US011897645B2

(12) United States Patent
Romo

(10) Patent No.: US 11,897,645 B2
(45) Date of Patent: Feb. 13, 2024

(54) PACKAGING MACHINE FOR OPENING BAGS ON A WEB OF BAGS AND METHODS OF USING THE SAME

(71) Applicant: Automated Packaging Systems, LLC, Streetsboro, OH (US)

(72) Inventor: David Romo, Mentor, OH (US)

(73) Assignee: Sealed Air Corporation (US), Charlotte, NC (US)

( * ) Notice: Subject to any disclaimer, the term of this patent is extended or adjusted under 35 U.S.C. 154(b) by 306 days.

(21) Appl. No.: 17/599,596

(22) PCT Filed: Apr. 1, 2020

(86) PCT No.: PCT/US2020/026080
§ 371 (c)(1),
(2) Date: Sep. 29, 2021

(87) PCT Pub. No.: WO2020/205915
PCT Pub. Date: Oct. 8, 2020

(65) Prior Publication Data

US 2022/0185521 A1 Jun. 16, 2022

Related U.S. Application Data

(60) Provisional application No. 62/828,394, filed on Apr. 2, 2019.

(51) Int. Cl.
*B65B 43/30* (2006.01)
*B65B 43/36* (2006.01)
(Continued)

(52) U.S. Cl.
CPC ..... *B65B 43/30* (2013.01); *B65B 5/045* (2013.01); *B65B 43/267* (2013.01); *B65B 43/36* (2013.01); *B65B 51/146* (2013.01); *B65B 57/02* (2013.01)

(58) Field of Classification Search
CPC ..... B65B 5/045; B65B 43/30; B65B 43/36; B65B 43/267; B65B 51/146; B65B 57/02
See application file for complete search history.

(56) References Cited

U.S. PATENT DOCUMENTS 3,254,468 A 6/1966 Hershey
3,254,828 A * 6/1966 Lerner ..... B65B 43/267 206/820

(Continued)

*Primary Examiner* — Thomas M Wittenschlaeger
*Assistant Examiner* — David G Shutty
(74) *Attorney, Agent, or Firm* — Jon M. Isaacson

(57) ABSTRACT

A packaging machine includes an indexing mechanism (210), a base (220), and a clamping arrangement (250). The indexing mechanism moves a web (10) of preformed bags along a path of travel. The base (220) is downstream of the indexing mechanism (210) along the path of travel and supports an engagement member (240) that includes a finger (242) having a beveled end (244). The clamping arrangement (250) supports a gripper (271) that includes a beveled surface (274) and a gripping surface (272). The base (220) further includes an engagement recess (222). The engagement member (240) is positioned within the engagement recess (220) and the beveled end (274) of the gripper (271) is capable of being disposed within the engagement recess. The indexing mechanism is configured to reverse index the web when the beveled end (274) of the gripper (271) is disposed within the engagement recess (222) so that the finger (242) and the gripper (271) are inserted into the top of one of the bags.

22 Claims, 52 Drawing Sheets

(51) Int. Cl.

| | |
|---|---|
| ***B65B 51/14*** | (2006.01) |
| ***B65B 57/02*** | (2006.01) |
| ***B65B 5/04*** | (2006.01) |
| ***B65B 43/26*** | (2006.01) |

(56) References Cited

U.S. PATENT DOCUMENTS

| | | | | | |
|---|---|---|---|---|---|
| 4,172,349 | A * | 10/1979 | Lipes | B65B 43/28 | 53/385.1 |
| 4,201,029 | A | 5/1980 | Lerner et al. | | |
| 4,253,292 | A * | 3/1981 | Lipes | B65B 43/30 | 53/506 |
| 4,291,517 | A * | 9/1981 | Lipes | B65B 43/28 | 53/469 |
| 4,899,520 | A | 2/1990 | Lerner et al. | | |
| 4,928,455 | A | 5/1990 | Gereby et al. | | |
| 5,172,537 | A * | 12/1992 | Wetter | B65B 43/28 | 53/248 |
| 5,341,625 | A | 8/1994 | Kramer | | |
| 5,371,521 | A | 12/1994 | Wehrmann | | |
| 5,394,676 | A | 3/1995 | Lerner et al. | | |
| 5,743,070 | A | 4/1998 | Lerner et al. | | |
| 5,957,824 | A | 9/1999 | Lerner et al. | | |
| 6,543,201 | B2 | 4/2003 | Cronauer | | |
| 6,742,317 | B2 | 6/2004 | Cronauer et al. | | |
| 7,654,064 | B2 * | 2/2010 | Riccardi | B65B 43/267 | 53/469 |
| 8,069,635 | B2 * | 12/2011 | Riccardi | B65B 5/045 | 53/385.1 |
| 8,271,138 | B2 * | 9/2012 | Eliuk | B66C 1/42 | 294/902 |
| 10,822,129 | B2 * | 11/2020 | Leap | B65B 61/04 | |
| 2006/0162291 | A1 * | 7/2006 | Gates | B65B 43/26 | 53/469 |
| 2009/0064637 | A1 | 3/2009 | Riccardi et al. | | |
| 2017/0203867 | A1 * | 7/2017 | Shook | B65B 43/267 | |
| 2018/0354668 | A1 * | 12/2018 | Leap | B65B 61/12 | |
| 2022/0185521 | A1 * | 6/2022 | Romo | B65B 43/36 | |

* cited by examiner

PACKAGING MACHINE FOR OPENING BAGS ON A WEB OF BAGS AND METHODS OF USING THE SAME

BACKGROUND

The present disclosure is in the technical field of machines and methods of using the same for opening bags on a web of bags. More particularly, the present disclosure is directed to machines and methods of using the same for opening bags on a web of bags so that the bags can be loaded with a product before the bags are closed and sealed.

U.S. Pat. No. 3,254,828, issued Jun. 7, 1966, to Hershey Lerner under the title Flexible Container Strips is directed to so called bags on a roll. U.S. Pat. No. 3,254,828 ("the AutoBag patent") is incorporated herein by reference in its entirety. The AutoBag patent discloses a web of bags interconnected by lines of weakness, preferably in the form of perforations, with each of the bags being open on one face. In use the bags are sequentially fed to a loading station. When at the loading station, each bag is blown open, a product is inserted and thereafter separated from the web and, if desired, the bag is then sealed to form a package.

These container strips in the form of chains of pre-opened bags are supplied either on a roll as taught in the AutoBag patent or festooned in a carton in the manner taught in U.S. Pat. No. 4,201,029, issued May 6, 1980, to Bernard Lerner et al. under the title Method and Apparatus for Packaging, ("the Wig-Wag patent"). Such container strips have been sold by Automated Packaging Systems, Inc. of Streetsboro, Ohio, the assignee of the present case, under the trademark AutoBag and have enjoyed great commercial success.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In a first embodiment, a packaging machine includes an indexing machine, a base, and a clamping arrangement. The indexing mechanism is configured to move a web of preformed bags along a path of travel. The web includes first and second plies that extend between two sides of the web, seals that extends across the web between the two sides of the web to form bottoms of the bags, and lines of weakness in at least the second ply at tops of the bags. Each of the bags includes a compartment located between the first and second plies, between the two sides, and between one of the seals at the bottom of the bag and one of the lines of weakness at the top of the bag.

The base is downstream of the indexing mechanism along the path of travel and configured to support a first engagement member. The first engagement member includes a first finger having a beveled end. The clamping arrangement is configured to support a first gripper. The first gripper includes a beveled surface and a gripping surface. The base further includes a first engagement recess. The first engagement member is positioned within the first engagement recess. The beveled end of the first gripper is capable of being disposed within the first engagement recess. The indexing mechanism is configured to reverse index the web when the beveled end of the first gripper is disposed within the first engagement recess so that the first finger and the first gripper are inserted into the top of one of the bags with the second ply sliding between the first gripper and the base and the first ply being engaged by the beveled end of the first gripper.

In a second embodiment, the indexing mechanism of the first embodiment is configured to reverse index the web until the first ply is engaged by the gripping surface of the first gripper.

In a third embodiment, the clamping arrangement of the second embodiment further includes a first gripping pad, a first gripper actuator configured to move the first gripper with respect to the first gripping pad, and a controller. The controller is configured to cause the first ply to be gripped between the first gripping surface and the first gripping pad by causing the first gripper actuator to move the first gripper toward the first gripping pad after the first ply is engaged by the gripping surface of the first gripper.

In a fourth embodiment, the packaging machine of the third embodiment, further includes a sensor configured to detect whether the first ply is gripped by the gripper and to send a signal to the controller in response to detecting that the first ply being gripped by the gripper.

In a fifth embodiment, the packaging machine of any of the previous embodiments is configured such that the base is further configured to support a second engagement member, where the second engagement member includes a second finger having a beveled end. The clamping arrangement is further configured to support a second gripper, where the second gripper includes a beveled surface and a gripping surface. The base further includes a second engagement recess, where the second engagement member is positioned within the second engagement recess and the beveled end of the second gripper is capable of being disposed within the second engagement recess. The indexing mechanism is further configured to reverse index the web when the beveled end of the second gripper is disposed within the second engagement recess so that the second finger and the second gripper are inserted into the top of the one of the bags with the second ply sliding between the second gripper and the base and the first ply being engaged by the beveled end of the second gripper.

In a sixth embodiment, the indexing mechanism of the fifth embodiment is configured to reverse index the web until the first ply is engaged by the gripping surface of the first gripper.

In a seventh embodiment, the packaging machine of any of the fifth to sixth embodiments is configured such that the first engagement member is configured to move laterally within the first engagement recess and the second engagement member is configured to move laterally within the second engagement recess.

In an eighth embodiment, the first and second engagement members of the seventh embodiment are configured to move laterally outward away from each other after the first and second fingers are inserted between the first and second plies to pull an opening of the bag taught between the first and second engagement members.

In an ninth embodiment, the clamping arrangement of any of the fifth to eighth embodiments is movable with respect to the base between open and closed positions, and the clamping arrangement is in the closed position when the first gripper is disposed within the first engagement recess and the second gripper is disposed within the second engagement recess.

In a tenth embodiment, the clamping arrangement of the ninth embodiment is configured to move away from the base after the first and second fingers and the first and second grippers have been inserted into the top of the one of the bags to form an opening at the top of the one of the bags.

In an eleventh embodiment, the packaging machine of the tenth embodiment is configured such that the first engagement member is configured to move laterally within the first engagement recess based on a predetermined size or shape of the opening at the top of the bag and the second engagement member is configured to move laterally within the second engagement recess based on the predetermined size or shape of the opening at the top of the bag.

In a twelfth embodiment, the first and second fingers and the first and second grippers of any of the tenth to eleventh embodiments are configured to hold the opening of the one of the bags as a product is loaded into the one of the bags.

In a thirteenth embodiment, the clamping arrangement of the twelfth embodiment is configured to move to the closed position to close the opening of the one of the bags after the product is loaded into the one of the bags and the packaging machine includes a sealing mechanism configured to form a closing seal in the one of the bags.

In a fourteenth embodiment, the first and second engagement members of the thirteenth embodiment are configured to move away from each other laterally with the first and second recesses, respectively, to flatten the opening of the bag before the closing seal is formed in the one of the bags.

In a fifteenth embodiment, the indexing mechanism of any of the thirteenth to fourteenth embodiments is configured to reverse index the web while the clamping arrangement is in the closed position to cause the line weakness in the second ply at the top of the one of the bags to break.

In a sixteenth embodiment, the first and second grippers of the fifteenth embodiment are configured to continue gripping the second ply as the clamping arrangement is moved away from the base after the closing seal is formed in the one of the bags and the line weakness in the second ply at the top of the one of the bags is broken.

In a seventeenth embodiment, the first and second grippers of the sixteenth embodiment are configured to open to allow the one of the bags to be removed from the packaging machine after the clamping arrangement is moved away from the base.

In an eighteenth embodiment, the base of any of the previous embodiments further includes a first horizontal ramp that protrudes outward from a flat portion that fits within the first engagement recess. The indexing of the web by the indexing mechanism causes one of the two sides of the web to slide over the flat portion and along the ramp toward the first fingers, which causes a line of weakness in the first ply to partially break near the first finger.

In a nineteenth embodiment, the packaging machine of any of the previous embodiments further includes a blower nozzle configured to supply a puff of air to help separate the first and second plies by the first finger.

In a twentieth embodiment, the packaging machine of any of the previous embodiments further includes a position sensor configured to detect a lateral position of the first engagement member.

In a twenty first embodiment, the packaging machine of the twentieth embodiment further includes a controller configured to determine whether the first finger has engaged the first finger ply based on an indication of the lateral position of the first engagement member from the position sensor.

In a twenty second embodiment, a method uses the packaging machine of any of the previous embodiments to open a bag. The method includes moving, by the indexing mechanism of the packaging machine, the web of preformed bags along a path of travel until one of the lines of weakness is downstream of the first finger and the first gripper. The method further includes moving the clamping arrangement of the packaging machine so that the beveled end of the first gripper is disposed within the first engagement recess. The method further includes reverse indexing the web, by the indexing mechanism, so that the first finger and the first gripper are inserted into the top of one of the bags with the second ply sliding between the first gripper and the base and the first ply being engaged by the beveled end of the first gripper.

BRIEF DESCRIPTION OF THE DRAWING

The foregoing aspects and many of the attendant advantages of the disclosed subject matter will become more readily appreciated as the same become better understood by reference to the following detailed description, when taken in conjunction with the accompanying drawings, wherein.

DETAILED DESCRIPTION

Exemplary embodiments of the present disclosure are directed to machines and methods of using the same for opening bags on a web of bags so that the bags can be loaded with a product before the bags are closed and sealed. It should be noted that various embodiments of machines and methods of using the same are disclosed herein, and any combination of these options can be made unless specifically excluded. In other words, individual components or portions of the disclosed machines can be combined unless mutually exclusive or otherwise physically impossible.

Figure 1:
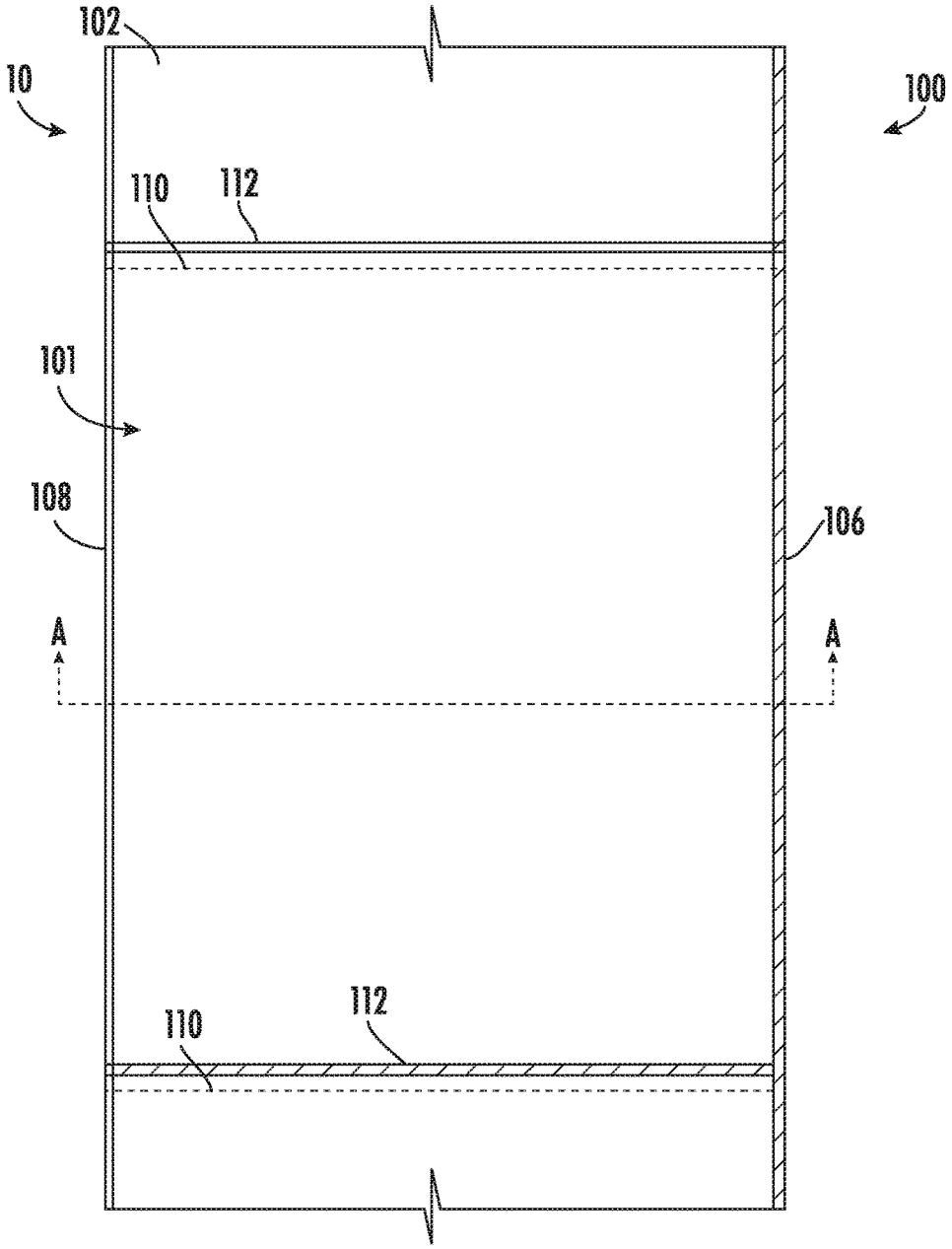
FIGS. 1 and 2 depict an embodiment of a web of bags, in accordance with the embodiments described herein.
Figure 2:
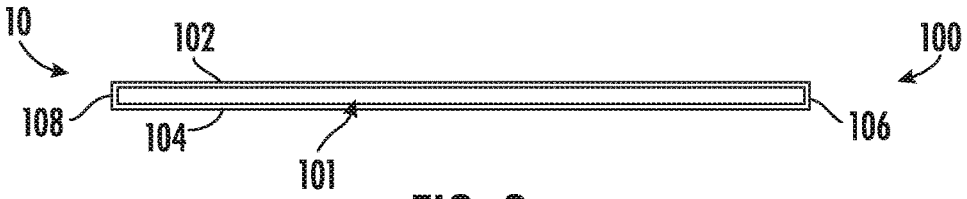

Referring now to FIGS. 1 and 2, an exemplary web 10 of bags 100 is shown. The web 10 can be supplied on a roll or from a box. The web 10 includes a first ply 102 and a second ply 104. The first and second plies 102, 104 may be two separate plies, or a single ply that is folded and joined together. In some embodiments, the first ply 102 and second ply 104 are portions of a tube of material that is flattened. In certain embodiments, the first ply 102 may be joined to the second ply 104 by various techniques including, but not limited to, heat sealing, ultrasonic welding, gluing, and the like.

The web 10 of preformed bags 100 is one example of the wide variety of different webs that may be used. Examples of acceptable webs of preformed interconnected bags include, but are not limited to, the webs disclosed in U.S. Pat. No. 3,254,828 to H. Lerner and U.S. Pat. No. 5,957,824 to B. Lerner et al., the contents of which are incorporated herein by reference in their entirety.

The first ply 102 and the second ply 104 may be formed of any suitable material. Examples of suitable materials include, but are not limited to, plastic materials, polyethylene, cellophane, vinyl films, pliofilms, cellulose acetate film, polystyrene, polypropylene, and virtually any type of heat sealable or ultrasonic weldable material.

The web 10 extends between a first edge or side 106 and second edge or side 108. One or both of the first and second sides 106, 108 can be formed from folds in a single piece of material, such as a flattened tube of material, or may be formed from seals that join the first ply 102 to the second ply 104. Seals joining the first and second plies 102, 104 can have a seal width such that the plies 102, 104 are not separable from each other until a distance equal to the seal width from the edge of the plies 102, 104. The bags 100 in the web 10 are separated by separating lines or areas of weakness 110 formed in one or both of the first and second plies 102, 104. In some embodiments, the separating lines or areas of weakness 110 are formed from a line of perforations, a slit, a thinner portion of material, or the like, that allow one of the bags 100 to be torn or otherwise removed from the web 10. A product 150 (e.g., FIGS. 3-4) can be inserted into the bag 100 while the bag 100 is part of the web 10 or can be inserted after the bag 100 is removed from the web 10.

Figure 3:
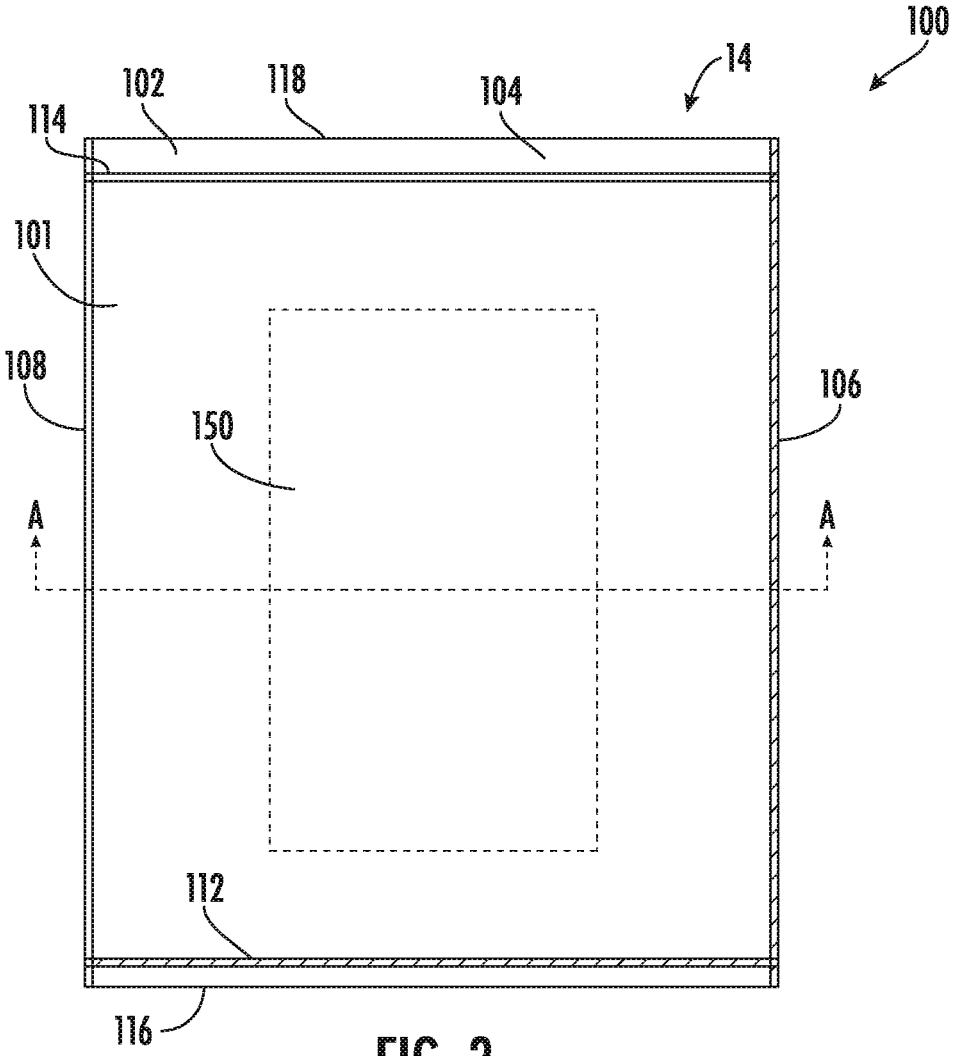
FIGS. 3 and 4 depict an embodiment of a bag removed from the web shown in FIGS. 1 and 2 by breaking two adjacent separating lines of weakness in the web, in accordance with the embodiments described herein.

A seal 112 extends across the web 10 from the first side 106 to the second side 108 near each of the separating lines of weakness 110 to form a bottom edge or side 116 of the bag 100. The seal 112 may be formed by various techniques including, but not limited to, heat sealing, ultrasonic welding, gluing, and the like. The first ply 102, second ply 104, first side 106, second side 108, and seal 112 define a compartment 101 for receiving a product 150 (e.g., as shown in FIG. 3). Although FIGS. 1-4 illustrate the bag 100 as having a single compartment 101, the bag 100 may have any number of compartments. Before product 150 is inserted into the compartment 101, the compartment 101 remains open along the top of the bag 100.

Figure 4:
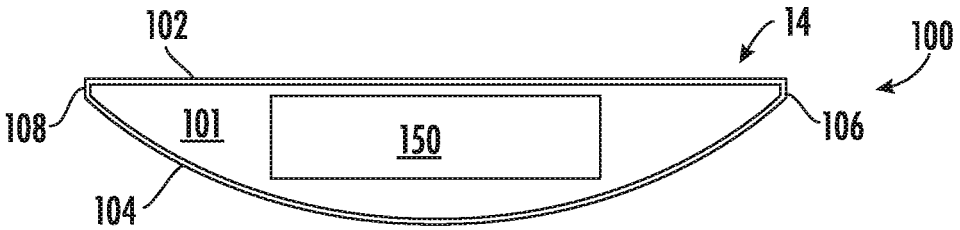
Figure 5:
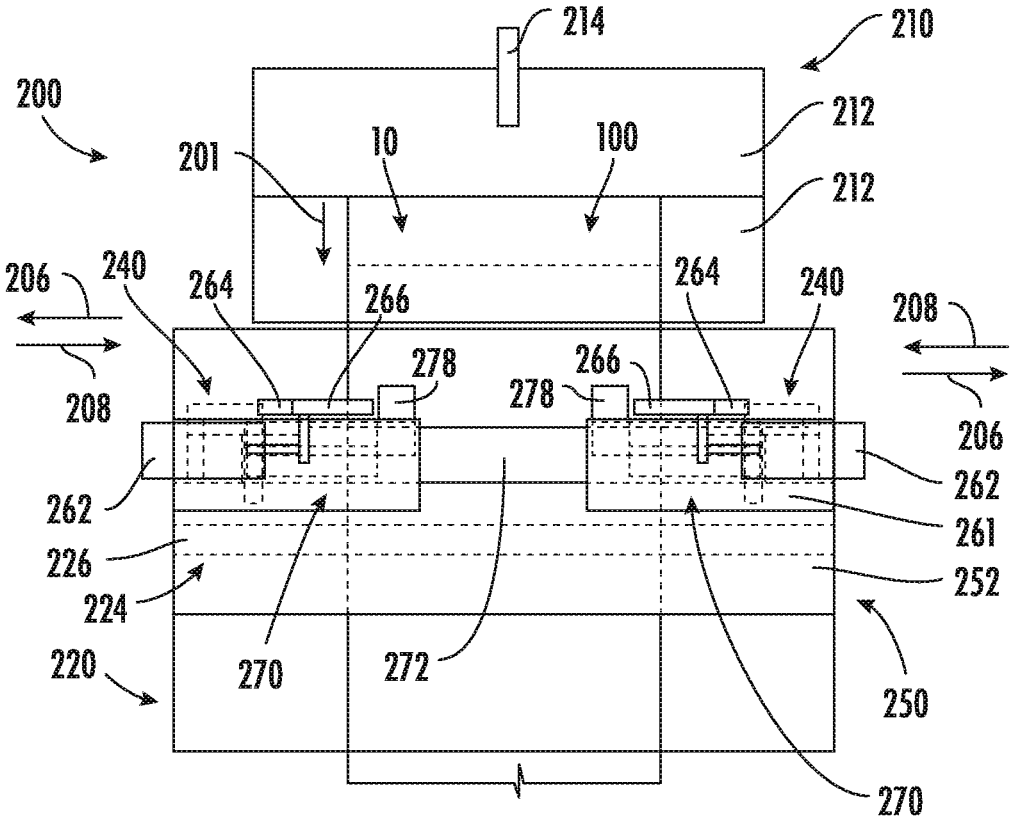
FIGS. 5, 6, and 7 depict front, top, and side views, respectively, of an instance of an embodiment of a packaging machine for opening and sealing the bags from an elongated web, in accordance with the embodiments described herein.
Figure 6:
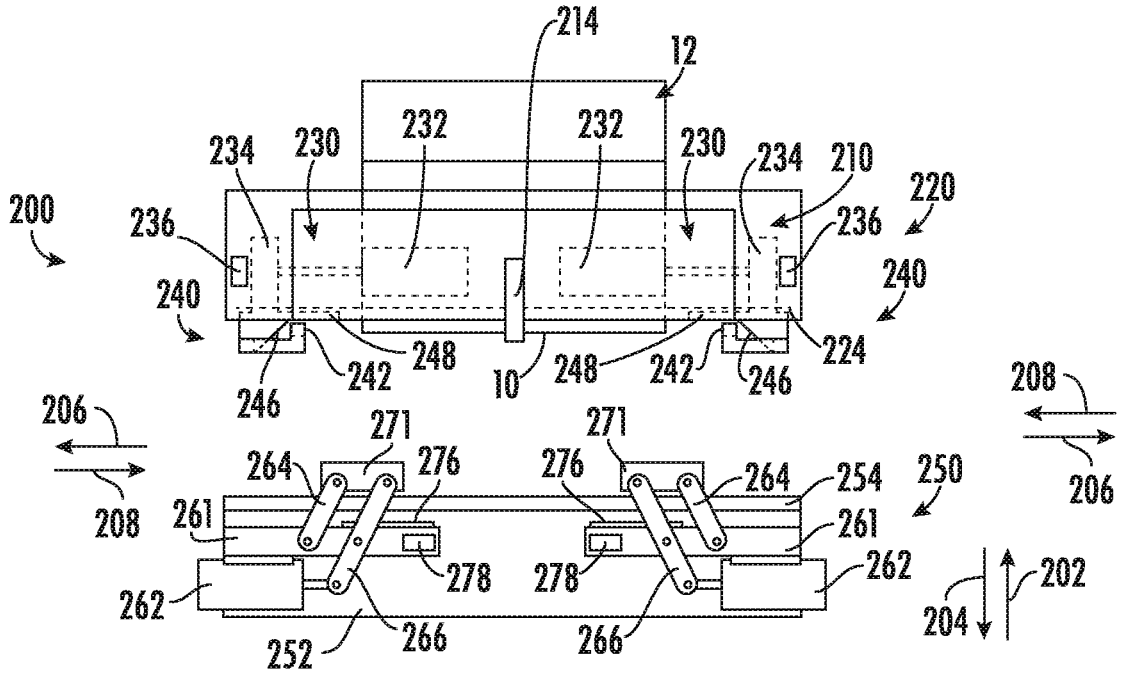
Figure 7:
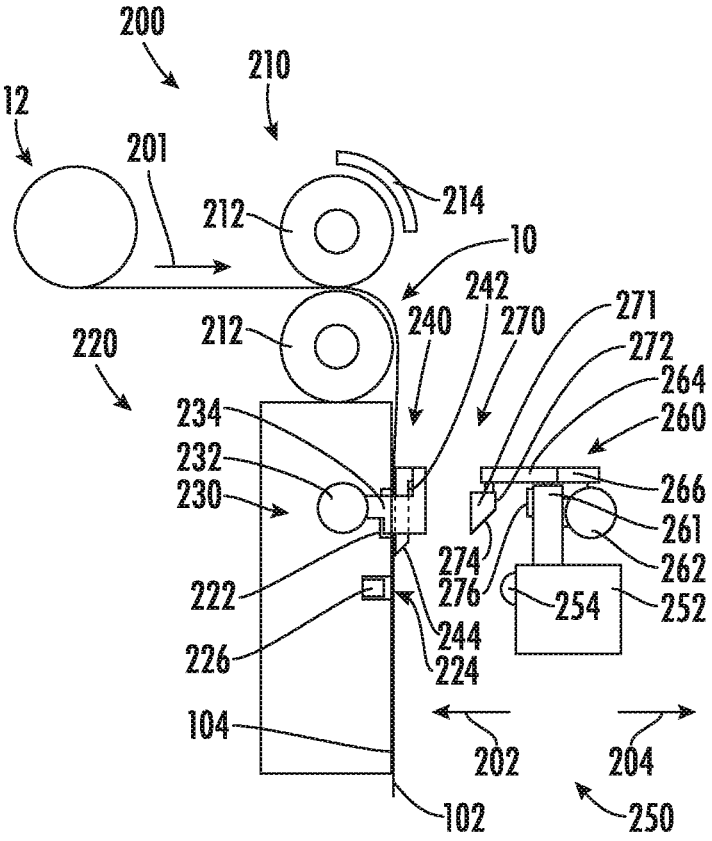
Figure 8:
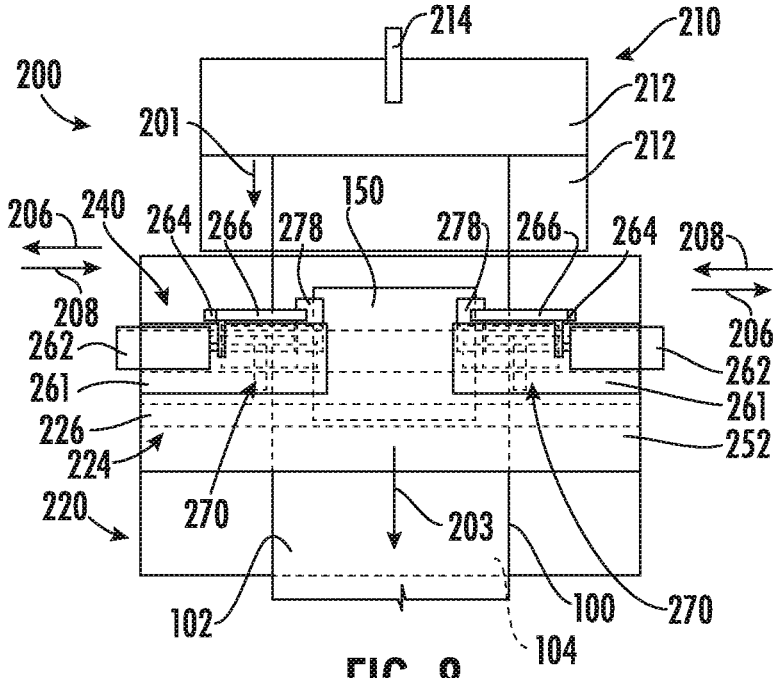
FIGS. 8, 9, and 10 depict front, top, and side views, respectively, of another instance of the packaging machine shown in FIGS. 5-7, in accordance with the embodiments described herein.

Referring now to FIGS. 3 and 4, one bag 100 is shown removed from the web 10. In some embodiments, the bag 100 can be removed from the web 10 by breaking two adjacent separating lines of weakness 100 in the web 10. The bag 100 extends from the bottom edge 116 formed by one of the broken separating lines of weakness 110 to a top edge 118 formed by the adjacent line of weakness 110 broken to separate the bag 100. The bag 100 is closed on three sides: the side edges 106, 108 and the bottom edge 116, which is closed by the seal 112. The bag 100 can be opened at the top edge 118 by separating the first and second plies 102, 104. Separating the first and second plies 102, 104 to open the bag 100 forms a product receiving opening (not shown) which allows the product 150 to be loaded into the compartment 101 of the bag 100. In some embodiments, the separating lines of weakness 110 in one or both of the plies 102, 104 do not extend fully to the sides 106, 108 of the web 10 to provide reinforcement during opening of and loading the product 150 through the product receiving opening. In certain embodiments, additional reinforcement of the product receiving opening is desirable to prevent tearing of the separating lines of weakness 110 while the product 150 is loaded by a bagging machine, such as the machines taught in herein.

As is shown in FIGS. 3 and 4, after the product 150 is loaded into the bag 100, the bag 100 can be sealed near the top 118 with a closing seal 114. In some embodiments, the closing seal 114 extends from the first side 106 to the second side 108 to seal the compartment 101. In some embodiments, the closing seal 114 may not extend all the way from the first side 106 to the second side 108 or may be intermittent to allow communication between the compartment 101 and external air. In some embodiments, the closing seal 114 allows communication between the compartment 101 and another optional compartment of the reclosable bag 100. In certain embodiments, the seal 114 may be formed by various techniques including, but not limited to, heat sealing, ultrasonic welding, gluing, and the like. Virtually any type of product 150 may be loaded into the reclosable bag 100 for delivery to a consumer. Examples of packaging machines that may be used to form the seal 114 are disclosed by U.S. Pat. Nos. 7,654,064; 8,069,635; and 5,743,070, as is described in more detail below. U.S. Pat. Nos. 7,654,064; 8,069,635; and 5,743,070 are incorporated herein by reference in their entirety.

Referring now to FIGS. 5-10, a schematic of an embodiment of a packaging machine 200 configured to open and seal the bags 100 of an elongated web 10 of preformed interconnected bags 100 is shown. In the depicted embodiment, the packaging machine 200 includes a supply 12 of the elongated web 10 of preformed interconnected bags 100, an indexing mechanism 210, a base 220, engagement actuation mechanisms 230, engagement members 240, a clamping arrangement 250, gripping actuation mechanisms 260, and gripping arrangements 270.

In the depicted embodiment, the supply 12 of the elongated web 10 is rolled to stage a relatively large amount of the web 10 in a relatively small space. In other embodiments the supply 12 of the elongated web 10 can be folded to stage a relatively large amount of the web 10 in a relatively small space. The web 10 is routed from the supply 12 along a path of travel 201 to the indexing mechanism 210. The indexing mechanism 210 receives the web 10 from the supply 12 and moves the web 10 along the path of travel 201. The indexing mechanism 210 may take a wide variety of different forms. For example, the indexing mechanism 210 can be any mechanism that is controlled to index bags of the web 10 to selected positions along the path of travel 201. In the depicted embodiment, the indexing mechanism 210 comprises a pair of rollers 212 that form a nip therebetween to engage the web 10. The rollers 212 can be selectively driven by a motor (not shown) to index bags 100 of the web 10 to selected positions along the path of travel 201.

The base 220 is downstream of the indexing arrangement 210 along the path of travel 201 and supports the engagement actuation mechanisms 230 and engagement members 240. The base 220 includes an engagement recess 222 in which the engagement members 240 are capable of traveling laterally in outward and inward directions 206, 208, respectively. The base 220 can also support actuators (not shown) for moving the clamping arrangement 250 between open and closed positions.

A sealing opening 224 in the base 220 below the engagement recess 222 exposes a heating element 226 positioned along the path of travel 201 to form the closing seal 114. The heating element 226 may take a wide variety of different forms. For example, heating element 226 may be any mechanism that applies heat to the web 10 to seal the first and second plies 102, 104 together to form the closing seal 114. The heating element 226 can also be configured to move toward and away from the path of travel of the web 201. In some embodiments, the bag 100 is sealed while the clamping arrangement 250 is holding the bag 100 closed.

The clamping arrangement 250 is moveable in closing and opening directions 202, 204, respectively by actuators (not shown). In the depicted embodiment, the clamping arrangement 250 also supports the gripping actuation mechanisms 260 and gripping arrangements 270. The clamping arrangement 250 includes a seal backing bar 252 and a seal backing element 254 that is selectively moved into and out of engagement with the sealing opening 224 and the heating element 226 by moving the clamping arrangement 250 in the closing and opening directions 202, 204. In some embodiments, the seal backing element 254 is not heated and is formed from an elastomeric material, such as rubber, to reduce wear from repeated engagement with the sealing opening 224 and heating element 226 and to avoid tearing the web 10 during the clamping and sealing steps.

When the web 10 is in the desired location for forming the closing seal 114, a controller (not shown) controls the clamping arrangement 250 to move in the closing direction 202 to clamp the web 10 between the seal backing element 254 and the heating element 226. In some embodiments, the seal backing bar 252 may be moved to the clamped position from the unclamped position under a low force, such as a force that is lower than a force that could injure a finger that might be between the seal backing element 254 and the heating element 226. In an exemplary embodiment, the heating element 226 is moved to a clamped position from an unclamped position and/or heat is applied by the heating element 226 only after the seal backing element 254 has been moved to the clamped position.

Heat is applied to the web 10 to seal the plies 102, 104 of the web 10 together between the first side 106 and the second side 108. The bag 100 can be sealed just below the separating line of weakness 110 or the web 10 can be indexed to any suitable position for forming the closing seal 114. The heating element 226 can be continuously on (e.g., always hot when the machine is turned on) or the heating element 226 can be controlled to only apply heat when the bag 100 is clamped and/or a seal signal is provided by the controller. The first and second plies 102, 104 are sealed together to form the closing seal 114 and close the compartment 101.

The engagement members 240 and gripping arrangements 270 are positioned along the path of travel 201 to open each bag 100 that is to be loaded and sealed. In some embodiments, a blower can also be included to assist in the opening of the bags 100. The engagement members 240, gripping arrangements 270, and blower can take a wide variety of different forms. For example, the illustrated embodiment includes a blower nozzle 214 positioned above the rollers 212 of the indexing arrangement 210. The nozzle 214 is oriented downward to blow air downward past the rollers 212 along the path of travel 201 of the web 10.

The engagement members 240 are moveable laterally along the engagement recess 222. In some embodiments, the engagement members 240 are arranged in a symmetrical and opposing relationship. In such an arrangement, the engagement members 240 are configured to both move in the inward direction 208—toward each other—or the outward direction 206—away from each other—substantially simultaneously. In some embodiments, the engagement members 240 include a downwardly protruding finger 242 with a beveled end 244 and a horizontal ramp 246 protruding outward from a flat portion 248 that fits within the engagement recess 222 of the base 220.

The fingers 242 extend vertically a distance that is long enough to sufficiently distribute opening forces so as to avoid tearing the sides 106, 108 of the bag 100 during opening. The beveled end 244 of the fingers 242 enables the fingers 242 to be more easily inserted between the plies 102, 104 of the web 10 to assist in the opening of each bag 100. When the web 10 is in an opening position along the path of travel 201 and between the engagement members 240, the engagement members 240 can be moved in the inward direction 208 to engage the sides 106, 108 of the web 10.

While moving inwardly, the sides 106, 108 slide over the flat portion 248 and along the ramp 246 toward the fingers 242. This movement can cause the separating lines of weakness 110 in the first ply 102 to partially break near the fingers 242, thereby forming an opening through which the fingers 242 can be inserted by reverse indexing the web 10. A puff of air from the blower nozzle 214 can optionally be supplied to help separate the plies 102, 104 when engaging the fingers 242. After being inserted between the plies 102, 104 of the web 10, the fingers 242 can be moved in the outward direction 206 to pull the opening of the bag 100 taught between the two engagement members 240.

In some embodiments, the engagement members 240 are moved laterally by engagement actuation mechanisms 230. In the depicted embodiment, the engagement actuation mechanisms 230 include an actuator 232, a coupling member 234, and a position sensor 236. The coupling members 234 couples the actuators 232 to the engagement members 240. The actuator 232 can be any kind of actuator that is configured to move the engagement members 240 laterally within the engagement recess 222, such as, for example, a pneumatic actuator, a linear actuator, a linear motor, a belt drive, a chain drive, a gear drive, or the like. The position sensors 236 can be used to detect the lateral position of the actuators 232, coupling members 234, and/or the engagement members 240. For example, the position sensors 236 can be configured to send a signal to the controller when the position sensors 236 detect that the engagement members 240 are in an initial or home position that is the outwardmost position of the engagement members 240. The position sensor 236 can be any suitable sensor, such as, for example, a limit switch, a proximity sensor, or the like. In some embodiments, the position sensor 236 is integrated with the actuator 232 so that the sensor 236 may be triggered when the actuator 232 is fully actuated in an open and/or closed position.

In some embodiments, the gripping arrangements 270 are coupled to gripping actuation mechanisms 260. In the depicted embodiment, the gripping actuation mechanisms 260 are coupled to the seal backing bar 252 of the clamping mechanism 250. In this arrangement, the gripping arrangements 270 move in the closing and opening direction 202, 204 when the clamping mechanism 250 opens and closes. The gripping actuation mechanisms 260 can be coupled to the seal backing bar 252 with fasteners to enable adjustment to a variety of positions spaced apart laterally along the seal backing bar 252. In some embodiments, the gripping actuation mechanisms 260 are moveably coupled to the seal backing bar 252 and are provided with actuators so that the lateral position of the gripping actuation mechanisms 260 can be controlled by the controller and moved in outward and inward directions 206, 208.

Figure 9:
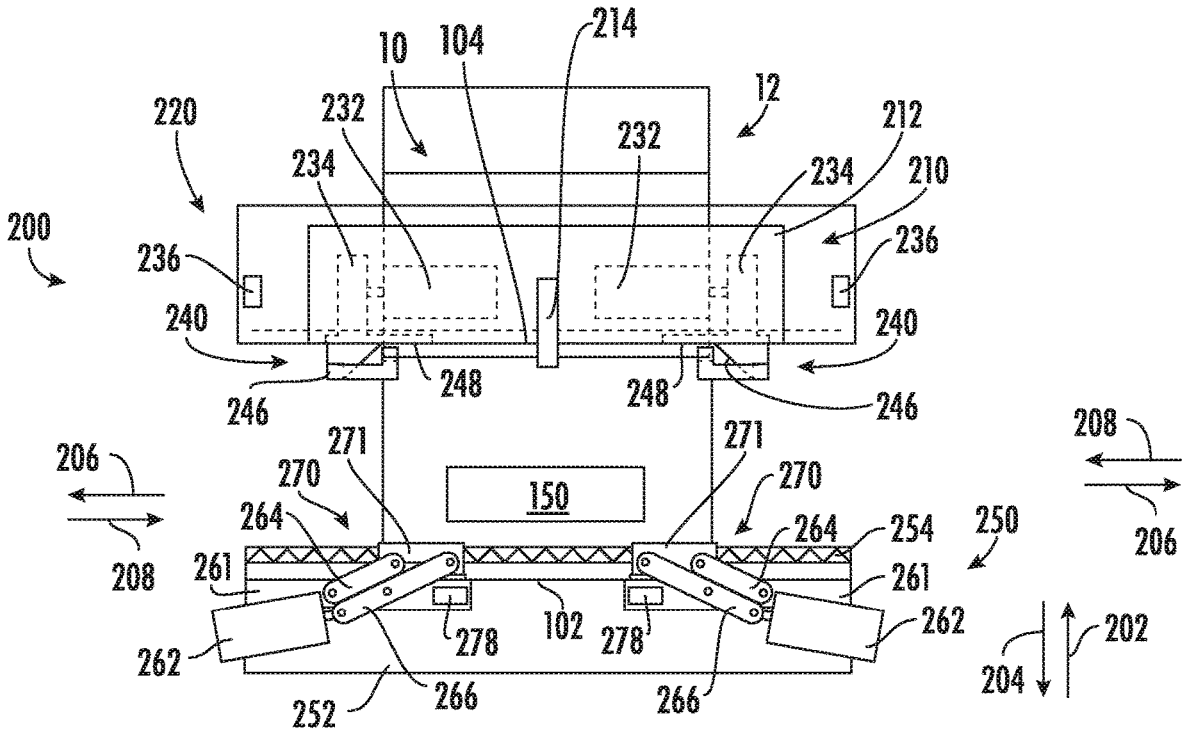
Figure 10:
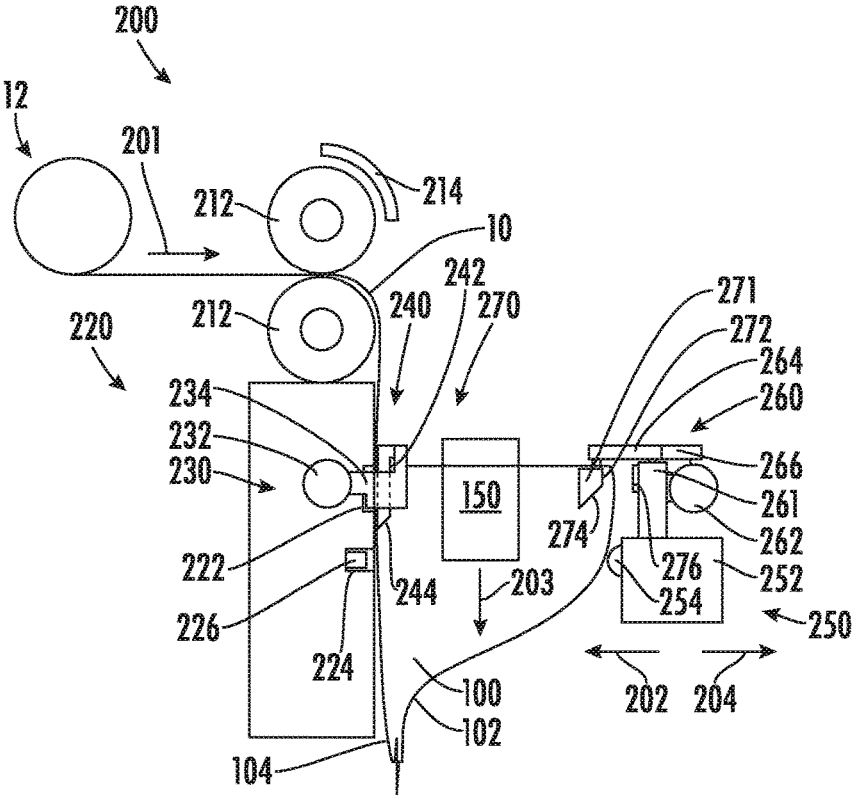
Figure 11:
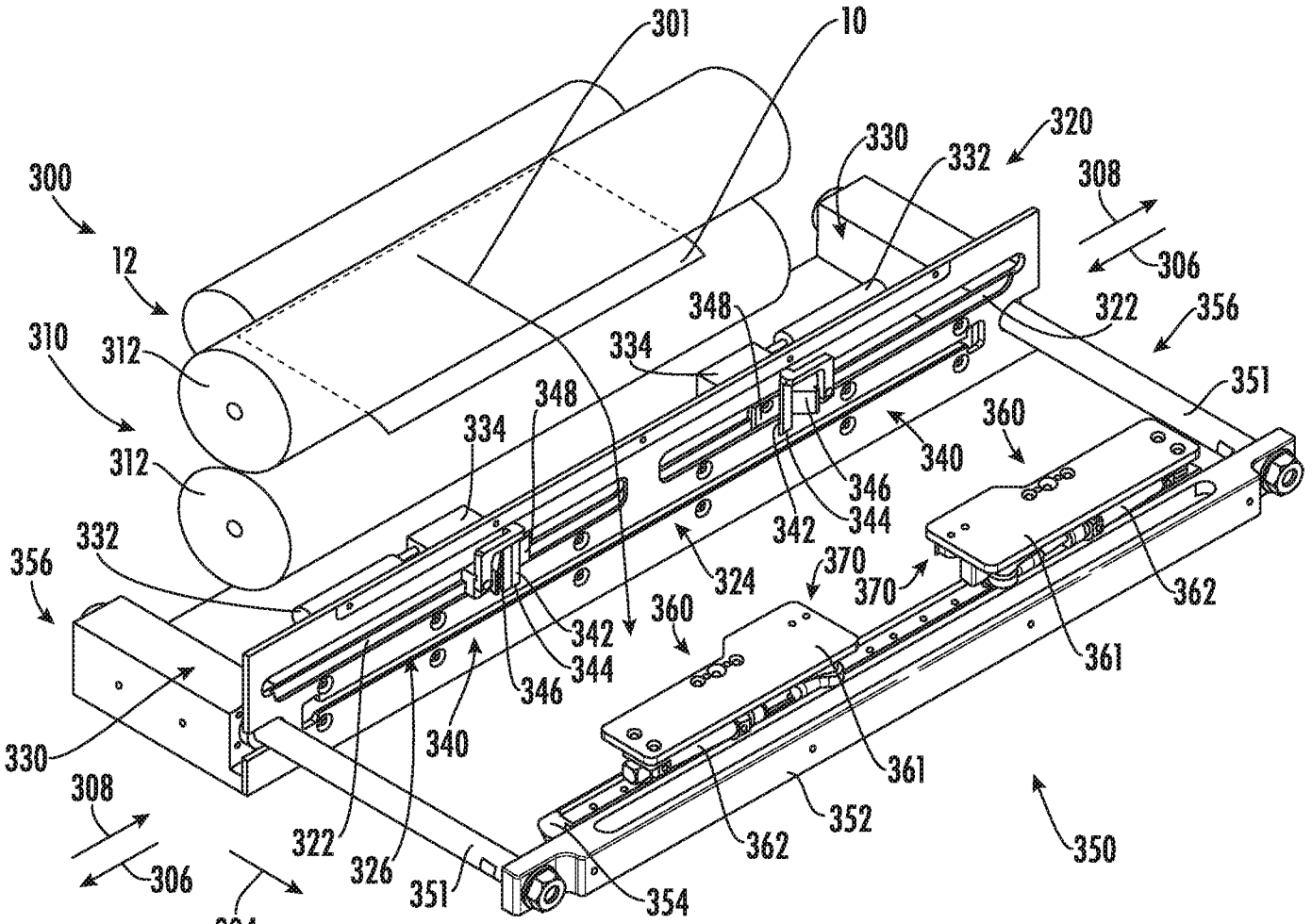
FIGS. 11-17 depict various views of an embodiment of a packaging machine, and components thereof, having a clamping arrangement that is in an open position and gripping arrangements that are closed, in accordance with the embodiments described herein.
Figure 12:
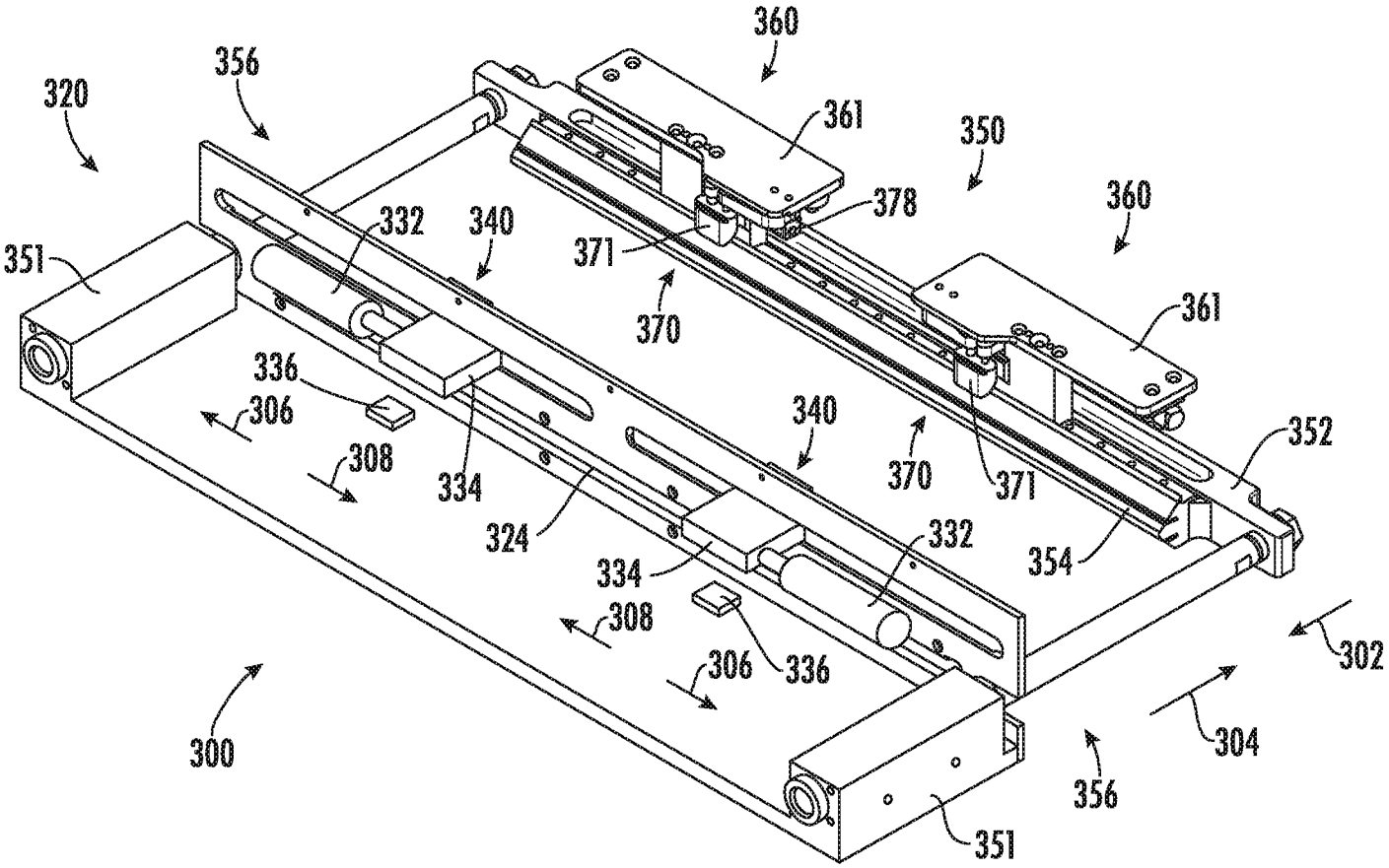
Figure 13:
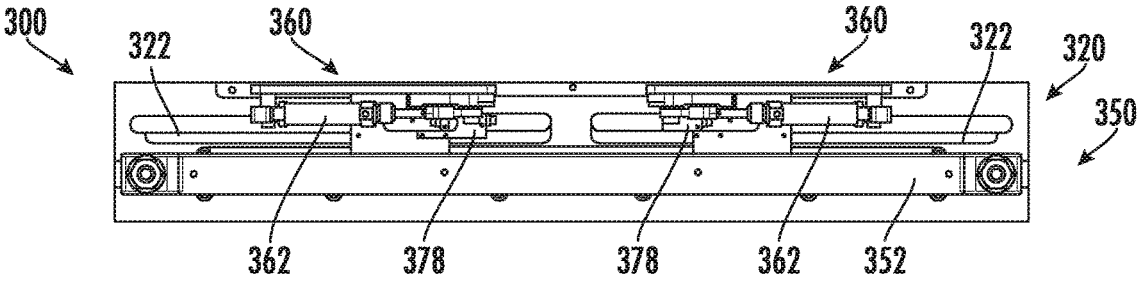
Figure 14:
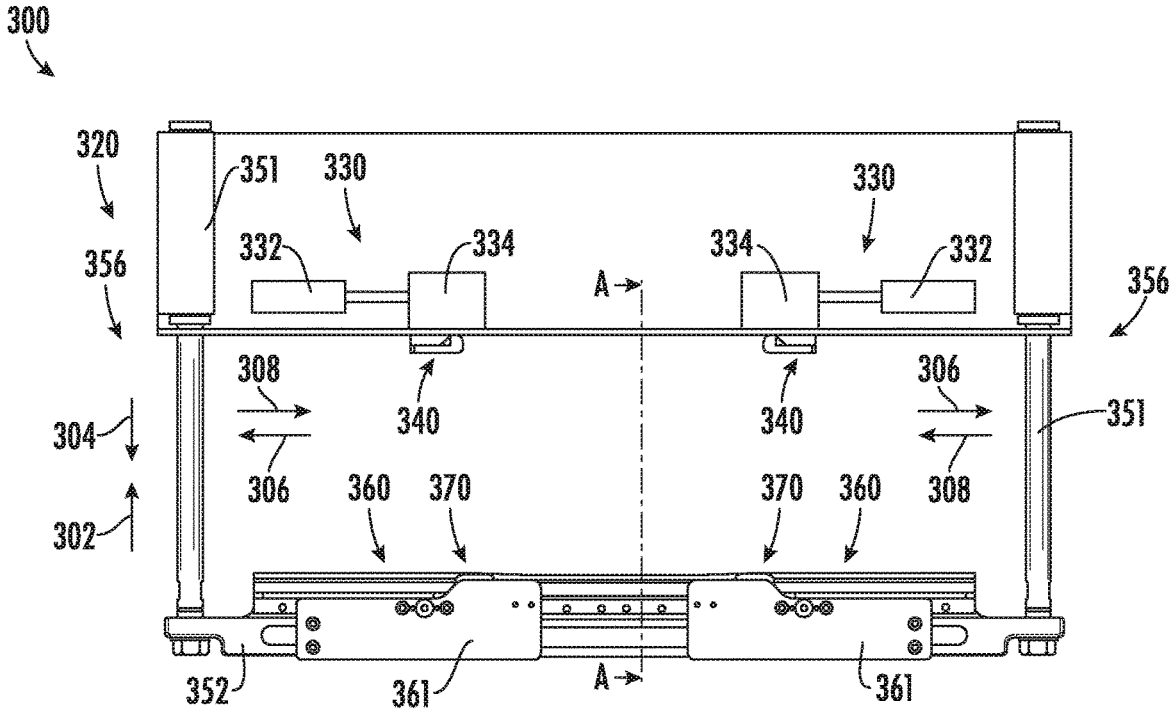
Figure 15:
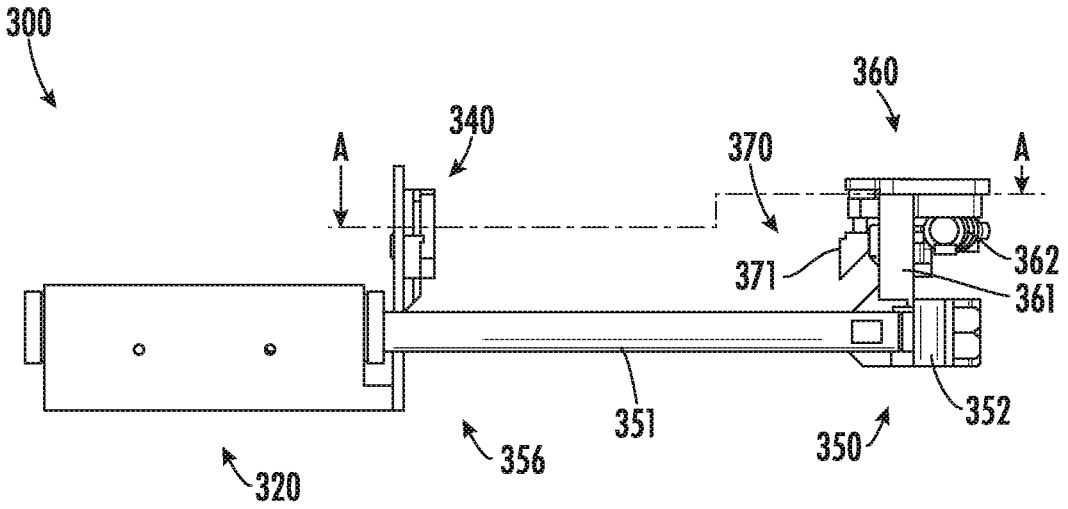
Figure 16:
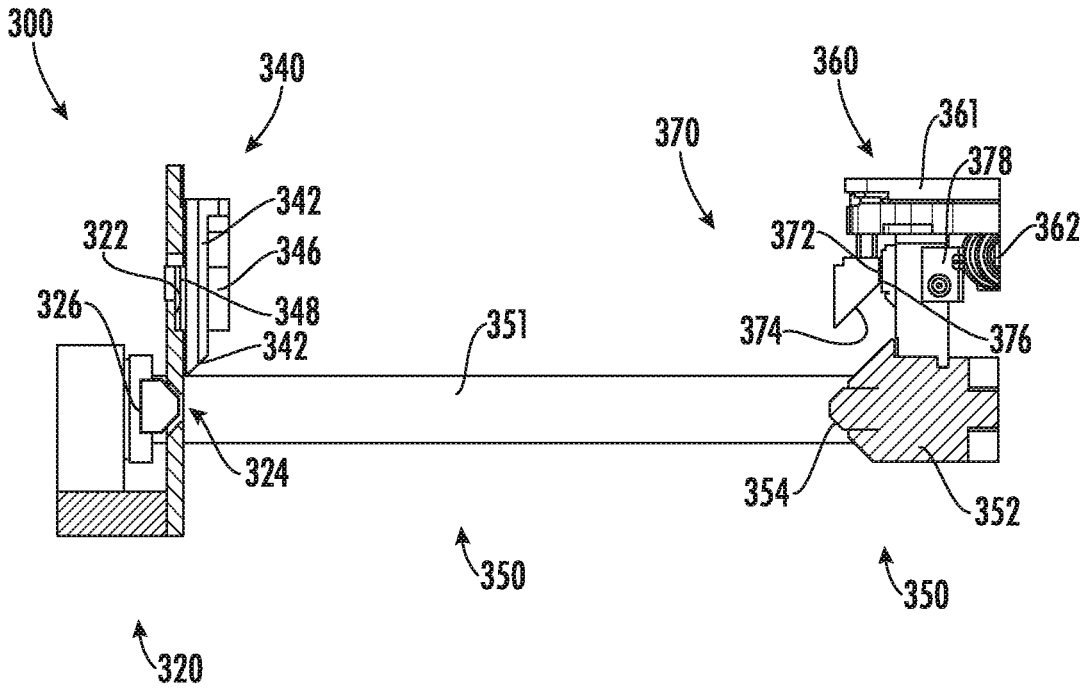
Figure 17:
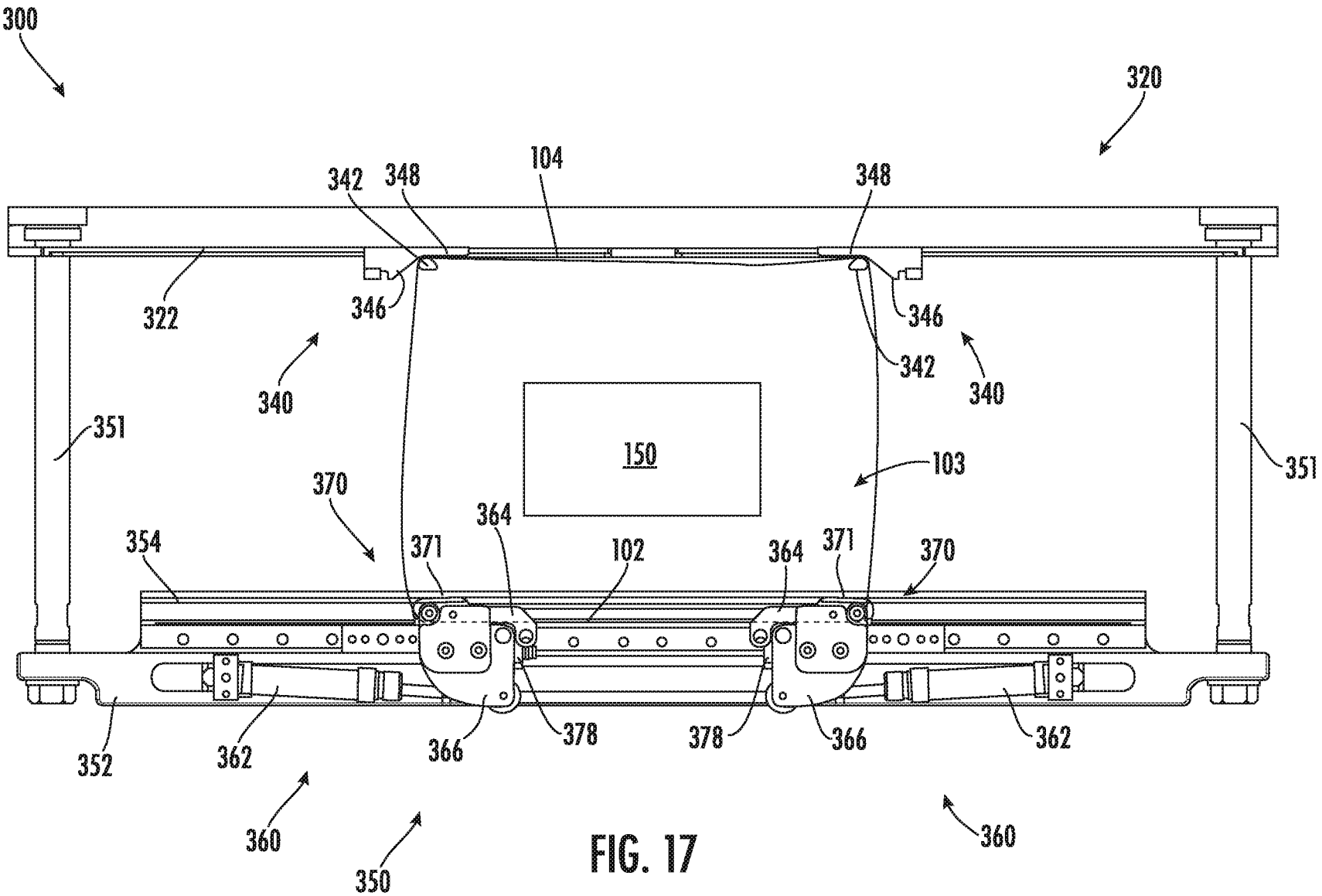
Figure 19:
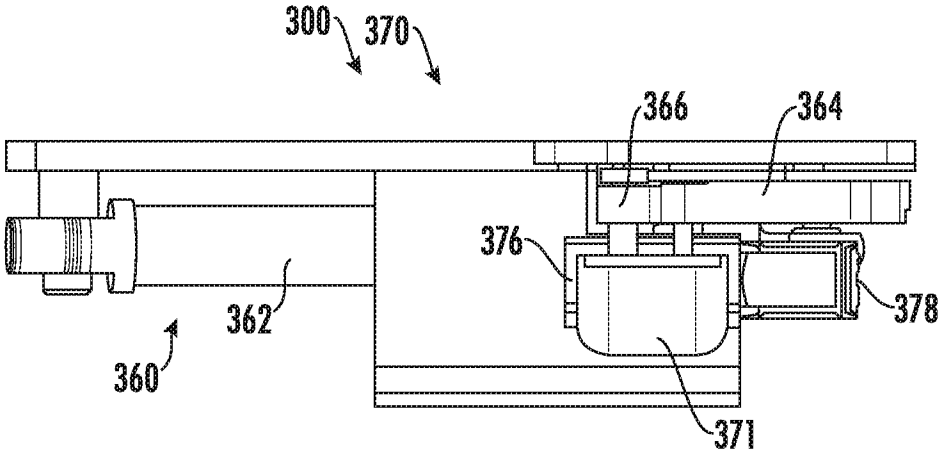
FIGS. 18-27 depict various views of embodiments of the gripping arrangements and gripping actuation mechanisms of the packaging machine depicted in FIGS. 11-17, in accordance with the embodiments described herein.
Figure 21:
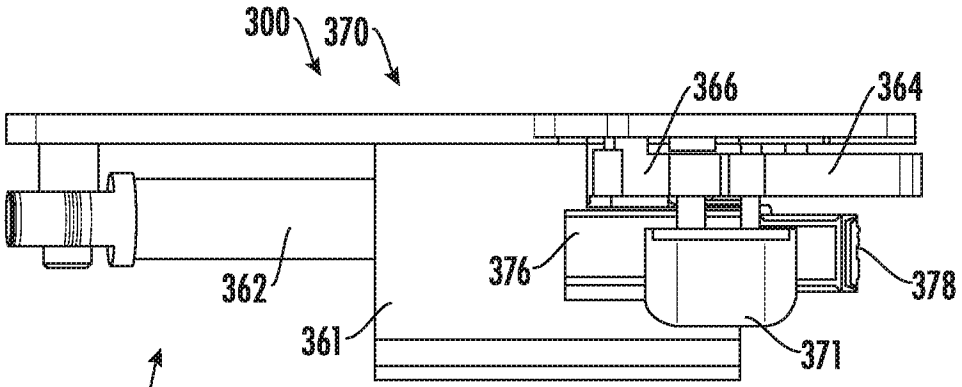
Figure 18:
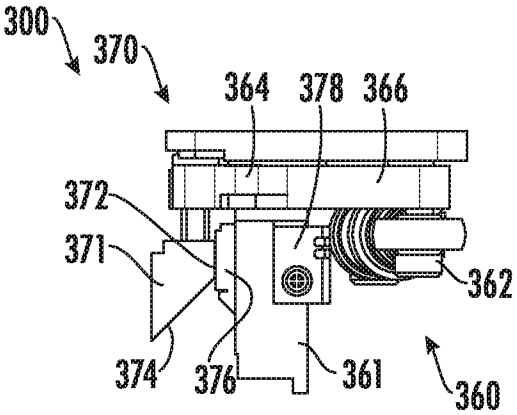
Figure 20:
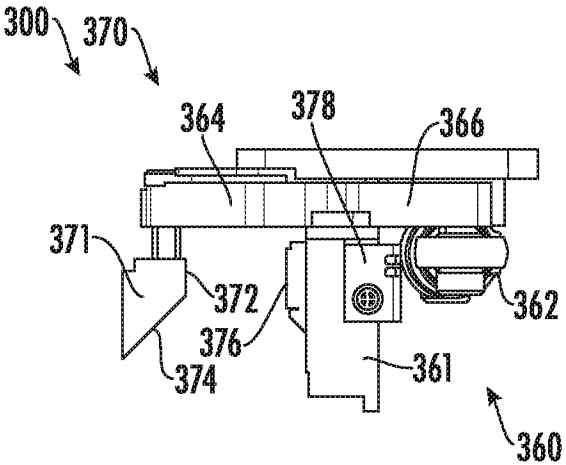
Figure 22:
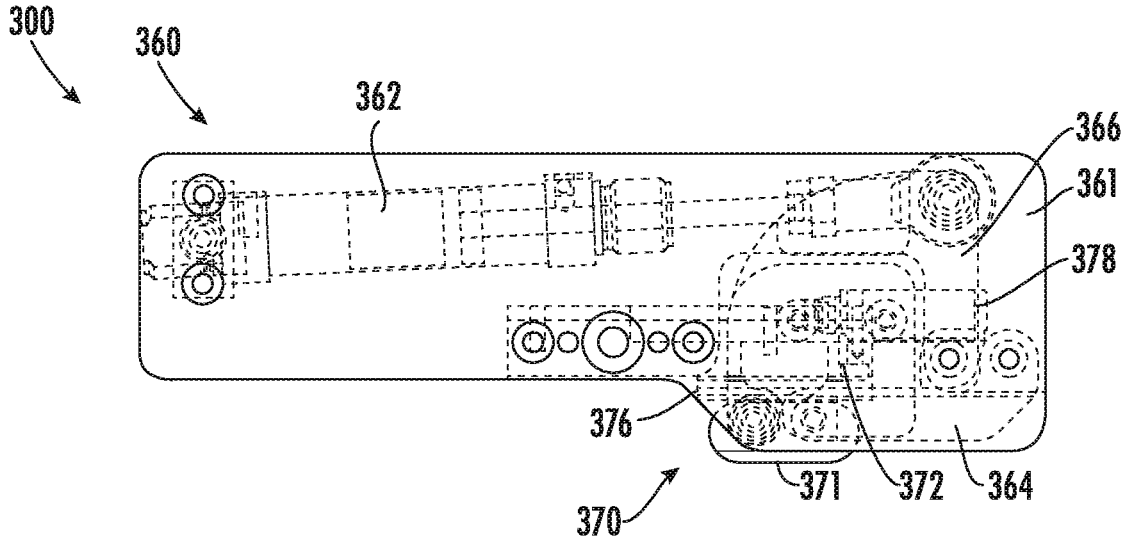
Figure 23:
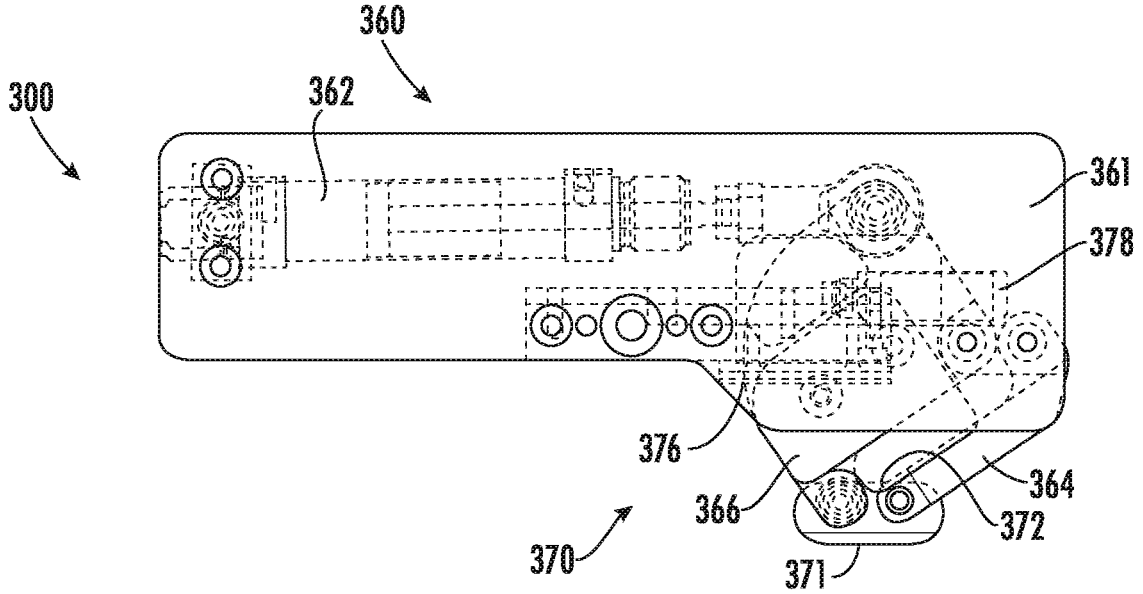
Figure 24:
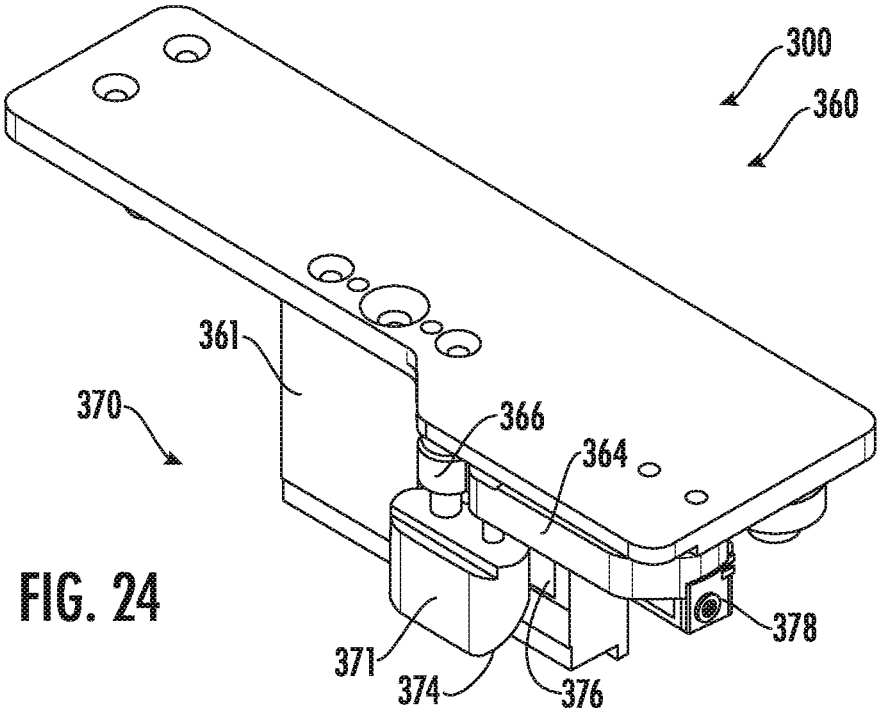
Figure 25:
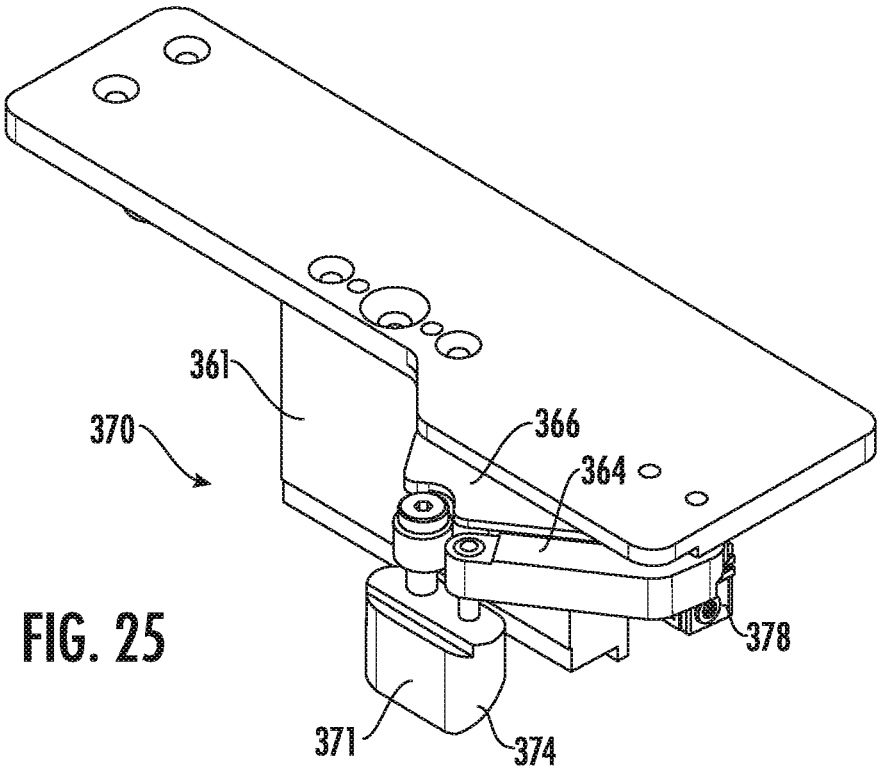
Figure 26:
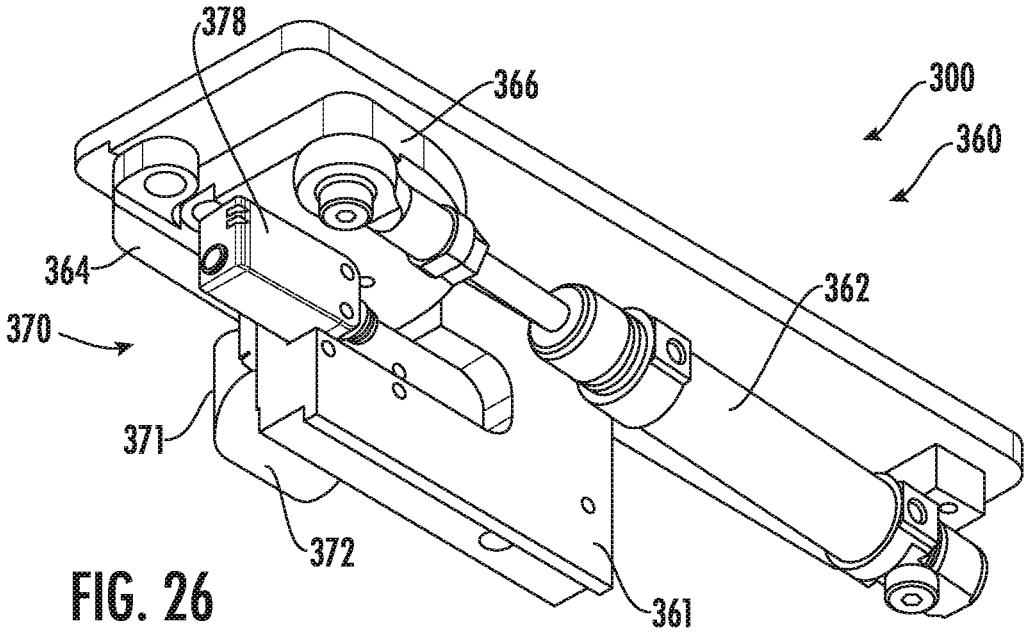
Figure 27:
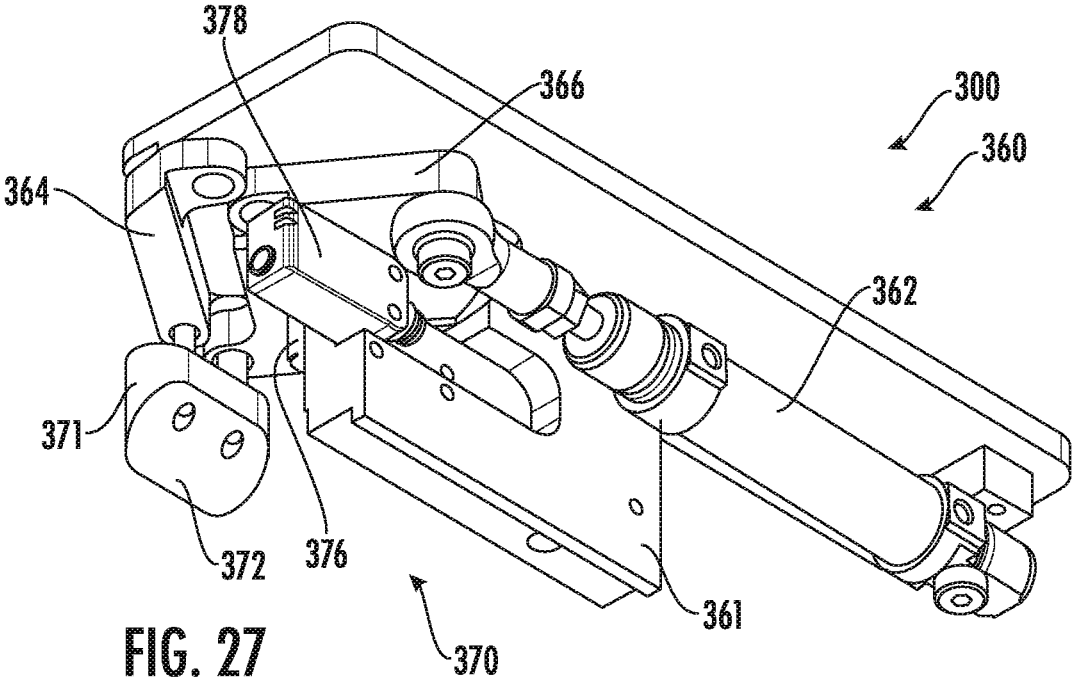
Figure 32:
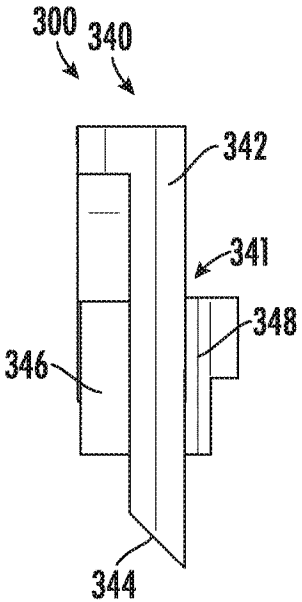
FIGS. 28-36 depict various views of embodiments of engagement members of the packaging machine depicted in FIGS. 11-17, in accordance with the embodiments described herein.
Figure 29:
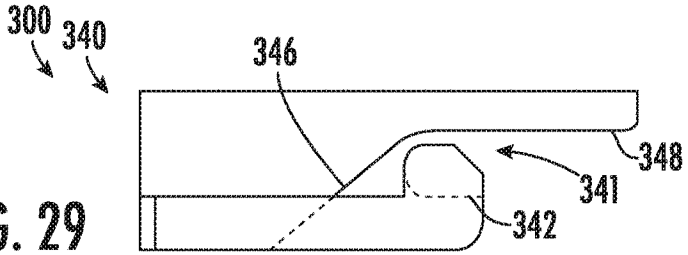
Figure 28:
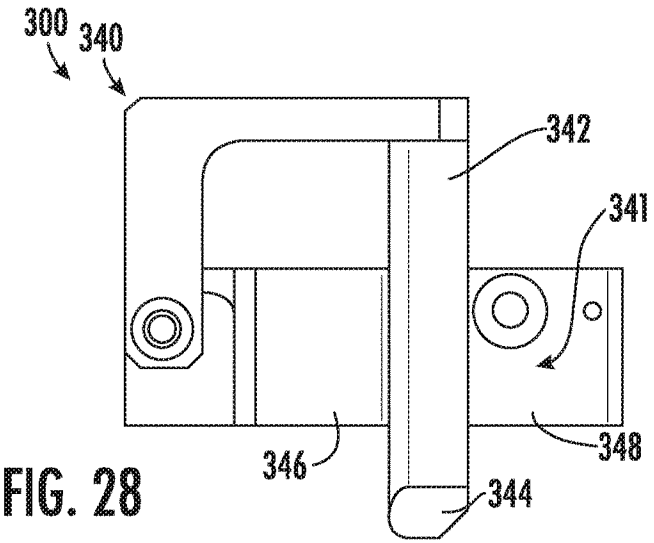
Figure 30:
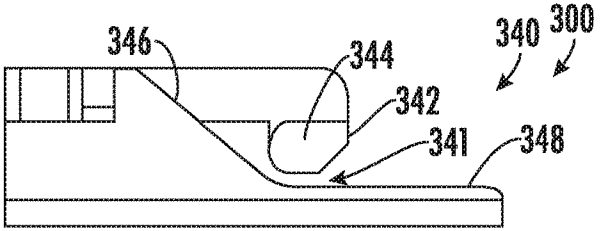
Figure 31:
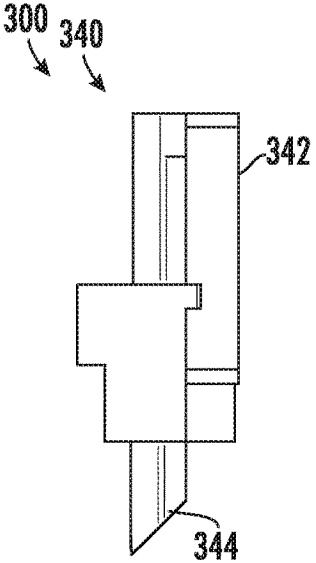
Figure 33:
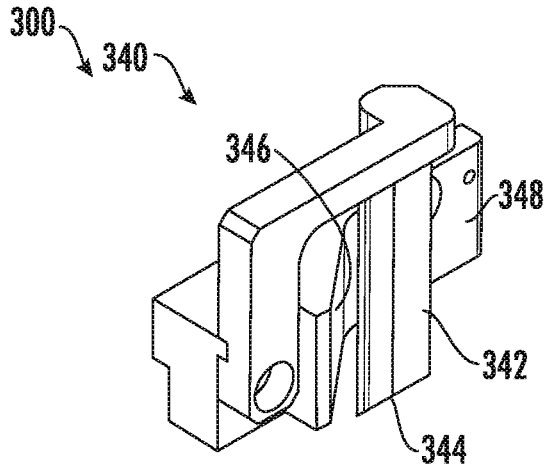
Figure 34:
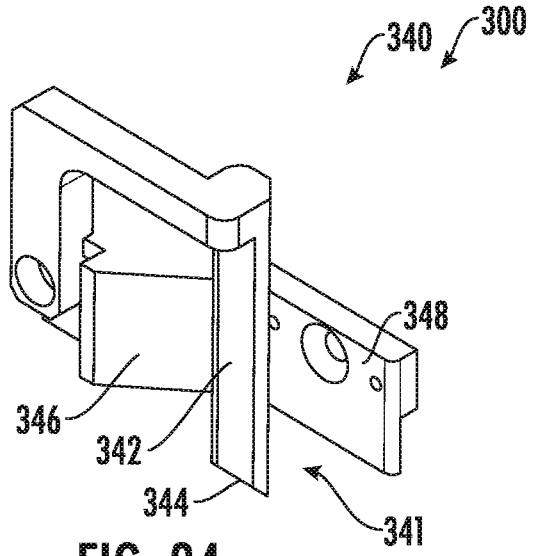
Figure 35:
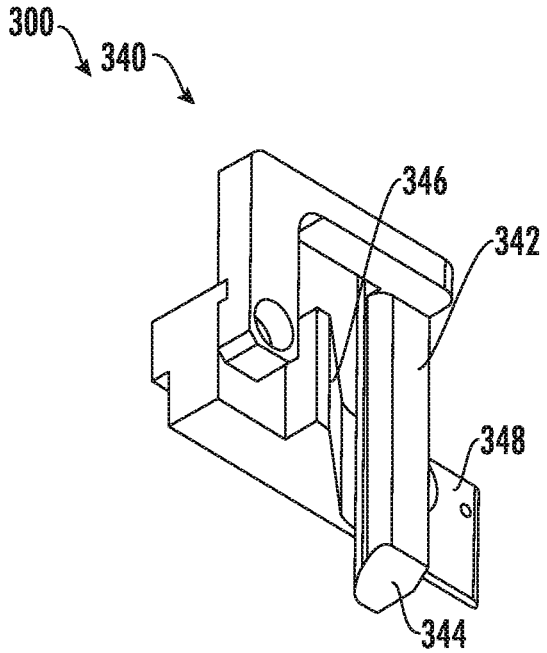
Figure 36:
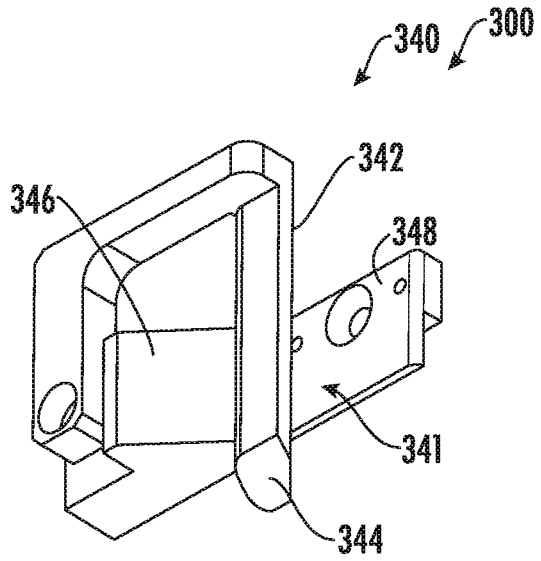

In some embodiments, the gripping actuation mechanisms 260 each include a base 261 to which an actuator 262 is attached. In the depicted embodiment, the actuator 262 is coupled to a four-bar linkage formed by a guide linkage 264, a drive linkage 266, the base 261, and the gripping arrangements 270. The guide and drive linkages 264, 266 are pivotably coupled to the base 261 and the gripping arrangements 270 such that movement of an end of the drive linkage 266 by the actuator 262 causes the gripping arrangements 270 to open (FIG. 6) and close (FIG. 9). The actuator 262 can be any kind of actuator that is configured to move the open and close the gripping arrangements 270, such as, for example, a pneumatic actuator, a linear actuator, a linear motor, a belt drive, a chain drive, a gear drive, or the like. The gripping actuation mechanisms 260 take on a variety of different forms, however, that can include direct rotation or movement of the gripping arrangements 270 with servo motors and the like.

In some embodiments, the gripping arrangements 270 include a gripper 271, a gripping pad 276, and a gripping sensor 278. The gripper 271 includes a vertical gripping surface 272 and a beveled end 274. In some embodiments, the gripping arrangement 270 is closed by moving the gripper 271 toward the gripping pad 276 and is opened by moving the gripper 271 away from the gripping pad 276. The gripper 271 can be moved by the gripping actuation mechanism 260 such that the gripping surface 272 maintains a substantially parallel relationship with the surface of the gripping pad 276. In some embodiments, the gripping pad 276 is formed from an elastomeric material so as to avoid tearing the material of the web 10 during gripping and opening.

The beveled end 274 of the gripper 271 enables the gripper 271 to be more easily inserted between the plies 102, 104 of the web 10 to assist in the opening of each bag 100. To capture the first ply 102 of the web 10 when opening the bags 100, the gripping arrangements 270 are opened and the clamping arrangement 250 is closed such that the beveled ends 274 of the grippers 271 are disposed within the engagement recess 222 of the base 220. In this position, the beveled ends 274 are positioned beyond the path of travel 201 of the web 10. When the web 10 is reverse indexed by the indexing mechanism 210, the second ply 104 slides between the grippers 271 and the base 220 while the first ply 102 is engaged by the beveled end 274 of the gripper 271 so that the first ply 102 slides upward between the gripping surface 272 and the gripping pad 276. The top of the gripper 271 is arranged to be approximately aligned vertically with the tops of the fingers 242 to avoid bunching up or sliding of the plies 104, 102 held by the fingers 242 and the gripping arrangements 270, respectively during opening of the bags 100. Thus, forces acting on the bag 100 during opening can be disposed substantially orthogonal to the surface of the bag 100 so that the bag 100 tends to remain in place rather than sliding off of the fingers 242 or grippers 271 as the bag 100 is opened.

The gripping sensor 278 can be used to detect whether the gripping arrangement 270 has successfully gripped the web 10. For example, the gripping sensor 278 may be able to detect the presence of the web 10 between the gripper 271 and the gripping pad 276. In some embodiments, the gripping sensor 278 can be configured to send a signal to the controller when the sensor 278 detects that the web 10 has been successfully gripped. In the illustrated embodiment, the gripping sensor 278 is positioned such that the first ply 102 that is successfully gripped by the gripper 271 will be directly in front of the sensor 278. In this embodiment, the sensor is a short-range optical sensor 278 calibrated to detect the material of the web 10. The gripping sensor 278 can be any suitable sensor, such as, for example, a proximity sensor, an optical sensor, an infrared sensor, a contact sensor, or the like. In some embodiments, the gripping sensor 278 is integrated in the gripper 271 and/or the gripping pad 276 and is configured to detect the presence of the material of the web 10.

Referring now to FIG. 9, the engagement members 240 and gripping arrangements 270 allow the bag 100 to be opened so that the product 150 can be loaded into the bag 100 through an opening 103. In the embodiments, the engagement members 240 and gripping arrangements 270 are configured to hold the bag 100 so that the opening 103 is substantially rectangular. In other embodiments, the engagement members 240 and gripping arrangements 270 are configured to hold the bag 100 any other shape, such as a triangular shape, a trapezoidal shape, any other polygonal shape, or any other shape. This opening 103 allows the product 150 to be packaged inside the bag 100. For example, when the product 150 is rectangular (e.g., a box) and the opening 103 is a rectangular opening, the rectangular opening can allow the product 150 to be packaged in the bag 100. After the product 150 is loaded, the bag 100 is sealed closed with a closing seal 114 to form a sealed package 14 containing the product 150 within the compartment 101, as can be seen in FIGS. 3 and 4. In some embodiments, the lateral positions of the engagement members 240 and/or the gripping arrangements 270 can be adjusted to form shaped openings having different proportions, depending on the size of the web 10 and the product 150 to be packaged within the bag 100.

Referring now to FIGS. 11-36, an embodiment of a packaging machine 300 for opening and sealing the bags 100 of an elongated web 10 of preformed interconnected bags 100 is shown. In the depicted embodiment, the packaging machine 300 includes a supply 12 of the elongated web 10 of preformed interconnected bags 100, an indexing mechanism 310, a base 320, engagement actuation mechanisms 330, engagement members 340, a clamping arrangement 350, gripping actuation mechanisms 360, and gripping arrangements 370. The packaging machine 300 is shown in FIGS. 11-17 with the clamping arrangement 350 in an open position and the gripping arrangements 370 closed.

In the depicted embodiment, the supply 12 of the elongated web 10 is rolled to stage a relatively large amount of the web 10 in a relatively small space. In other embodiments the supply 12 of the elongated web 10 can be folded to stage a relatively large amount of the web 10 in a relatively small space. The web 10 is routed from the supply 12 along a path of travel 301 to the indexing mechanism 310. The indexing mechanism 310 receives the web 10 from the supply 12 and moves the web 10 along the path of travel 301. The indexing mechanism 310 may take a wide variety of different forms. For example, the indexing mechanism 210 can be any mechanism that is controlled to index bags of the web 10 to selected positions along the path of travel 301. In the depicted embodiment, the indexing mechanism 310 comprises a pair of rollers 312 that form a nip therebetween to engage the web 10. The rollers 312 can be selectively driven by a motor (not shown) to index bags 100 of the web 10 to selected positions along the path of travel 301.

The base 320 is downstream of the indexing arrangement 310 along the path of travel 301 and supports the engagement actuation mechanisms 330 and engagement members 340. The base 320 includes an engagement recess 322 in which the engagement members 340 are capable of traveling laterally in outward and inward directions 306, 308, respectively. The base 320 can also support actuators 351 for moving the clamping arrangement 350 between open and closed positions.

A sealing opening 324 in the base 320 below the engagement recess 322 exposes a heating element 326 (FIG. 16) positioned along the path of travel 301 to form the closing seal 114. The heating element 326 may take a wide variety of different forms. For example, heating element 326 may be any mechanism that applies heat to the web 10 to seal the first and second plies 102, 104 together to form the closing seal 114 may be implemented. The heating element 326 can also be configured to move toward and away from the path of travel of the web 301. In some embodiments, the bag 100 is sealed while the clamping arrangement 350 is holding the bag 100 closed.

The clamping arrangement 350 is moveable in closing and opening directions 302, 304, respectively by actuators 351. In the depicted embodiment, the clamping arrangement 250 also supports the gripping actuation mechanisms 360 and gripping arrangements 370. The clamping arrangement 350 includes a seal backing bar 352 and a seal backing element 354 that is selectively moved into and out of engagement with the sealing opening 324 and the heating element 326 by moving the clamping arrangement 350 in the closing and opening directions 302, 304. In some embodiments, the seal backing element 354 is not heated and is formed from an elastomeric material, such as rubber, to reduce wear from repeated engagement with the sealing opening 324 and heating element 326 and to avoid tearing the web 10 during the clamping and sealing steps.

When the web 10 is in the desired location for forming the closing seal 114, a controller (not shown) controls the clamping arrangement 350 to move in the closing direction 302 to clamp the web 10 between the seal backing element 354 and the heating element 326. In some embodiments, the seal backing bar 352 may be moved to the clamped position from the unclamped position under a low force, such as a force that is lower than a force that could injure a finger that might be between the seal backing element 354 and the heating element 326. In an exemplary embodiment, the heating element 326 is moved to a clamped position from an unclamped position and/or heat is applied by the heating element 326 only after the seal backing element 354 has been moved to the clamped position.

Heat is applied to the web 10 to seal the plies 102, 104 of the web 10 together between the first side 106 and the second side 108. The bag 100 can be sealed just below the separating line of weakness 110 or the web 10 can be indexed to any suitable position for forming the closing seal 114. The heating element 326 can be continuously on (e.g., always hot when the machine is turned on) or the heating element 326 can be controlled to only apply heat when the bag 100 is clamped and/or a seal signal is provided by the controller. The first and second plies 102, 104 are sealed together to form the closing seal 114 and close the compartment 101.

The engagement members 340 and gripping arrangements 370 are positioned along the path of travel 301 to open each bag 100 that is to be loaded and sealed. The gripping arrangements 370 and gripping actuation mechanisms 360 are shown in detail in FIGS. 18-27 and the engagement members 340 are shown in detail in FIGS. 28-36.

In some embodiments, a blower can also be included to assist in the opening of the bags 100. The engagement members 340, gripping arrangements 370, and blower can take a wide variety of different forms. For example, the illustrated embodiment includes a blower nozzle 314 positioned above the rollers 312 of the indexing arrangement 310. The nozzle 314 is oriented downward to blow air downward past the rollers 312 along the path of travel 301 of the web 10.

The engagement members 340 are moveable laterally along the engagement recess 322. In some embodiments, the engagement members 340 are arranged in a symmetrical and opposing relationship. In such an arrangement, the engagement members 340 are configured to both move in the inward direction 308—toward each other—or the outward direction 306—away from each other—substantially simultaneously. In some embodiments, the engagement members 340 include a downwardly protruding finger 342 with a beveled end 344 and a horizontal ramp 346 protruding outward from a flat portion 348 that fits within the engagement recess 322 of the base 320.

The fingers 342 extend vertically a distance that is long enough to sufficiently distribute opening forces so as to avoid tearing the sides 106, 108 of the bag 100 during opening. The beveled end 344 of the fingers 342 enables the fingers 342 to be more easily inserted between the plies 102, 104 of the web 10 to assist in the opening of each bag 100. When the web 10 is in an opening position along the path of travel 301 and between the engagement members 340, the engagement members 340 can be moved in the inward direction 308 to engage the sides 106, 108 of the web 10. While moving inwardly, the sides 106, 108 slide over the flat portion 348 and along the ramp 346 toward the fingers 342. This movement can cause the separating lines of weakness 110 in the first ply 102 to partially break near the fingers 342, thereby forming an opening through which the fingers 342 can be inserted by reverse indexing the web 10. A puff of air from the blower nozzle 314 can optionally be supplied to help separate the plies 102, 104 when engaging the fingers 342. After being inserted between the plies 102, 104 of the web 10, the fingers 342 can be moved in the outward direction 306 to pull the opening of the bag 100 taught between the two engagement members 340.

In some embodiments, the engagement members 340 are moved laterally by engagement actuation mechanisms 330. In the depicted embodiment, the engagement actuation mechanisms 330 include an actuator 332, a coupling member 334, and a position sensor 336. The coupling members 334 couples the actuators 332 to the engagement members 340. The actuator 332 can be any kind of actuator that is configured to move the engagement members 340 laterally within the engagement recess 322, such as, for example, a pneumatic actuator, a linear actuator, a linear motor, a belt drive, a chain drive, a gear drive, or the like. The position sensors 336 can be used to detect the lateral position of the actuators 332, coupling members 334, and/or the engagement members 340. For example, the position sensors 336 can be configured to send a signal to the controller when the position sensors 336 detect that the engagement members 340 are in an initial or home position that is the outward most position of the engagement members 340. The position sensor 336 can be any suitable sensor, such as, for example, a limit switch, a proximity sensor, or the like. In some embodiments, the position sensor 336 is integrated with the actuator 332 so that the sensor 336 may be triggered when the actuator 332 is fully actuated in an open and/or closed position.

In some embodiments, the gripping arrangements 370 are coupled to gripping actuation mechanisms 360. In the depicted embodiment, the gripping actuation mechanisms 360 are coupled to the seal backing bar 352 of the clamping mechanism 350. In this arrangement, the gripping arrangements 370 move in the closing and opening direction 302, 304 when the clamping mechanism 350 opens and closes. The gripping actuation mechanisms 360 can be coupled to the seal backing bar 352 with fasteners to enable adjustment to a variety of positions spaced apart laterally along the seal backing bar 352. In some embodiments, the gripping actuation mechanisms 360 are moveably coupled to the seal backing bar 352 and are provided with actuators so that the lateral position of the gripping actuation mechanisms 360 can be controlled by the controller and moved in outward and inward directions 306, 308.

In some embodiments, the gripping actuation mechanisms 360 each include a base 361 to which an actuator 362 is attached. In the depicted embodiment, the actuator 362 is coupled to a four-bar linkage formed by a guide linkage 364, a drive linkage 366, the base 361, and the gripping arrangements 370. The guide and drive linkages 364, 366 are pivotably coupled to the base 361 and the gripping arrangements 370 such that movement of an end of the drive linkage 366 by the actuator 362 causes the gripping arrangements 370 to open (FIGS. 20-21, 23, 25, and 27) and close (FIGS. 18-19, 22, 24, and 26). The actuator 362 can be any kind of actuator that is configured to move the open and close the gripping arrangements 370, such as, for example, a pneumatic actuator, a linear actuator, a linear motor, a belt drive, a chain drive, a gear drive, or the like. The gripping actuation mechanisms 360 take on a variety of different forms, however, that can include direct rotation or movement of the gripping arrangements 370 with servo motors and the like.

In some embodiments, the gripping arrangements 370 include a gripper 371, a gripping pad 376, and a gripping sensor 378. The gripper 371 includes a vertical gripping surface 372 and a beveled end 374. In some embodiments, the gripping arrangement 370 is closed by moving the gripper 371 toward the gripping pad 376 and is opened by moving the gripper 371 away from the gripping pad 376. The gripper 371 can be moved by the gripping actuation mechanism 360 such that the gripping surface 372 maintains a substantially parallel relationship with the surface of the gripping pad 376. In some embodiments, the gripping pad 376 is formed from an elastomeric material so as to avoid tearing the material of the web 10 during gripping and opening.

Figure 56:
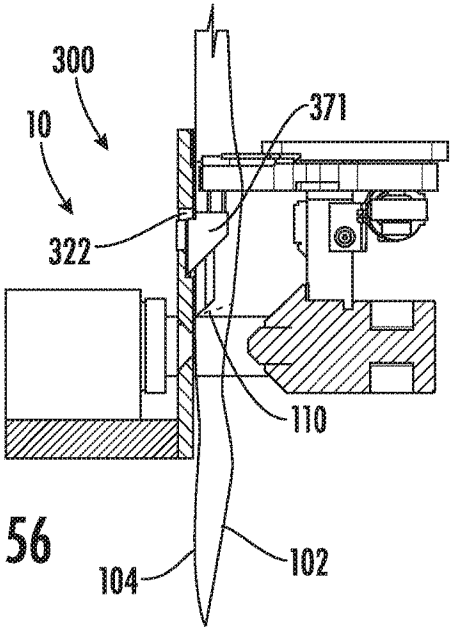
Figure 57:
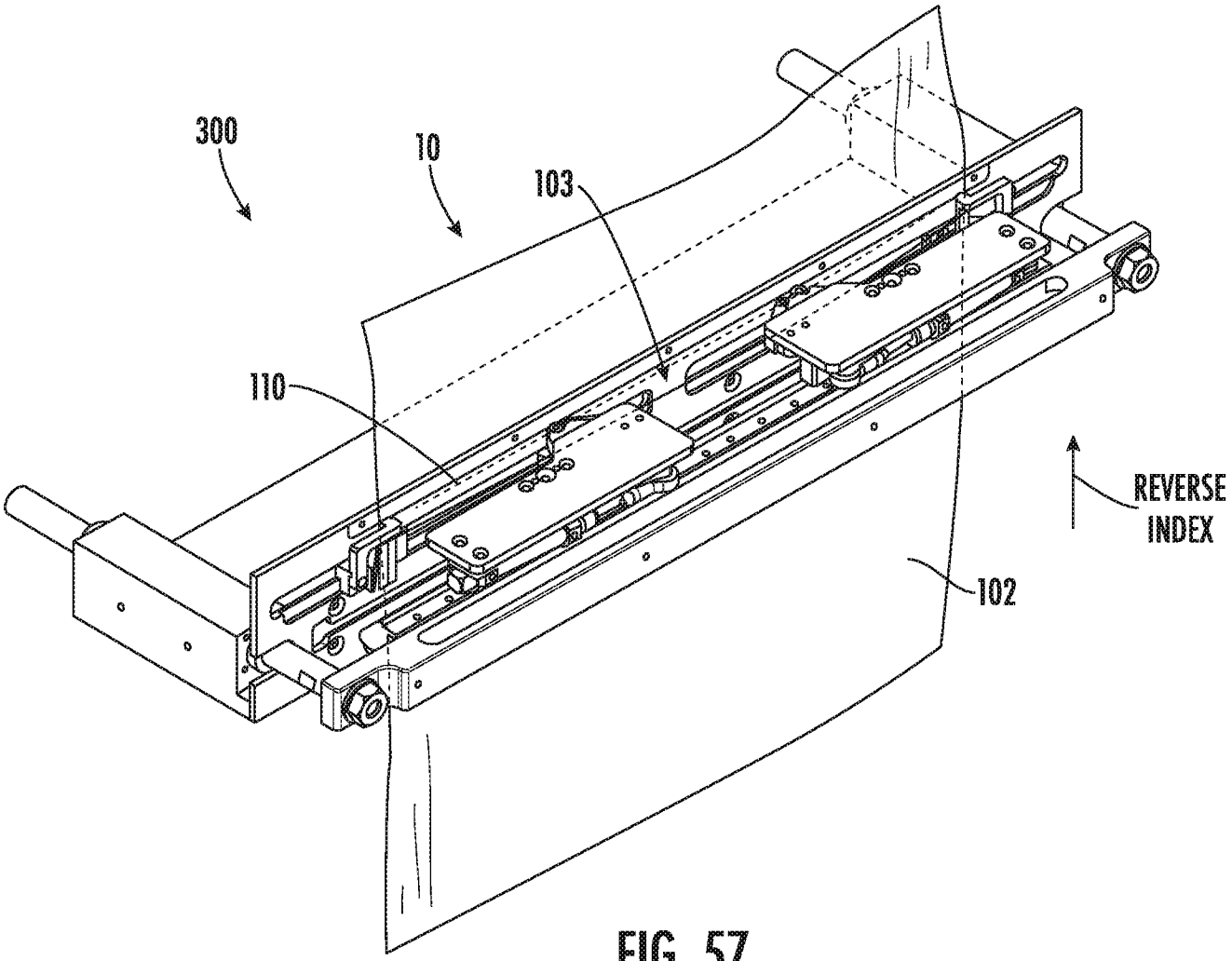
Figure 58:
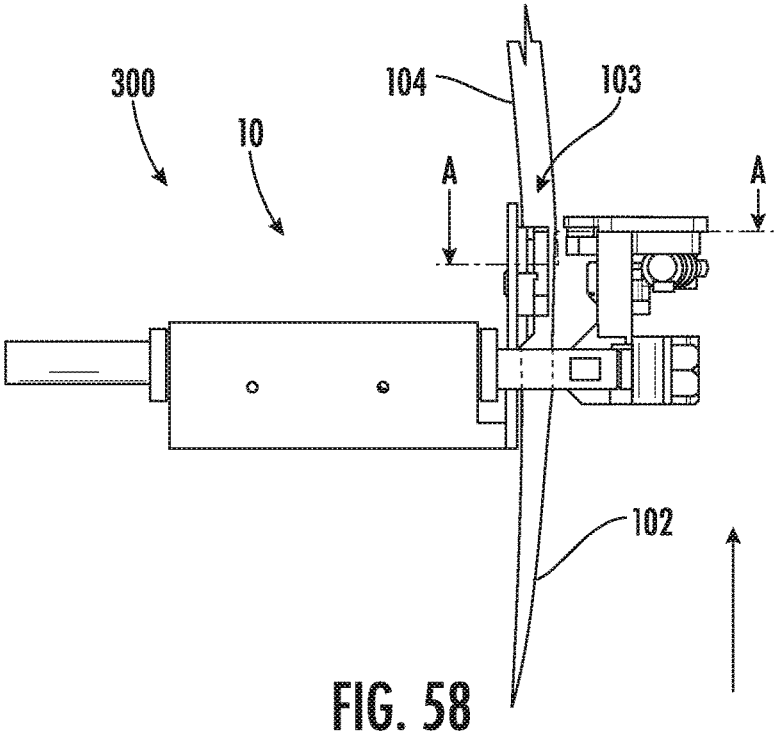
Figure 59:
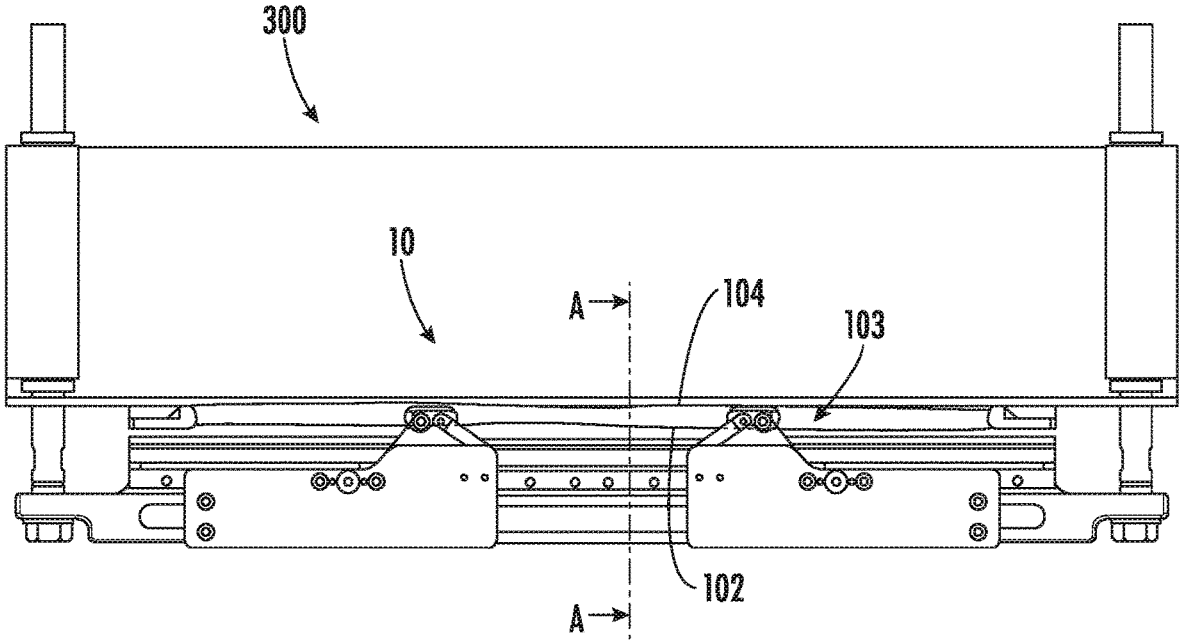
Figure 60:
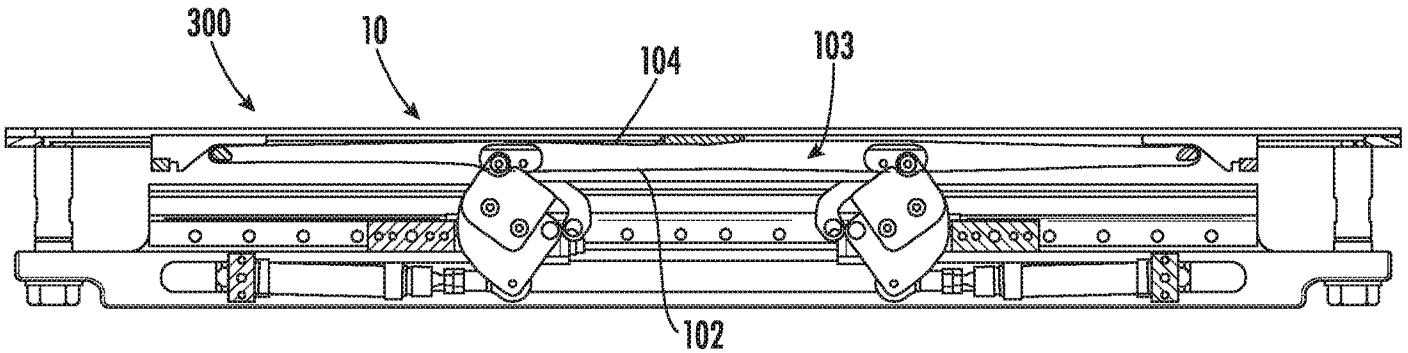
Figure 61:
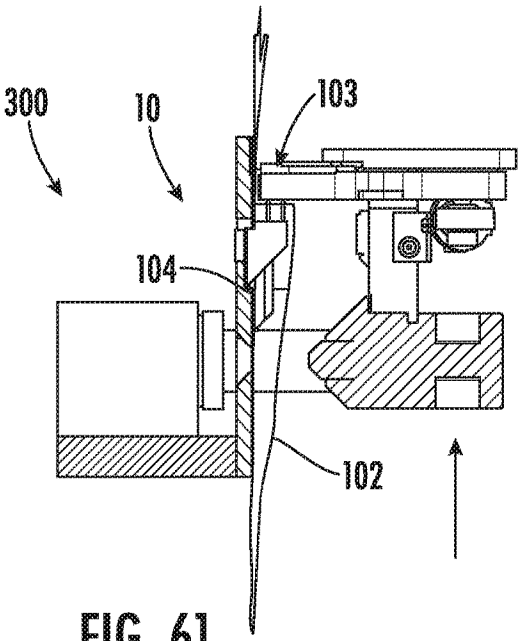
Figure 62:
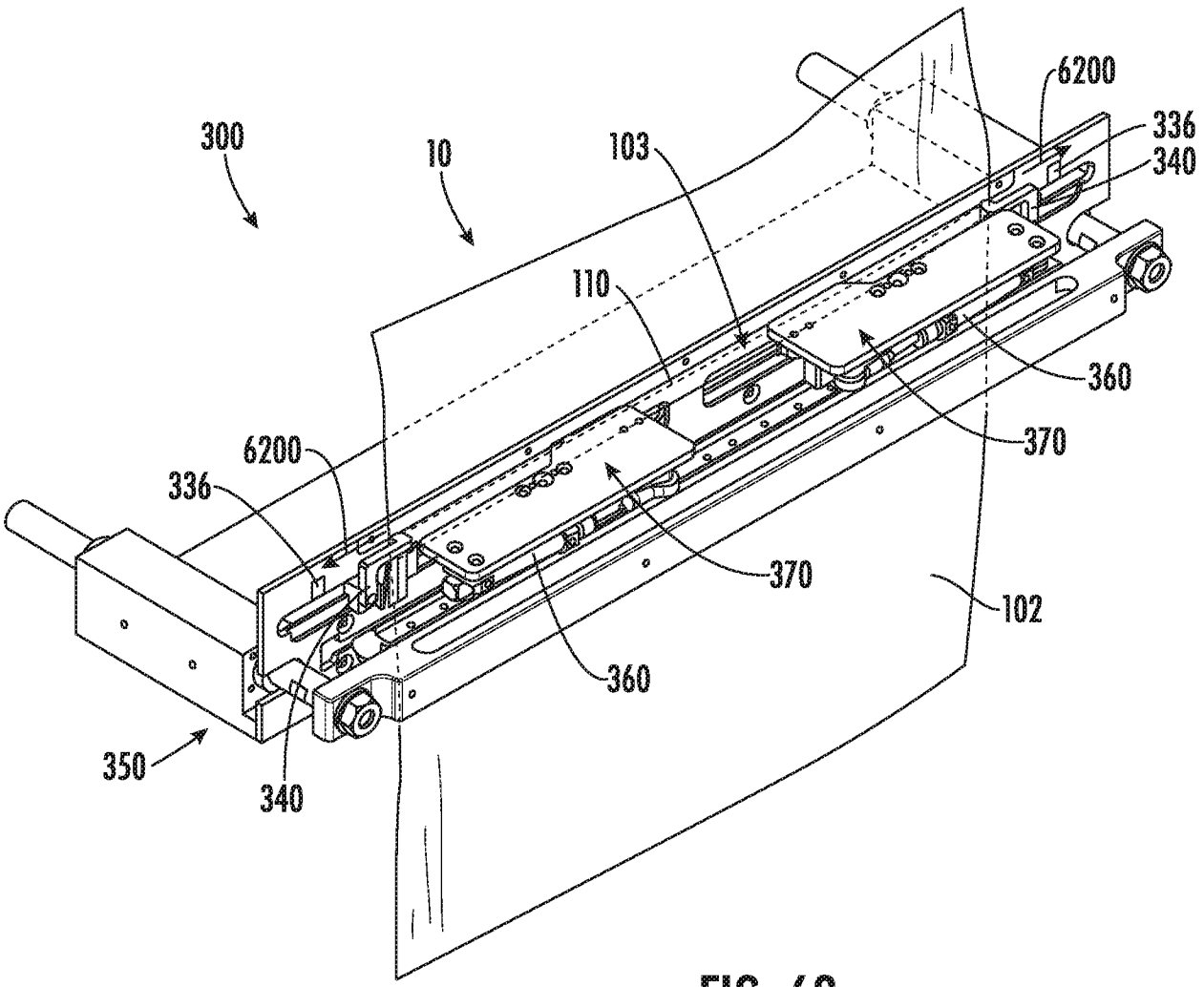
FIGS. 62-66 depict various views of an embodiment of the engagement members being moved in an outward direction until the top portion of the bag is taught, in accordance with the embodiments described herein.
Figure 63:
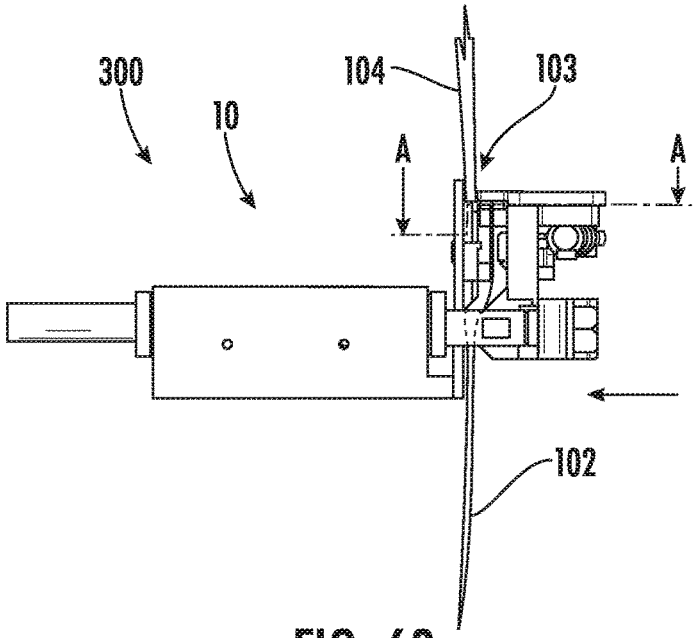
Figure 64:
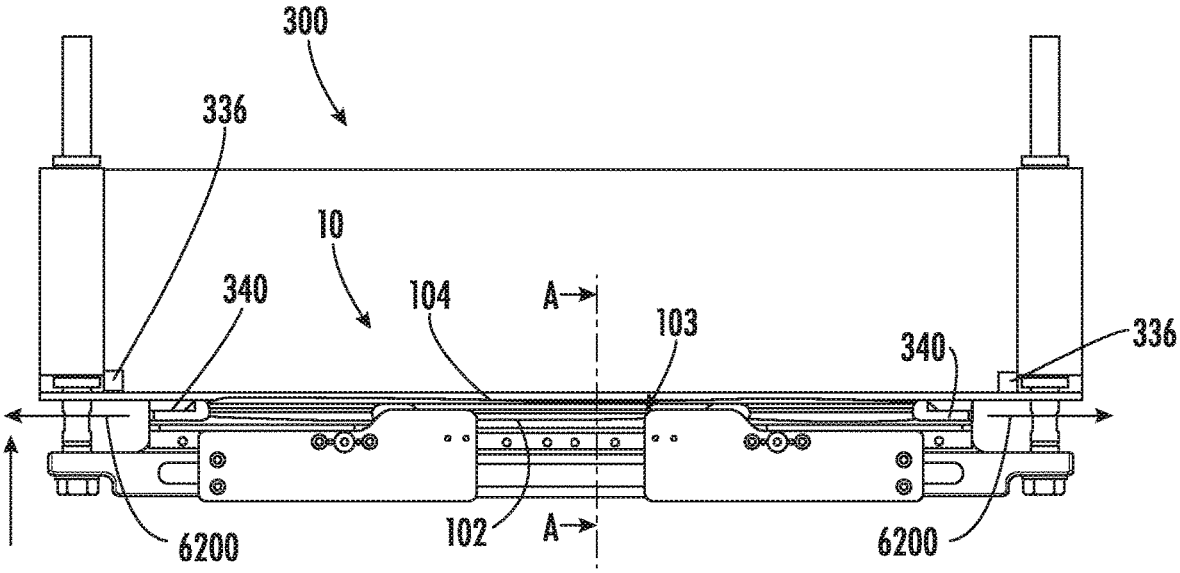
Figure 65:
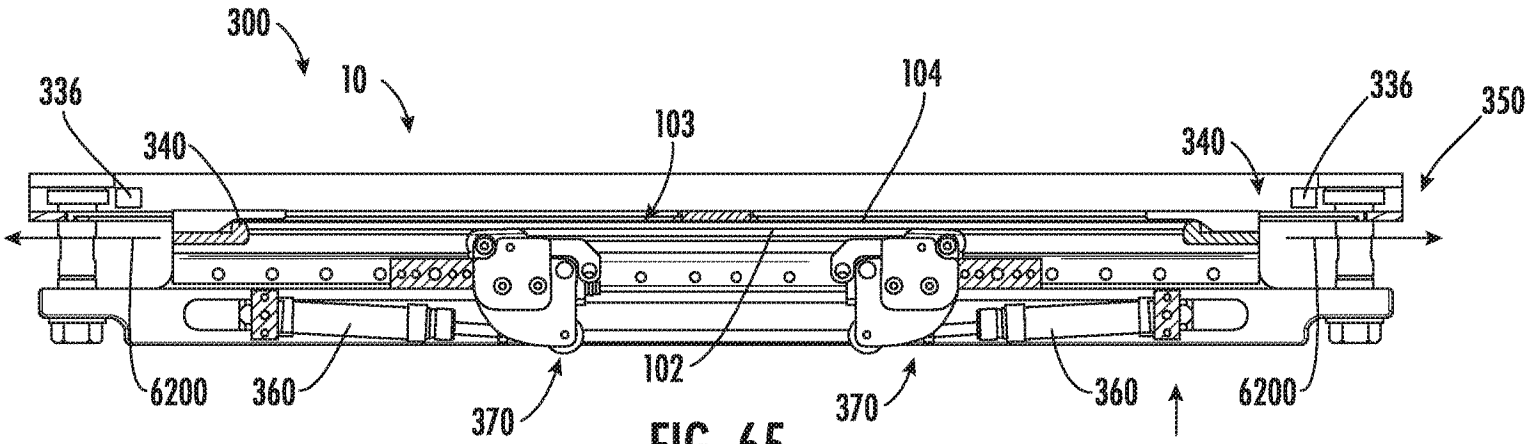
Figure 66:
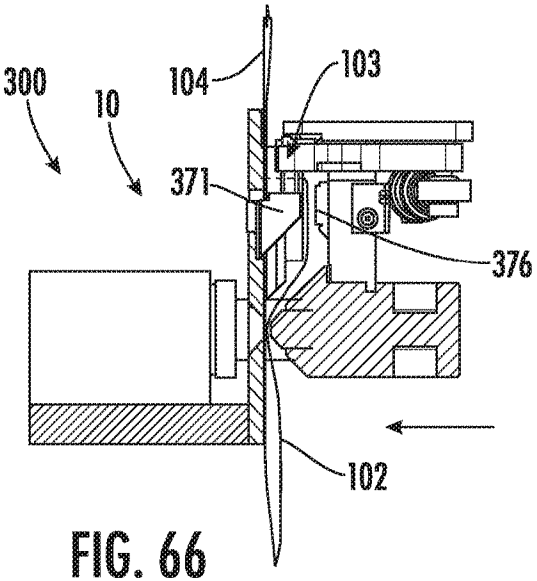
Figure 67:
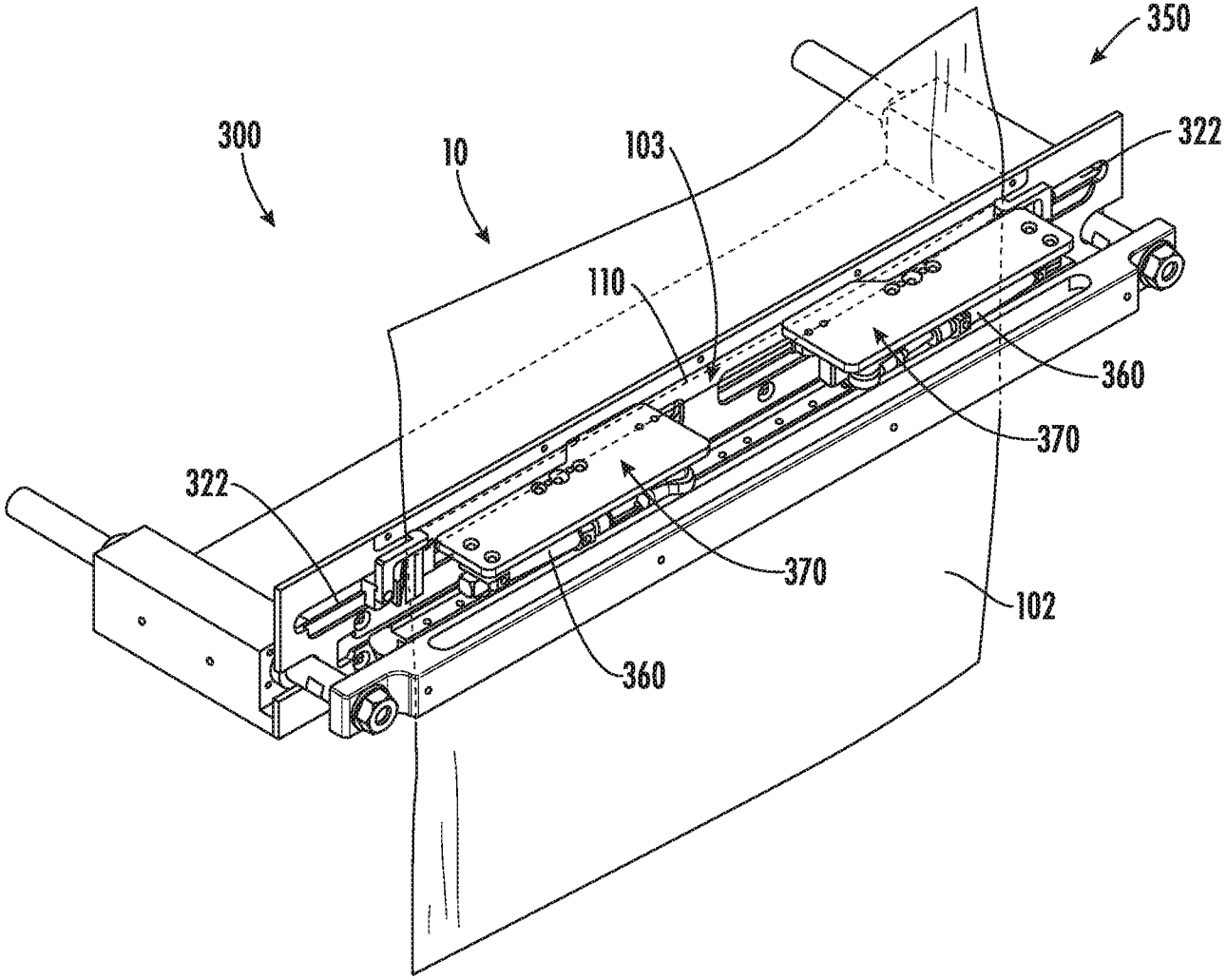
FIGS. 67-71 depict various views of an embodiment of the gripping arrangements and clamping arrangement being closed so that the grippers remain within the opening of the bag during closing of the gripping arrangements, in accordance with the embodiments described herein.
Figure 68:
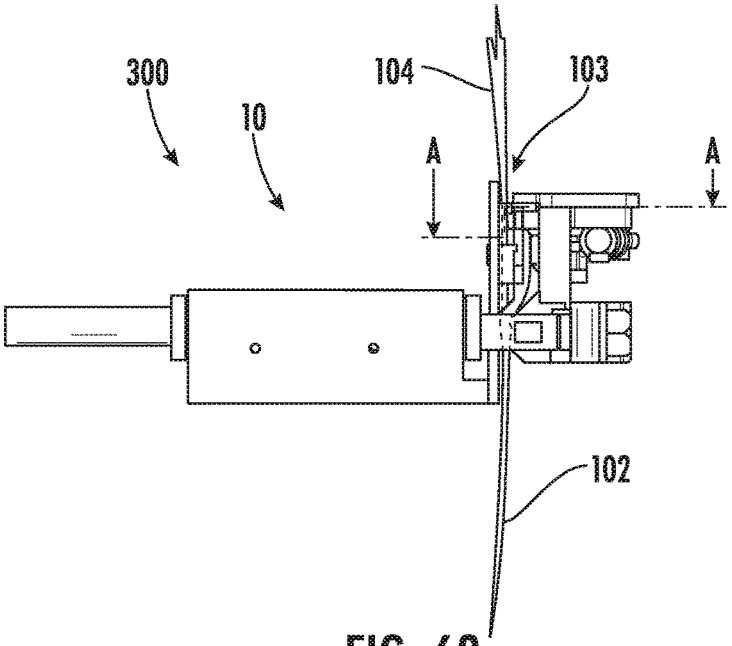
Figure 69:
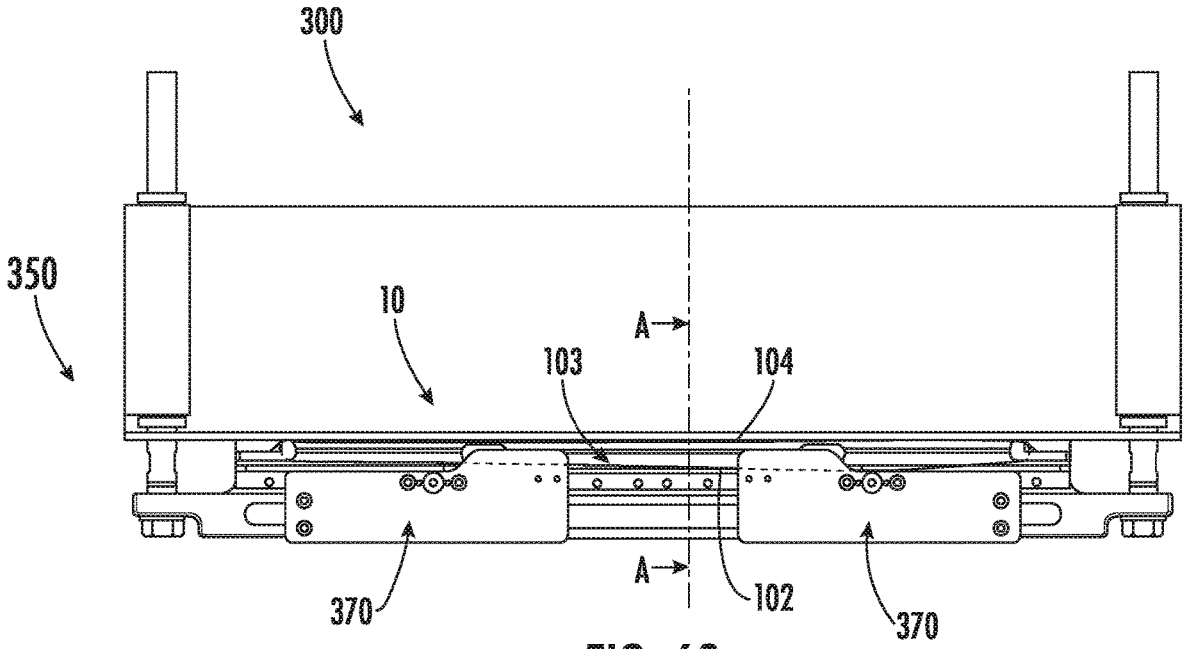
Figure 70:
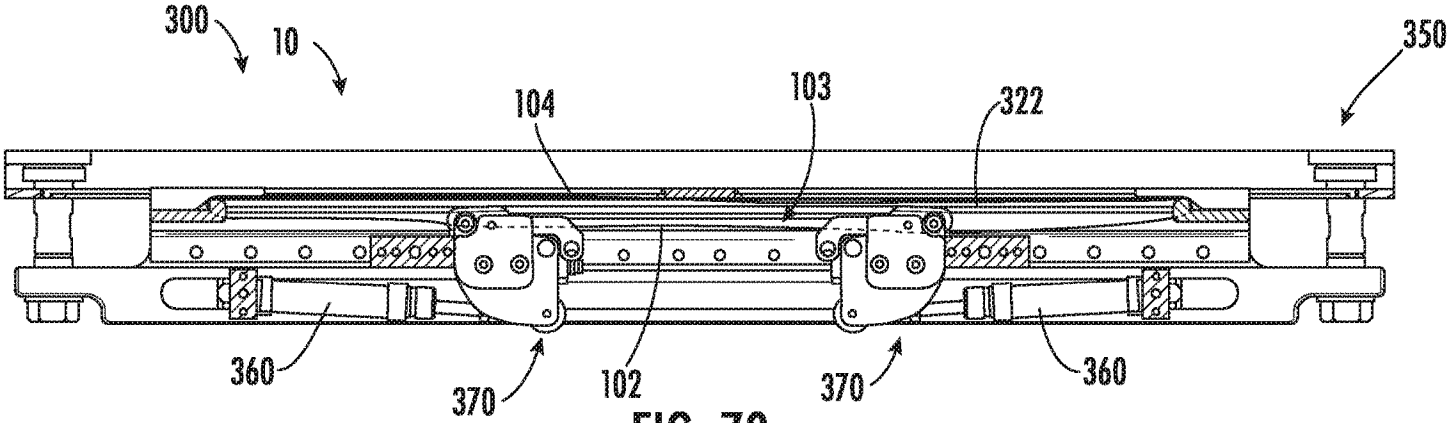
Figure 71:
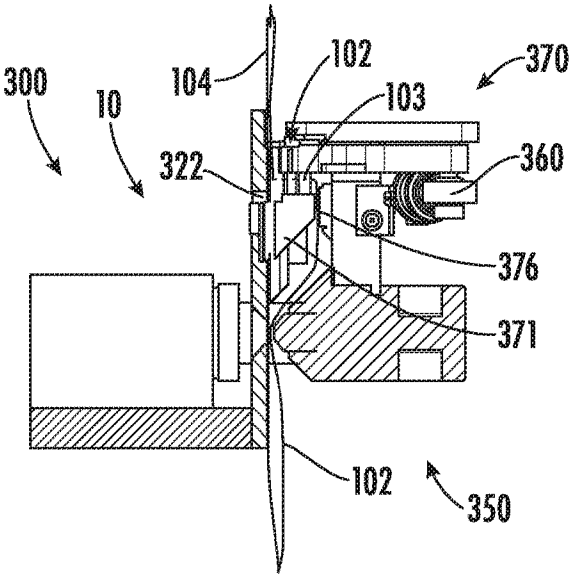
Figure 72:
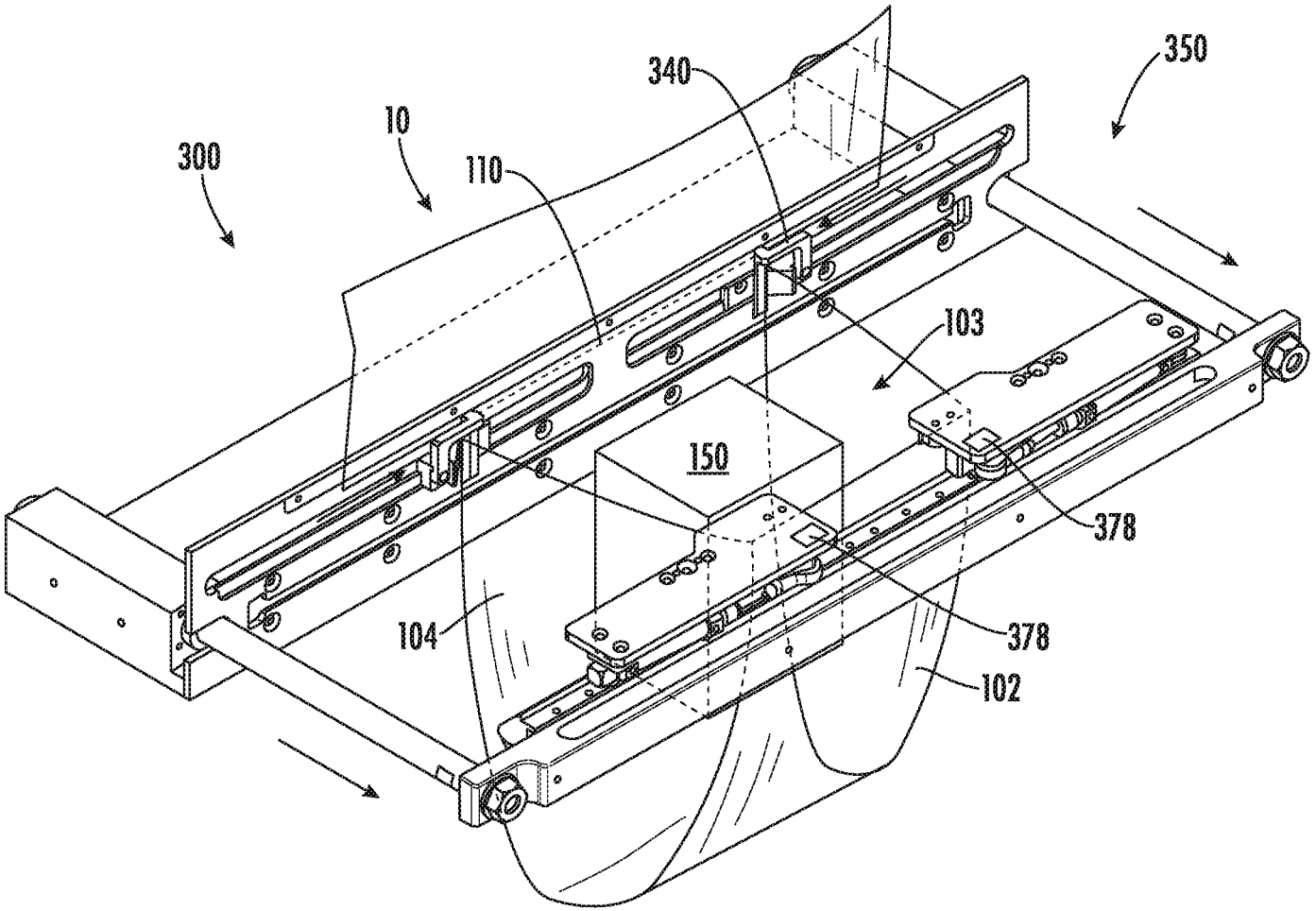
FIGS. 72-76 depict various views of an embodiment of the clamping arrangement being opened while the engagement members are moved inward to form an opening for loading a product into the bag, in accordance with the embodiments described herein.
Figure 73:
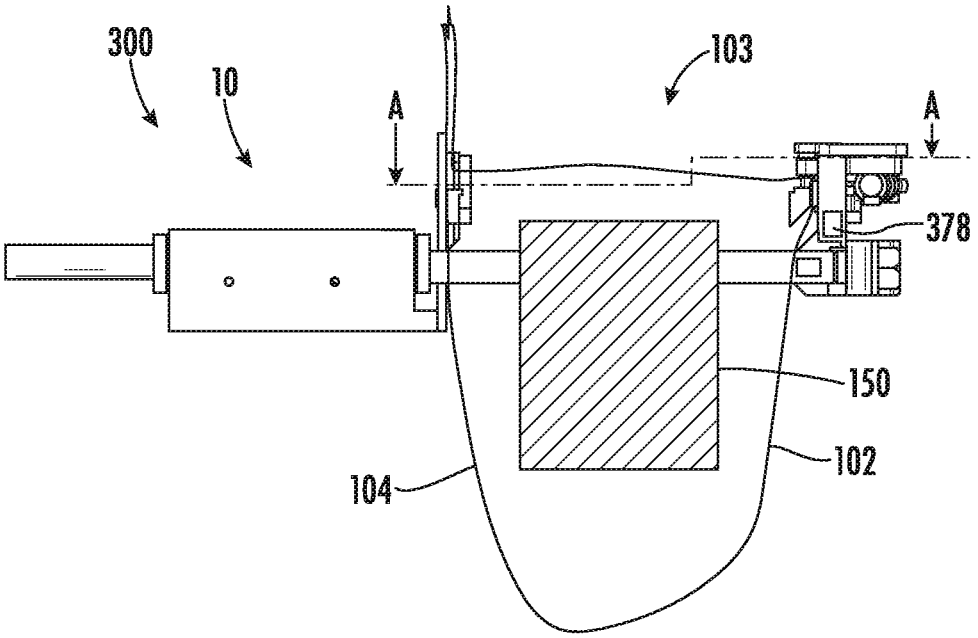
Figure 74:
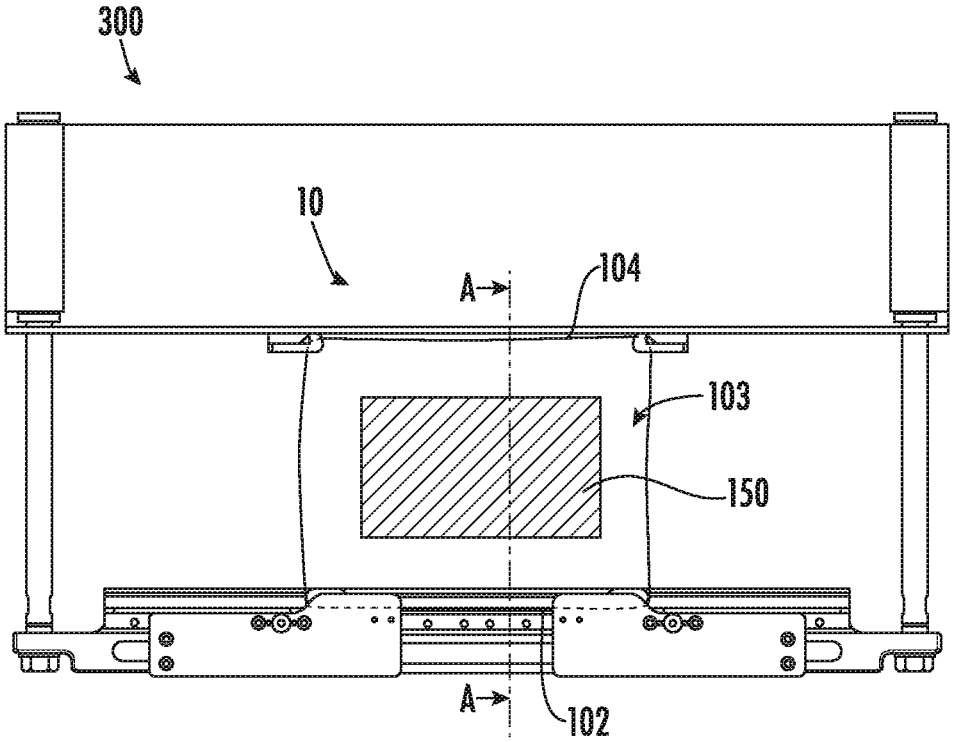
Figure 75:
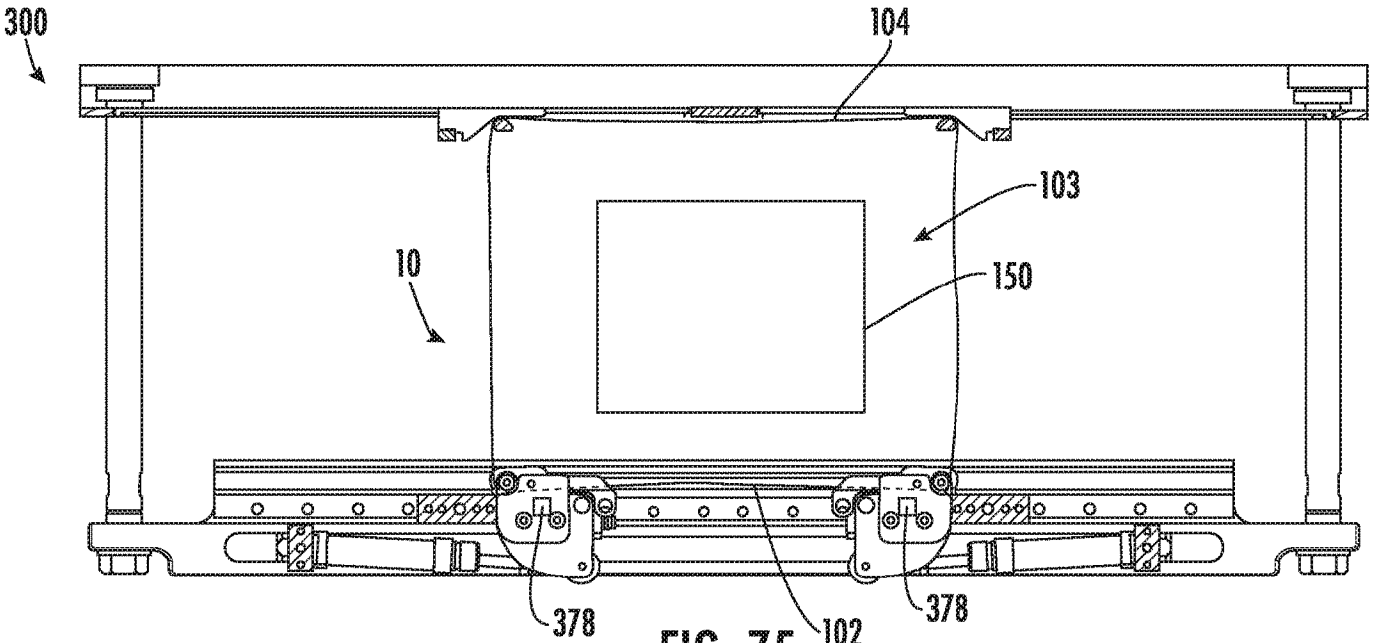
Figure 76:
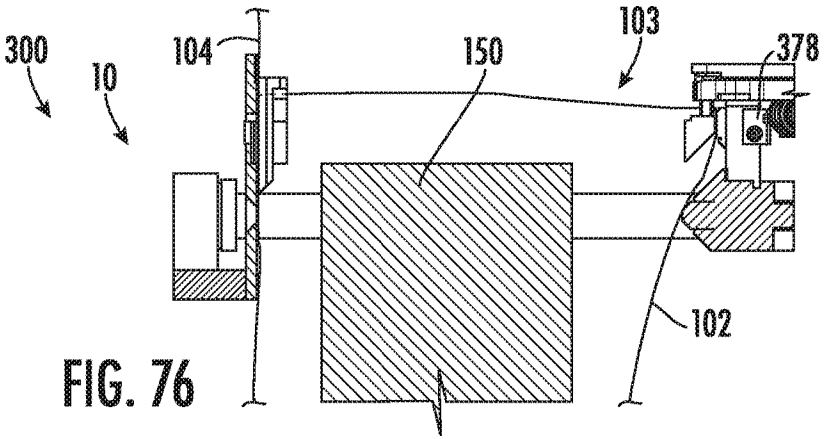
Figure 77:
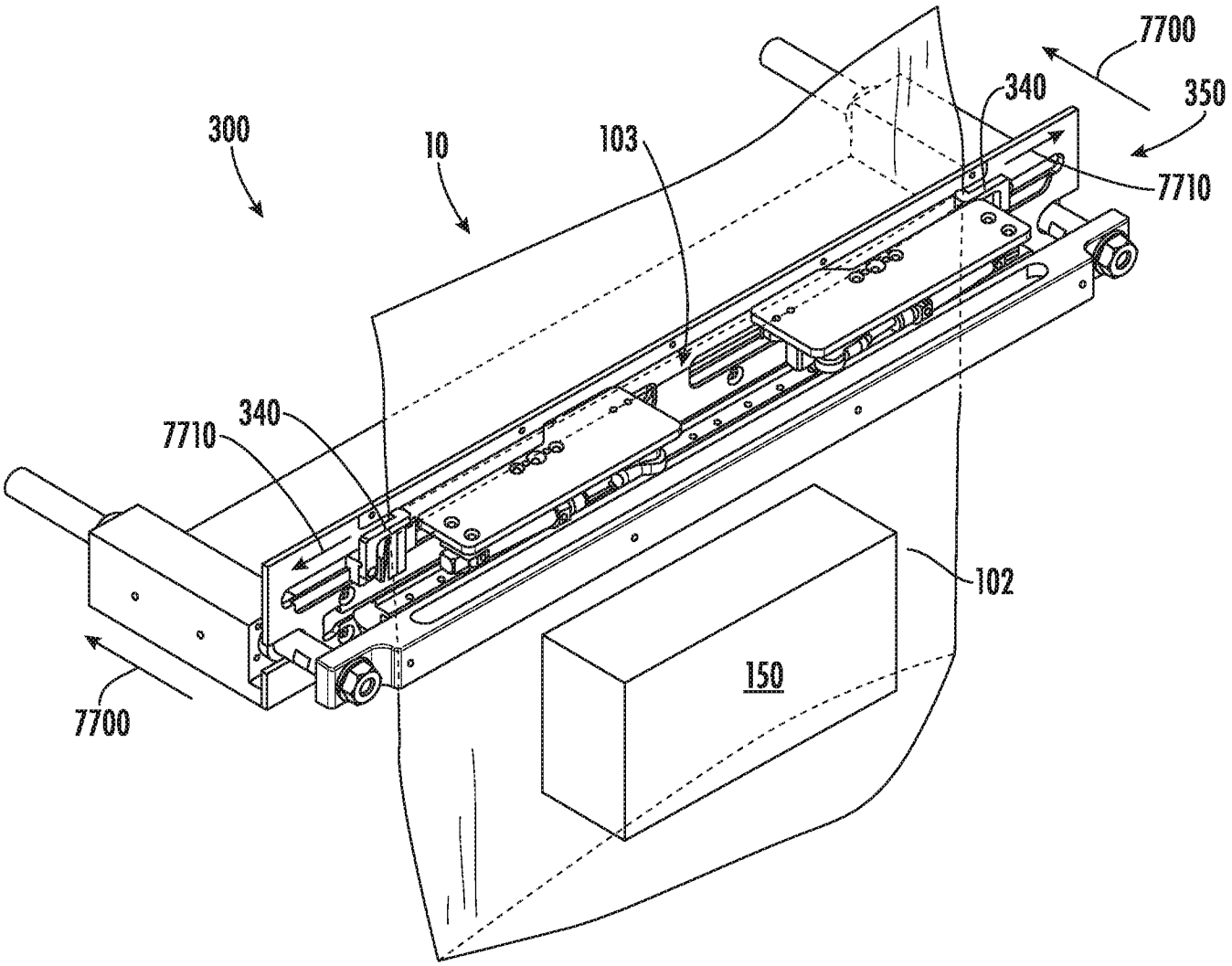
FIGS. 77-81 depict various views of an embodiment of the clamping arrangement being closed and the engagement members being moved outward to flatten the top portion of the bag with the product in the bag, in accordance with the embodiments described herein.
Figure 78:
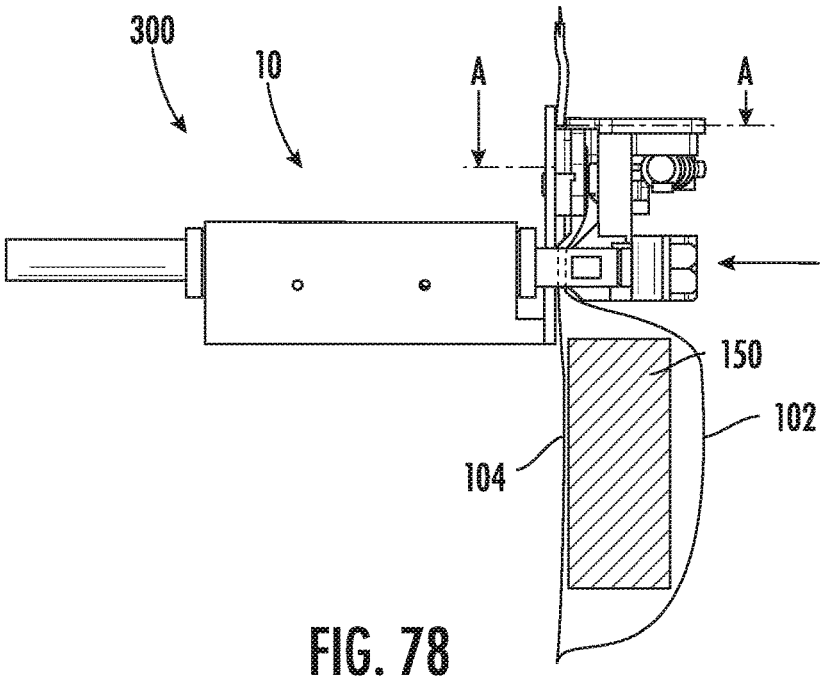
Figure 79:
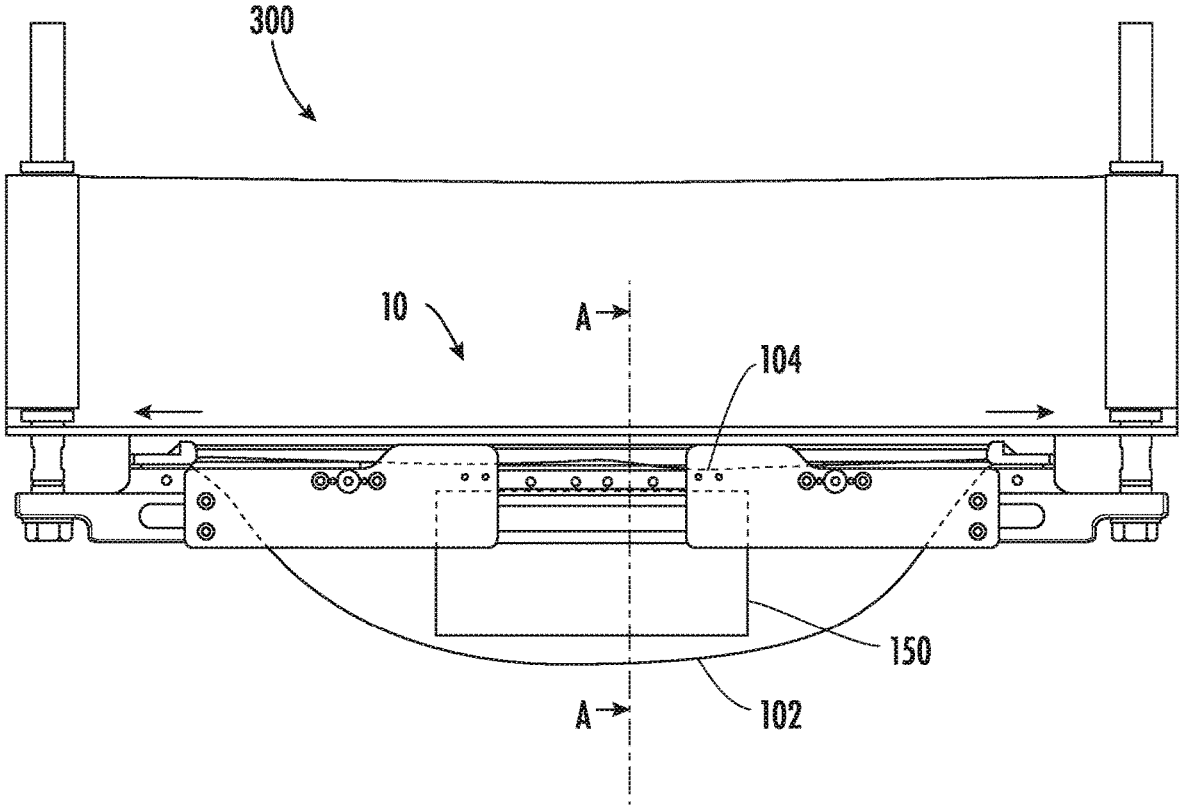
Figure 80:
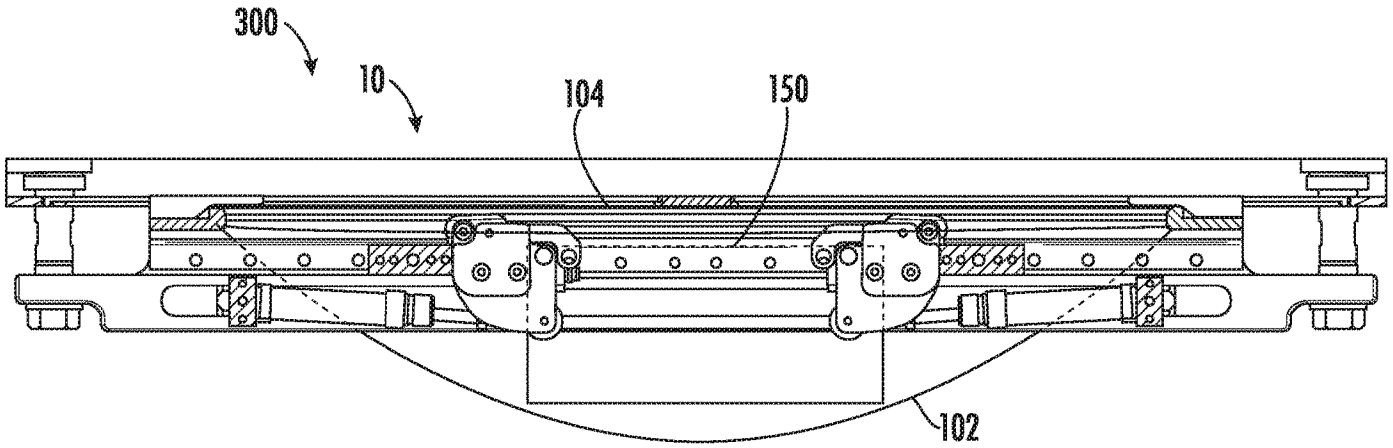
Figure 81:
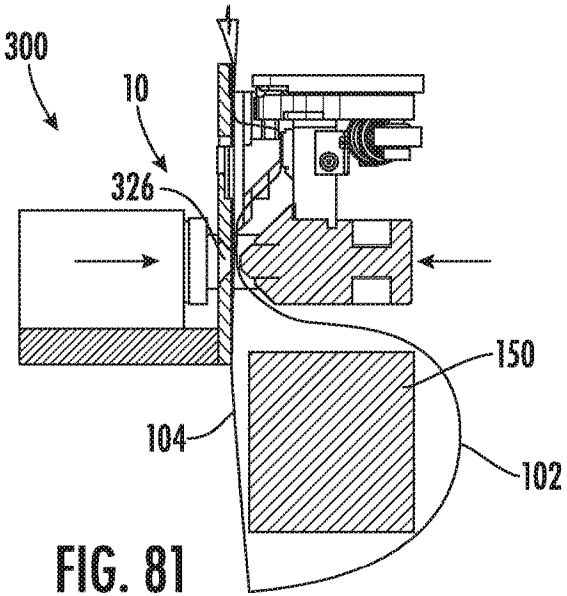
Figure 82:
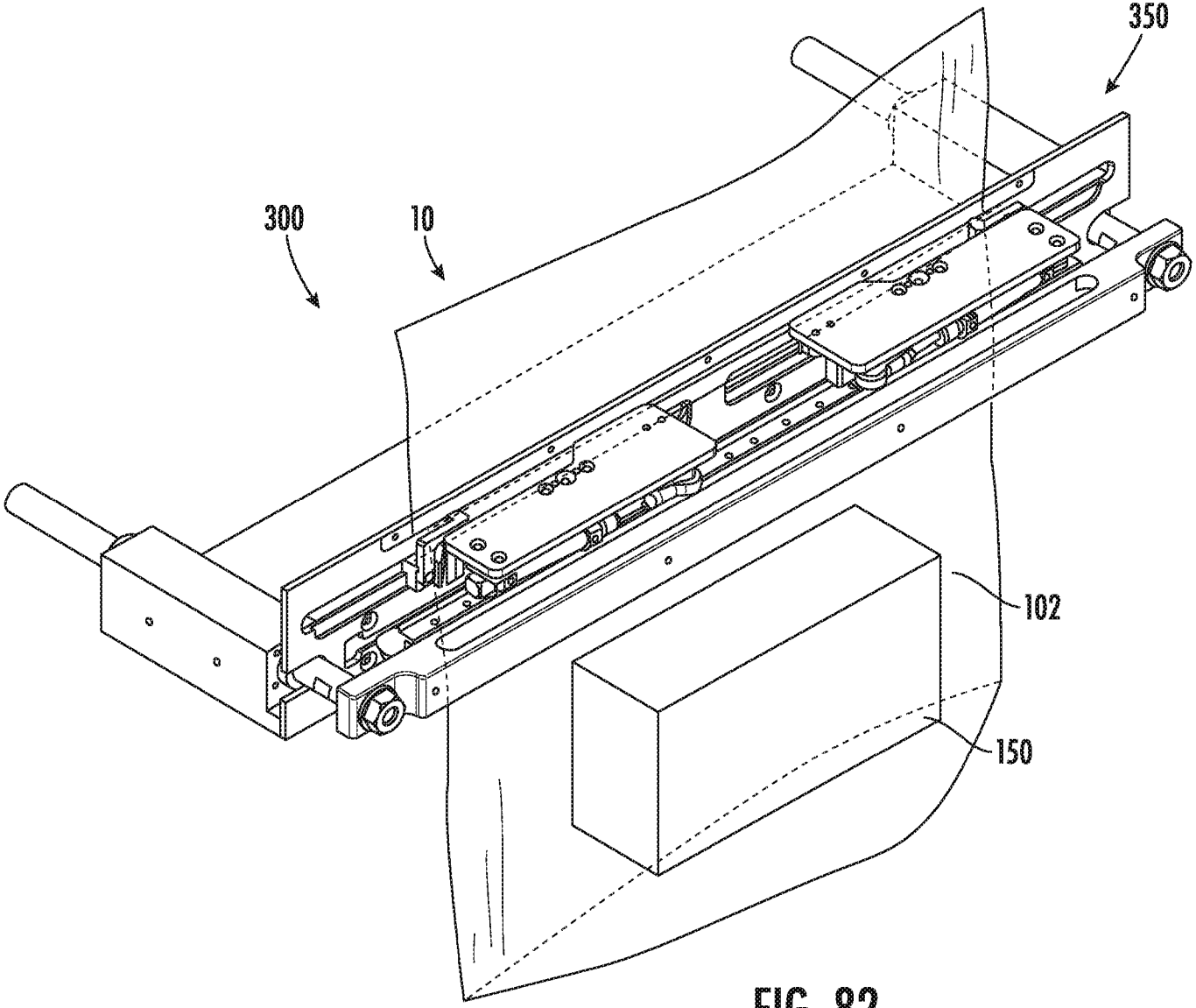
FIGS. 82-86 depict various views of an embodiment of the clamping arrangement fully closed so that the heating element can engage the web to form the closing seal in the bag, in accordance with the embodiments described herein.
Figure 83:
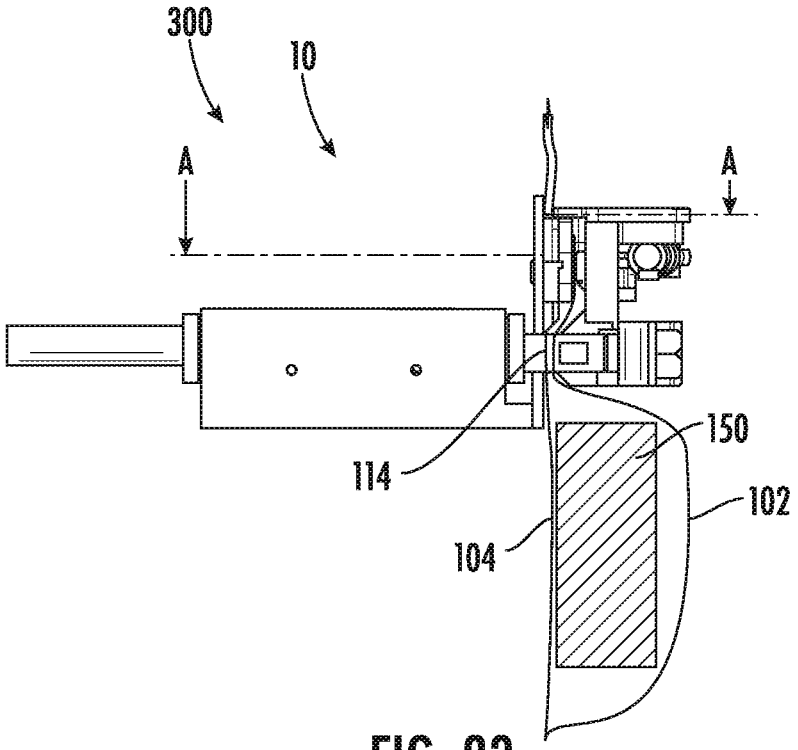
Figure 84:
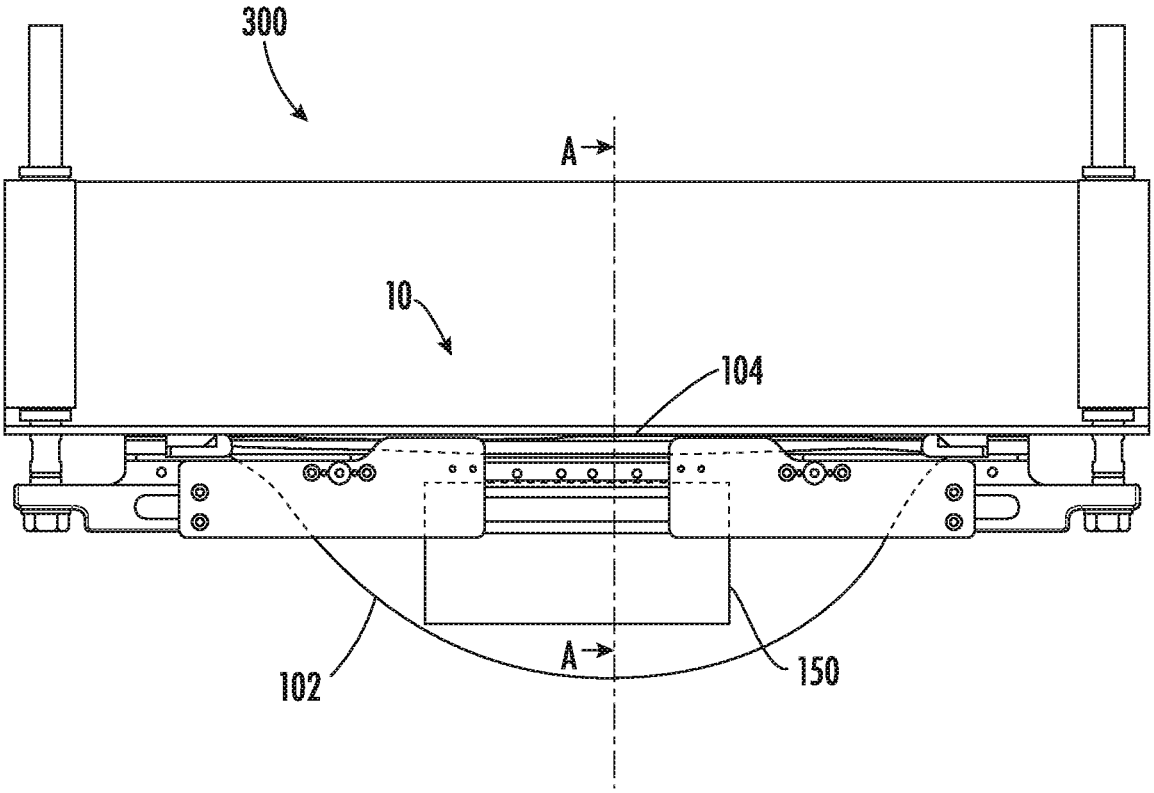
Figure 85:
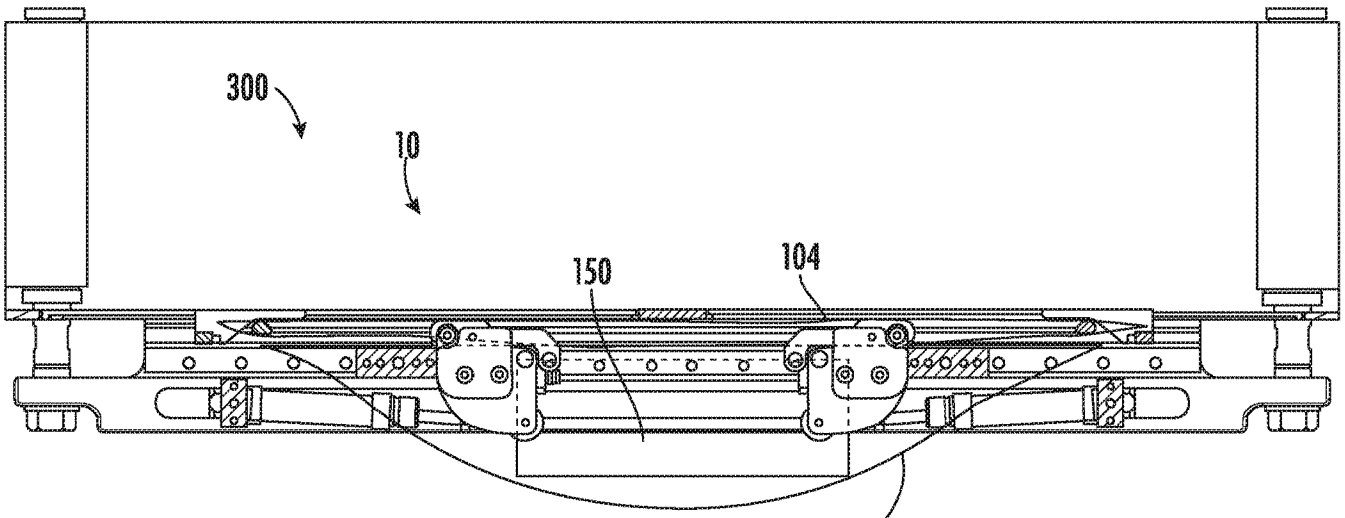
Figure 86:
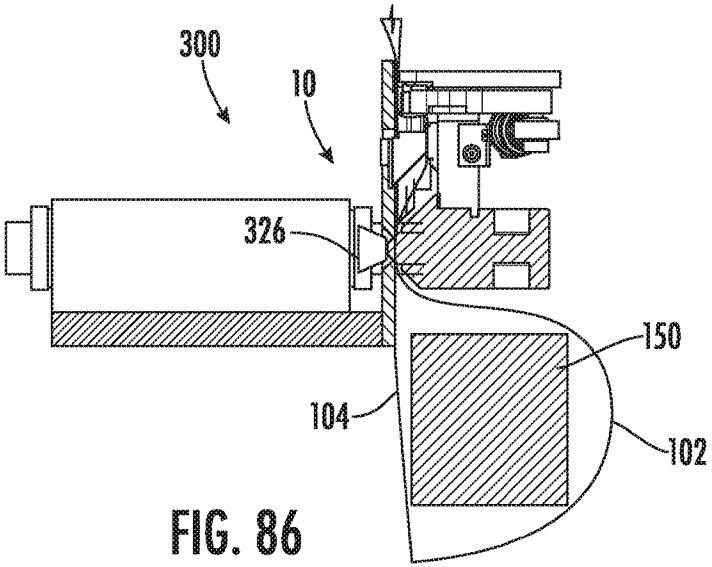
Figure 87:
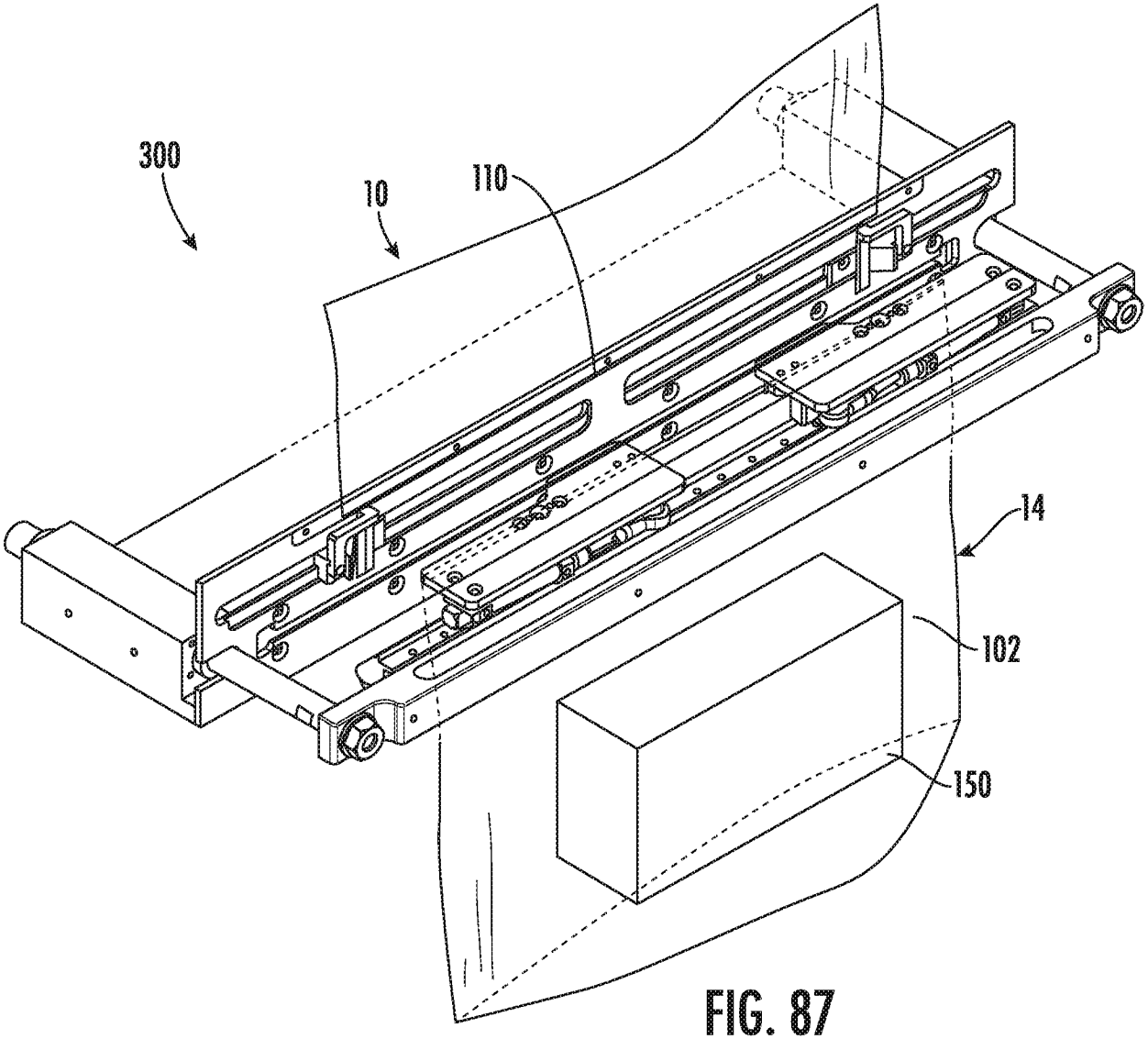
FIGS. 87-91 depict various views of an embodiment of the clamping arrangement being opened to a release position where the package can be removed from the machine 300, in accordance with the embodiments described herein.
Figure 88:
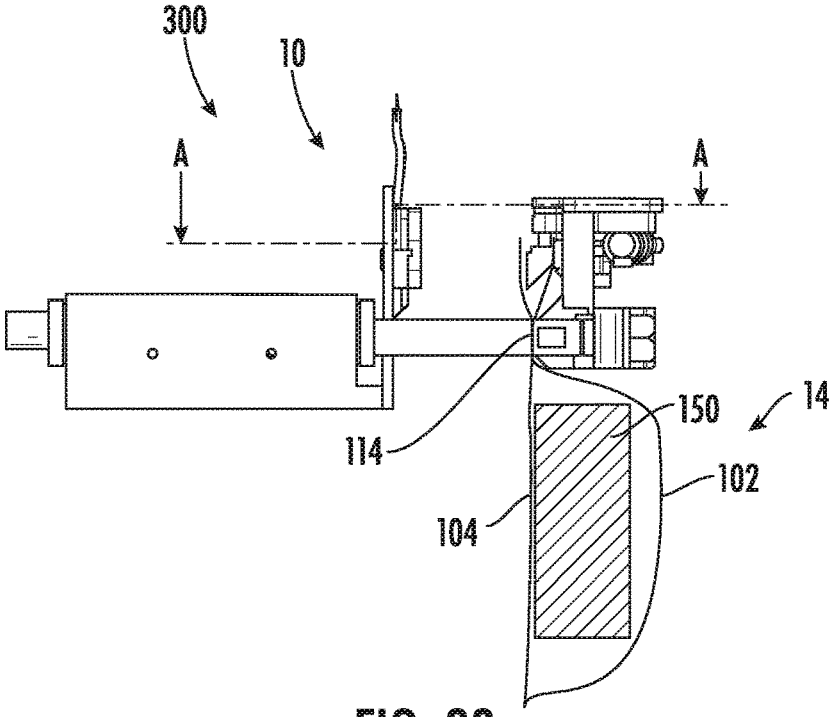
Figure 89:
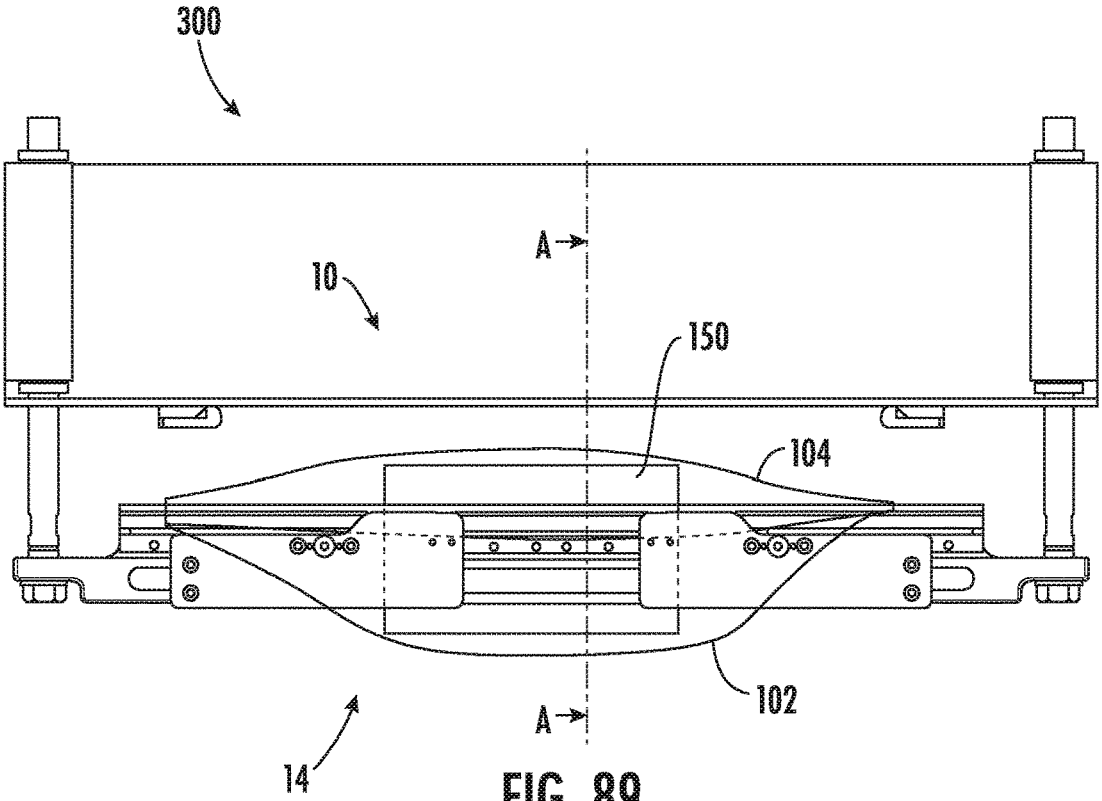
Figure 90:
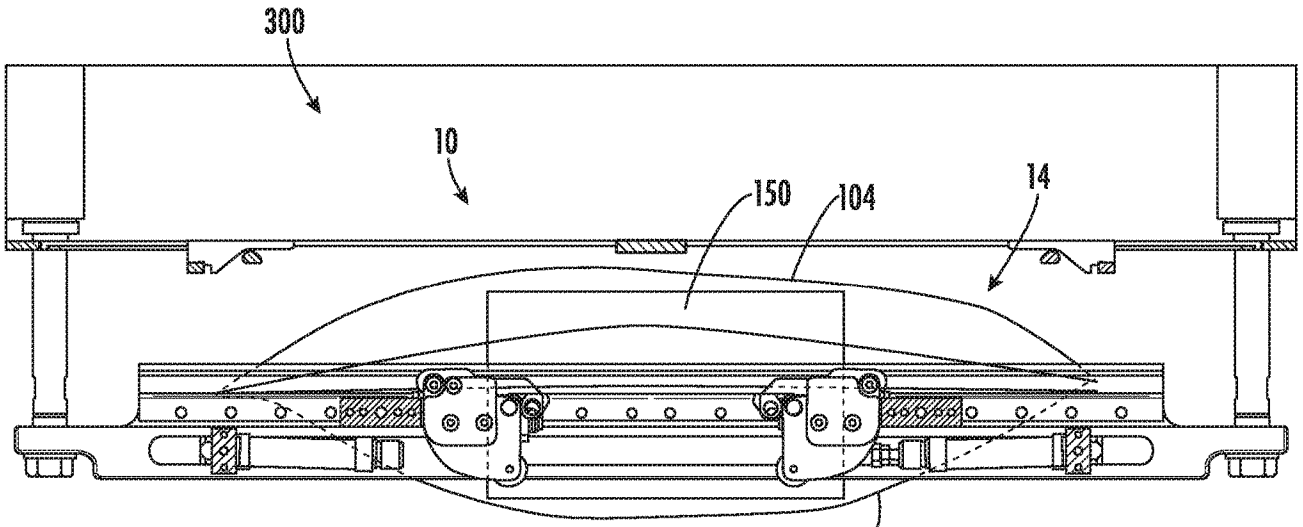
Figure 91:
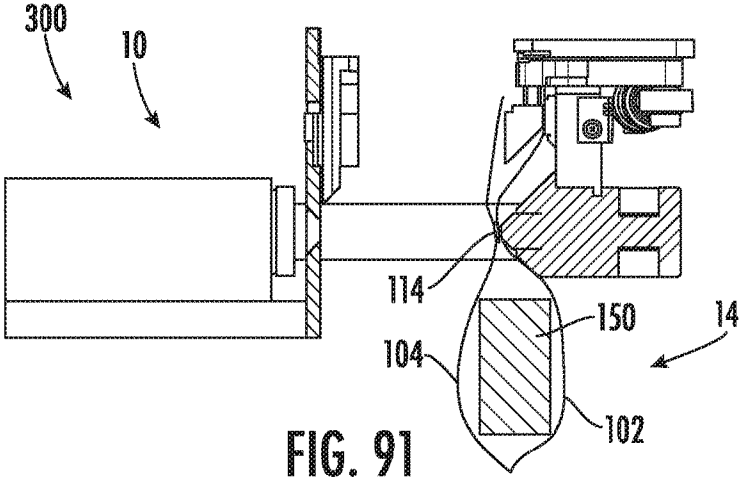
Figure 92:
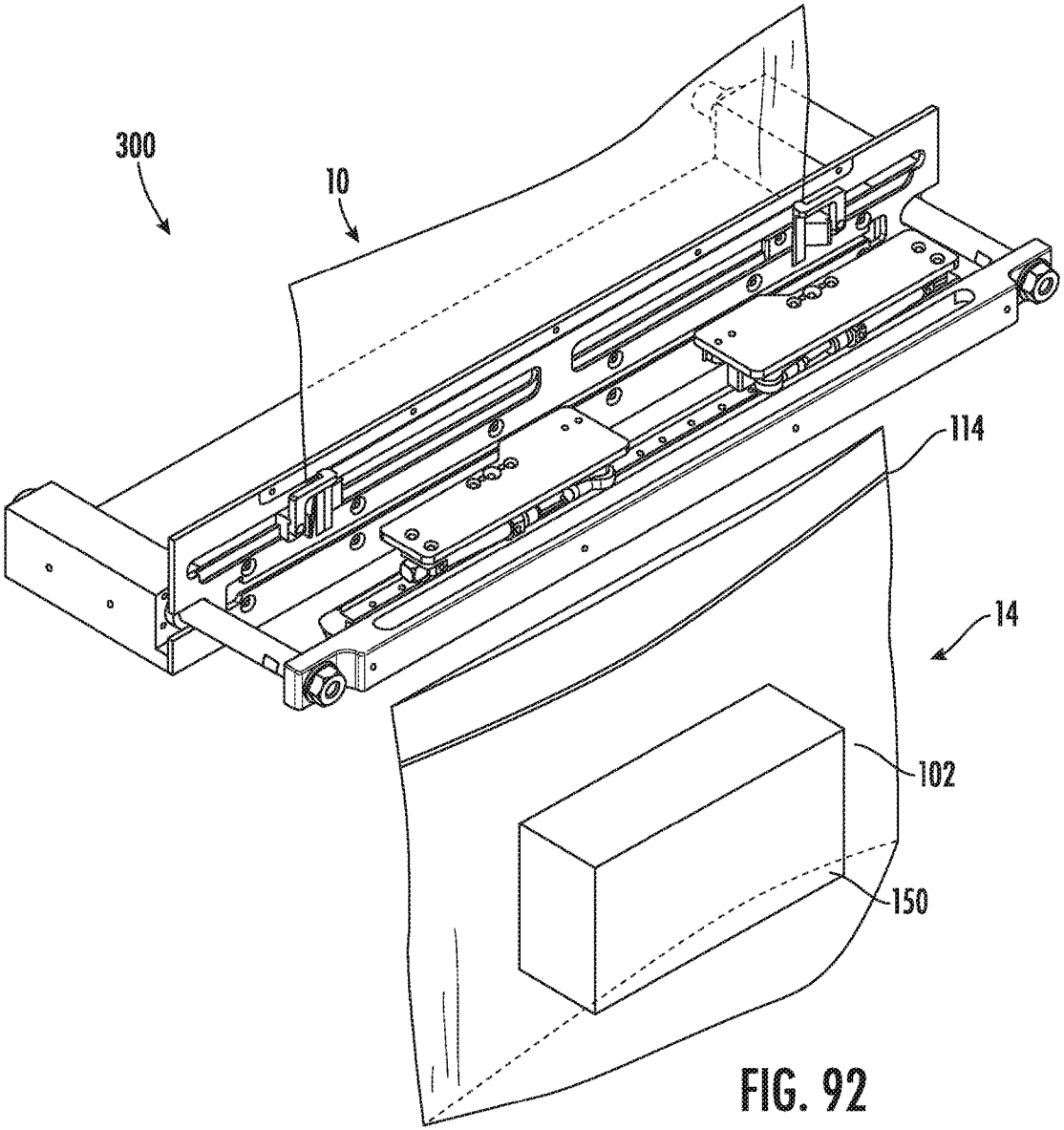
FIGS. 92-96 depict various views of an embodiment of the clamping arrangement at the release position as the gripping arrangements are opened are opened so that the package drops from the machine, in accordance with the embodiments described herein.
Figure 93:
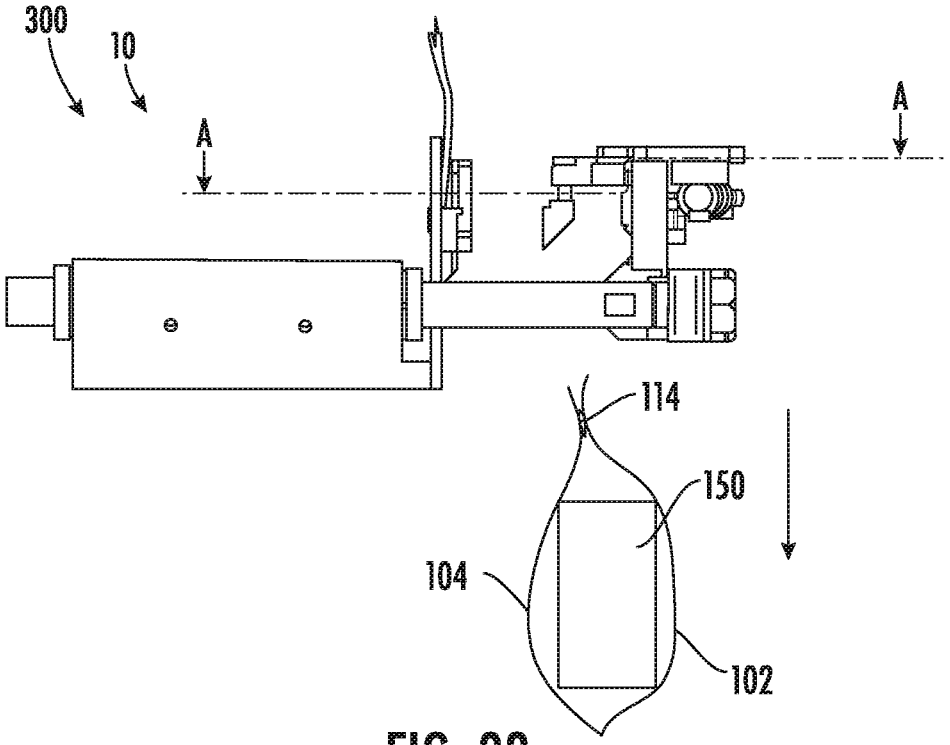
Figure 94:
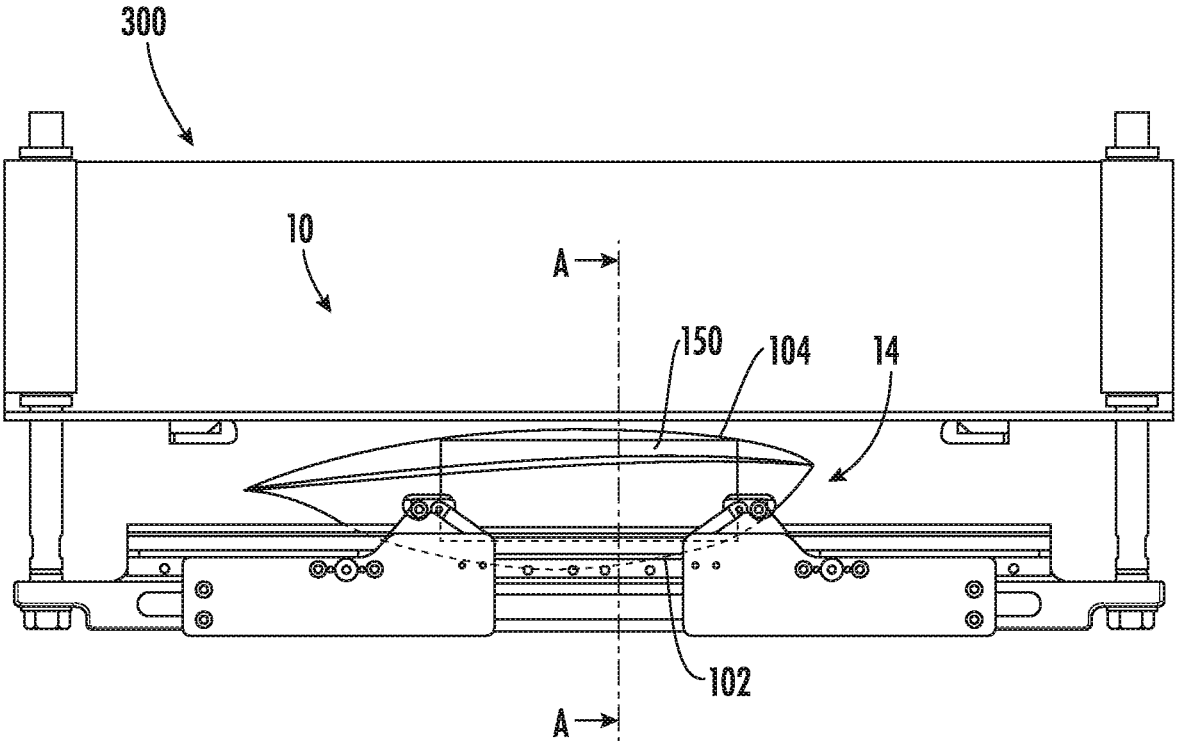
Figure 95:
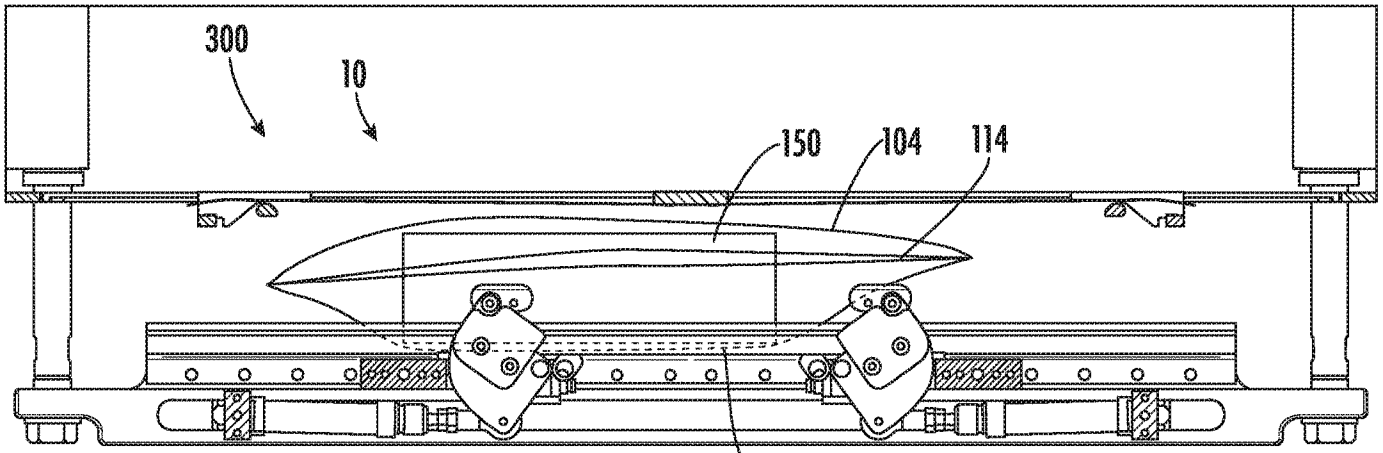

The beveled end 374 of the gripper 371 enables the gripper 371 to be more easily inserted between the plies 102, 104 of the web 10 to assist in the opening of each bag 100. To capture the first ply 102 of the web 10 when opening the bags 100, the gripping arrangements 370 are opened and the clamping arrangement 350 is closed such that the beveled ends 374 of the grippers 371 are disposed within the engagement recess 322 of the base 320 (e.g., FIG. 56). In this position, the beveled ends 274 are positioned beyond the path of travel 301 of the web 10. When the web 10 is reverse indexed by the indexing mechanism 310, the second ply 104 slides between the grippers 371 and the base 320 while the first ply 102 is engaged by the beveled end 374 of the gripper 371 so that the first ply 102 slides upward between the gripping surface 372 and the gripping pad 376. The top of the gripper 371 is arranged to be approximately aligned vertically with the tops of the fingers 342 to avoid bunching up or sliding of the plies 104, 102 held by the fingers 342 and the gripping arrangements 370, respectively during opening of the bags 100. Thus, forces acting on the bag 100 during opening can be disposed substantially orthogonal to the surface of the bag 100 so that the bag 100 tends to remain in place rather than sliding off of the fingers 342 or grippers 371 as the bag 100 is opened.

The gripping sensor 378 can be used to detect whether the gripping arrangement 370 has successfully gripped the web 10. For example, the gripping sensor 378 may be able to detect the presence of the web 10 between the gripper 371 and the gripping pad 376. In some embodiments, the gripping sensor 378 can be configured to send a signal to the controller when the sensor 378 detects that the web 10 has been successfully gripped. In the illustrated embodiment, the gripping sensor 378 is positioned such that the first ply 102 that is successfully gripped by the gripper 371 will be directly in front of the sensor 378. In this embodiment, the sensor is a short-range optical sensor 378 calibrated to detect the material of the web 10. The gripping sensor 378 can be any suitable sensor, such as, for example, a proximity sensor, an optical sensor, an infrared sensor, a contact sensor, or the like. In some embodiments, the gripping sensor 378 is integrated in the gripper 371 and/or the gripping pad 376 and is configured to detect the presence of the material of the web 10.

Referring now to FIG. 9, the engagement members 340 and gripping arrangements 370 allow the bag 100 to be opened so that the product 150 can be loaded into the bag 100 through an opening 103. In the embodiments, the engagement members 340 and gripping arrangements 370 are configured to hold the bag 100 so that the opening 103 is substantially rectangular. In other embodiments, the engagement members 340 and gripping arrangements 370 are configured to hold the bag 100 any other shape, such as a triangular shape, a trapezoidal shape, any other polygonal shape, or any other shape. This opening 103 allows the product 150 to be packaged inside the bag 100. For example, when the product 150 is rectangular (e.g., a box) and the opening 103 is a rectangular opening, the rectangular opening can allow the product 150 to be packaged in the bag 100. After the item is loaded, the bag 100 is sealed closed with a closing seal 114 to form a sealed package 14 containing the product 150 within the compartment 101, as can be seen in FIGS. 3 and 4. In some embodiments, the lateral positions of the engagement members 340 and/or the gripping arrangements 370 can be adjusted to form shaped openings having different proportions, depending on the size of the web 10 and the product 150 to be packaged within the bag 100.

Figure 37:
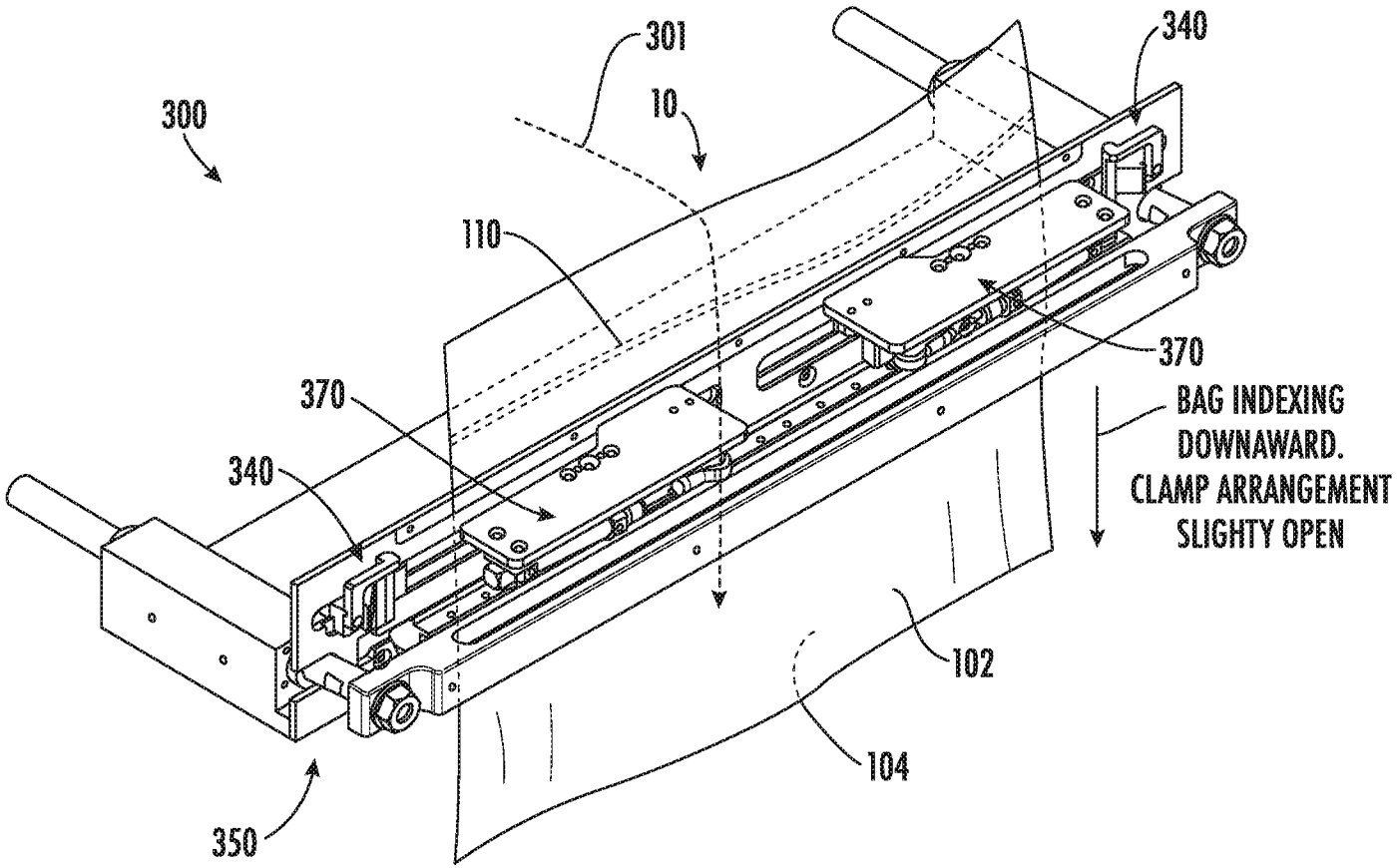
FIGS. 37-41 depict various views of an embodiments of the packaging machine depicted in FIGS. 11-17 with the clamping arrangement partially open so that the web can be indexed along the path of travel until the line of separation is arranged below the engagement members and the gripping arrangements, in accordance with the embodiments described herein.
Figure 38:
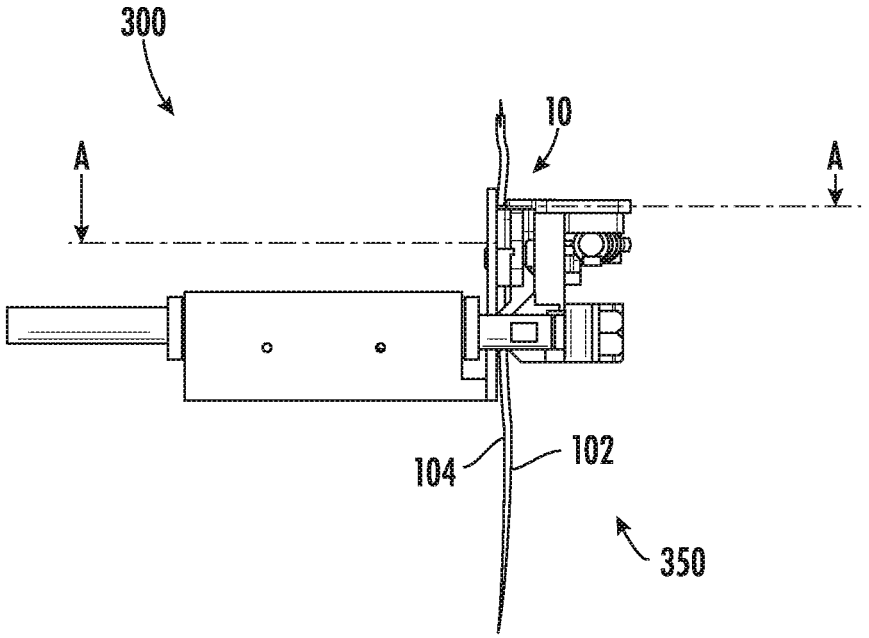
Figure 39:
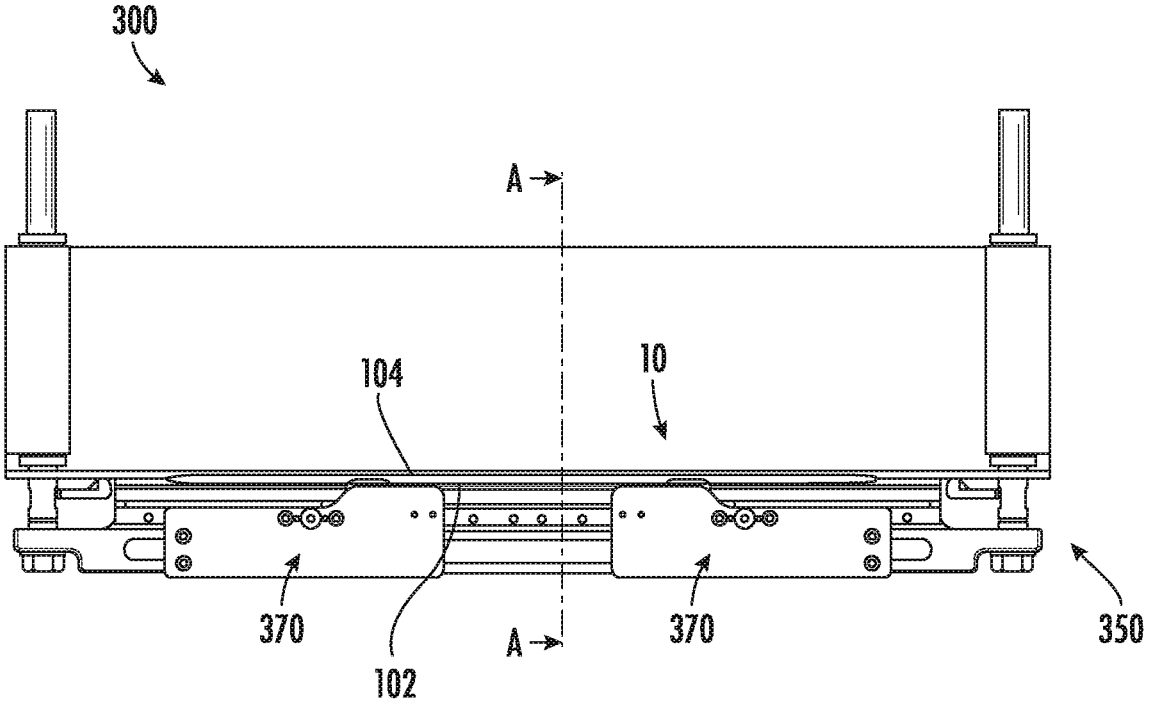
Figure 40:
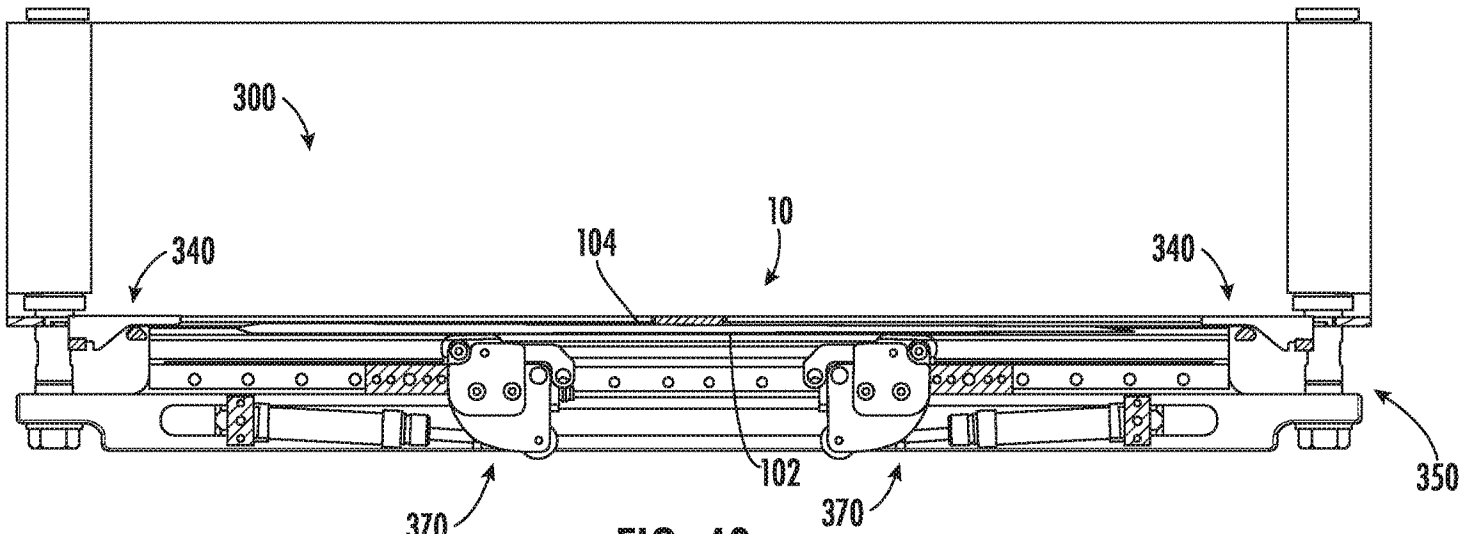
Figure 41:
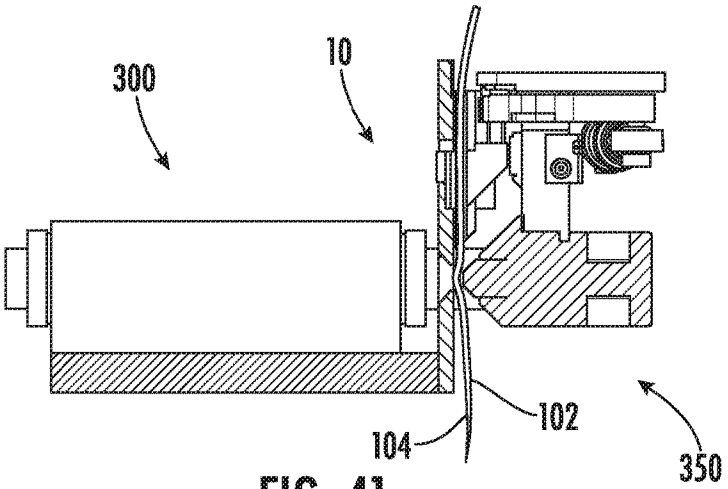
Figure 42:
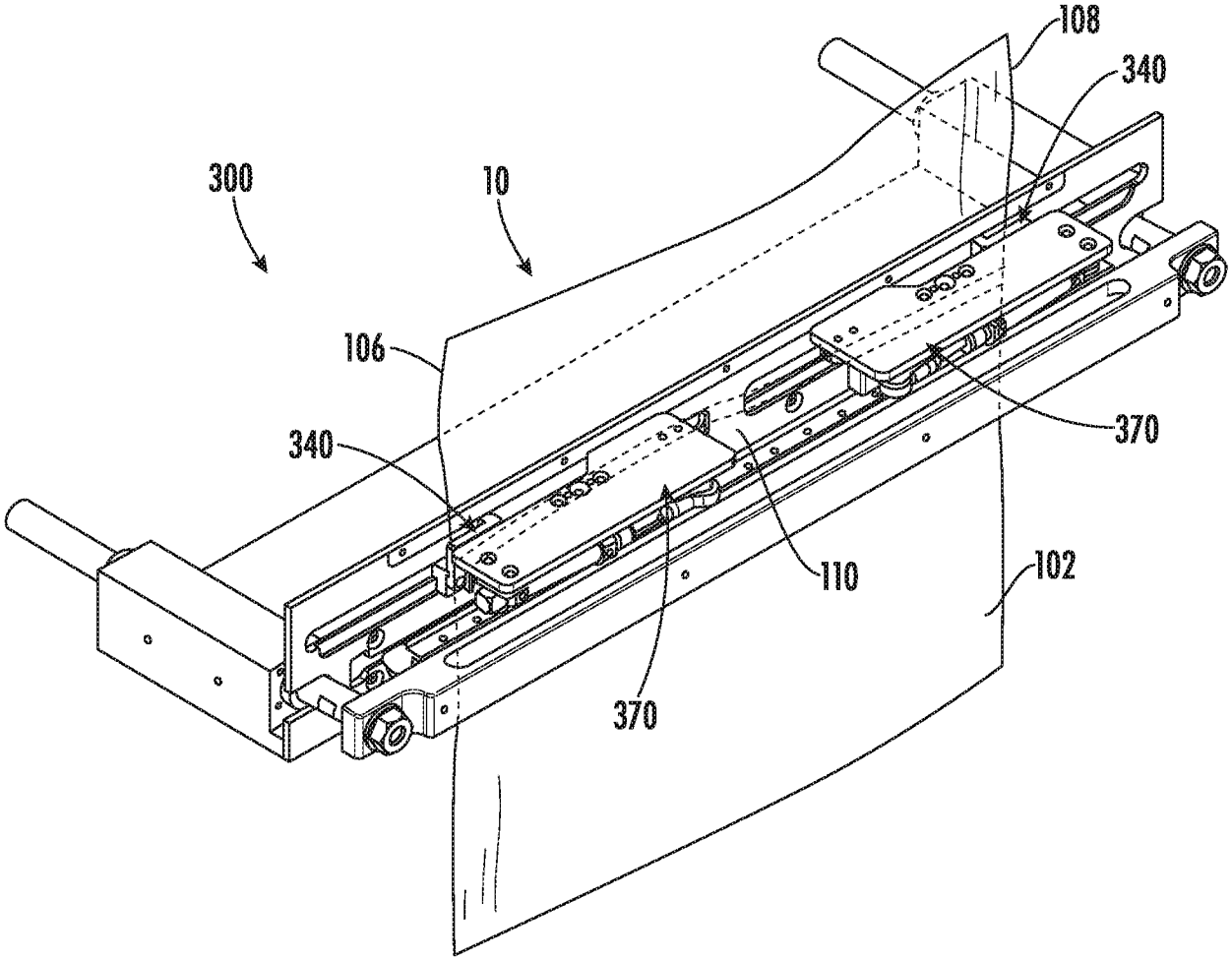
FIGS. 42-46 depict various views of an embodiment of the engagement members being moved inward to engage the sides of the web such that the sides slide along the flat portions and ramps of the engagement members, in accordance with the embodiments described herein.
Figure 43:
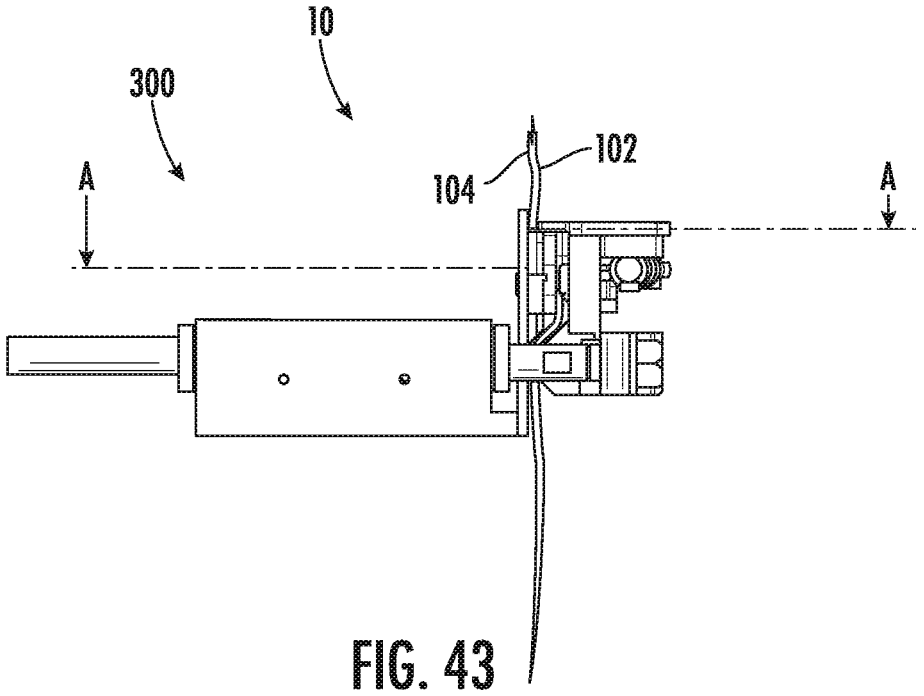
Figure 44:
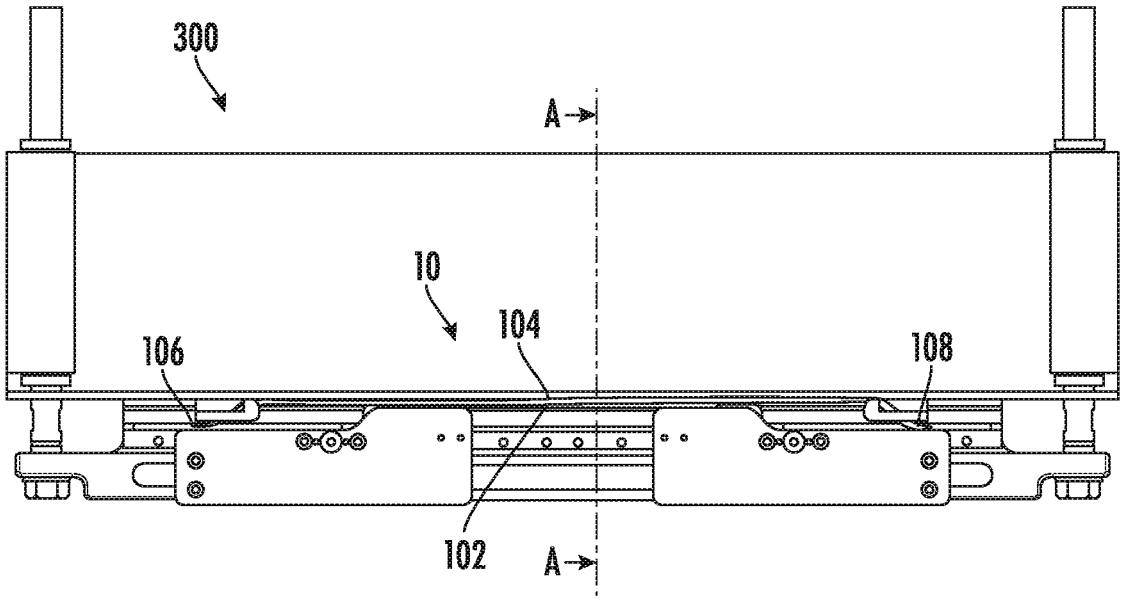
Figure 45:
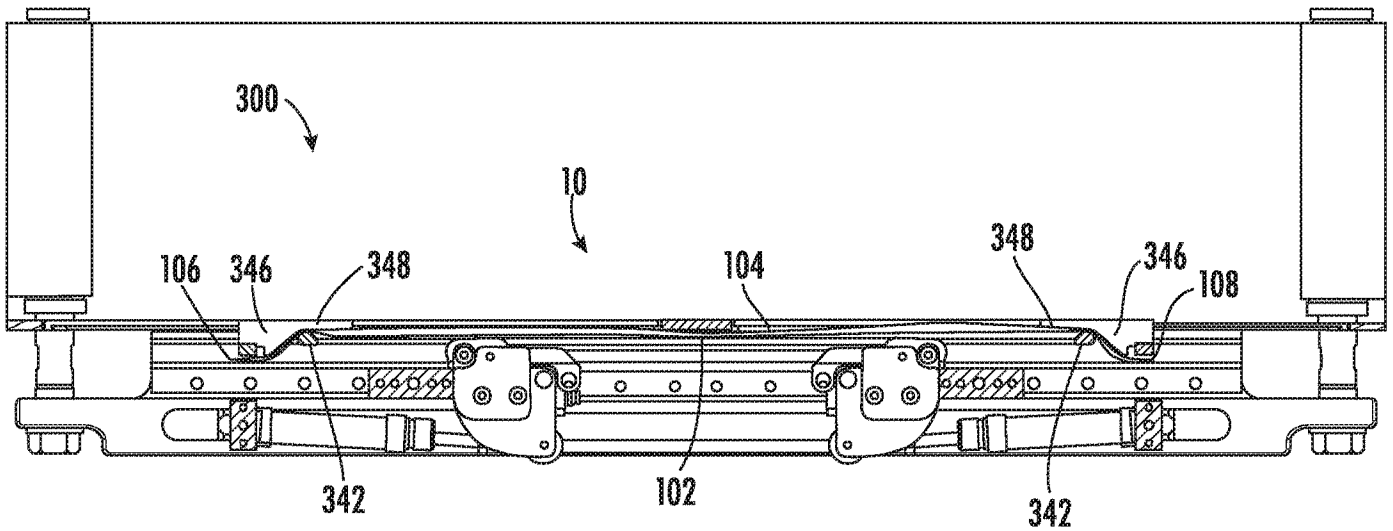
Figure 46:
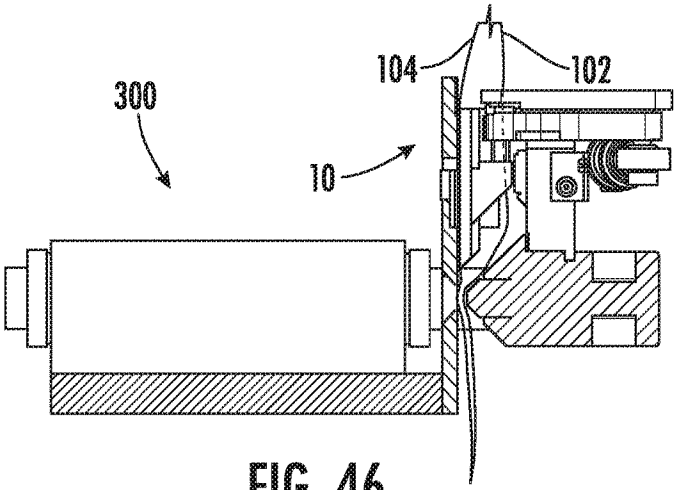
Figure 47:
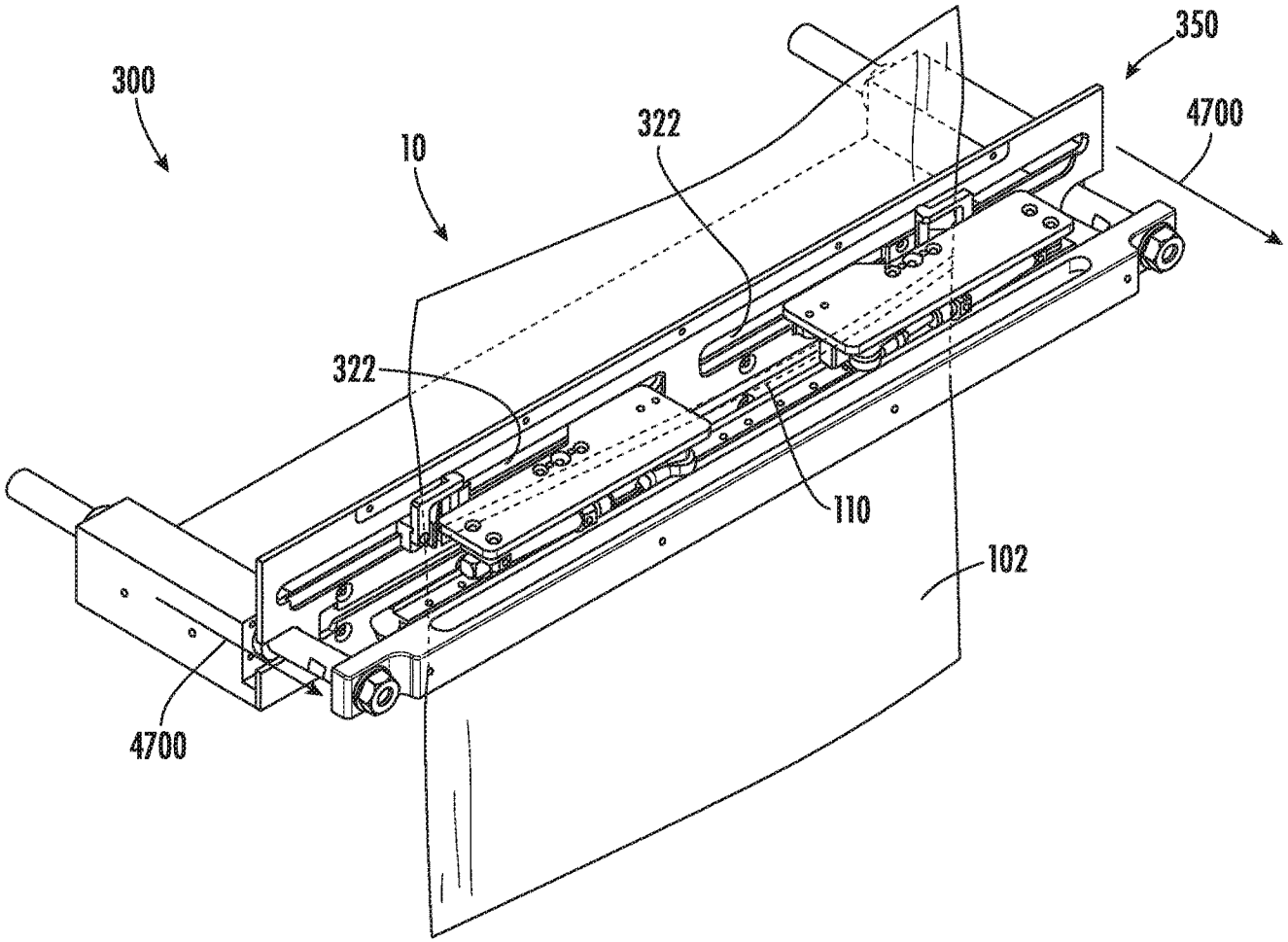
FIGS. 47-51 depict various views of an embodiment of the clamping arrangement being opened to a distance from the base, in accordance with the embodiments described herein.
Figure 48:
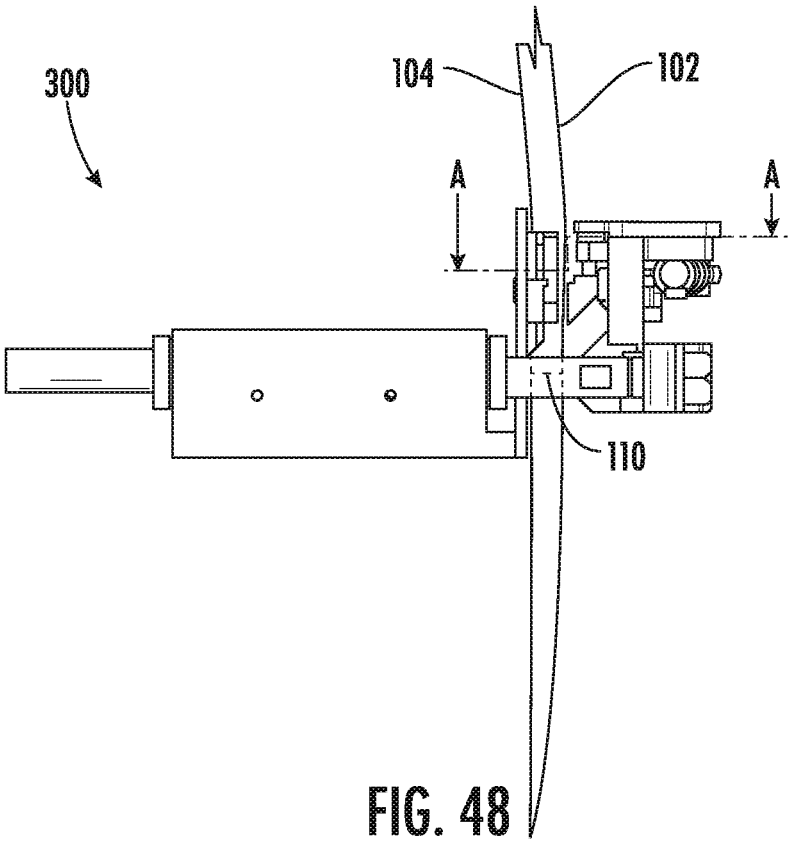
Figure 49:
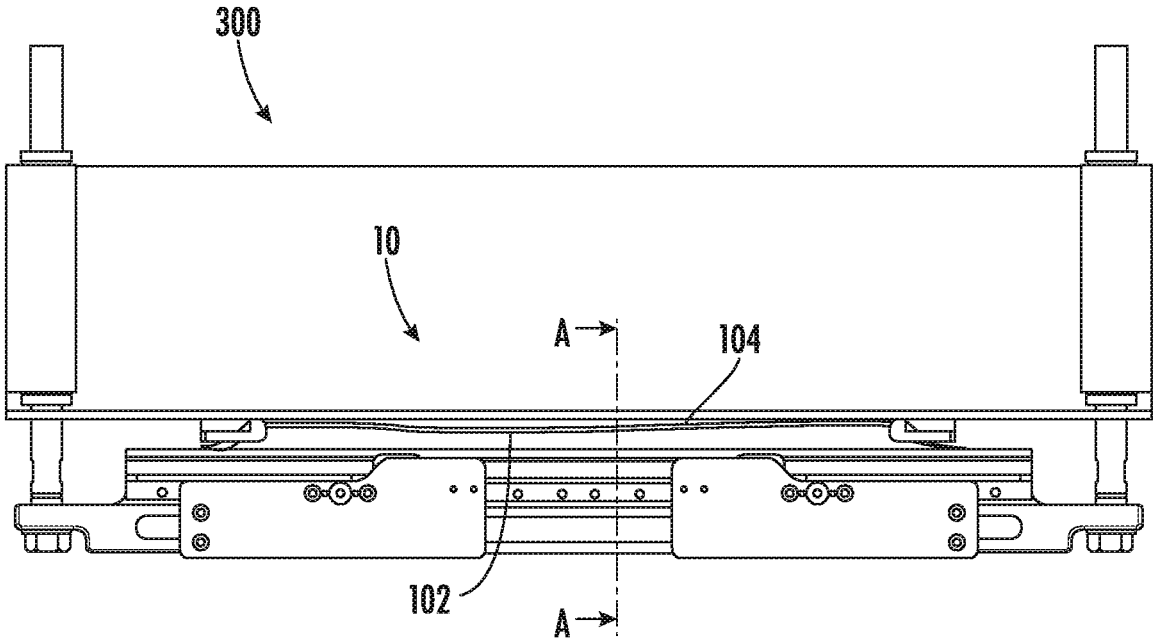
Figure 50:
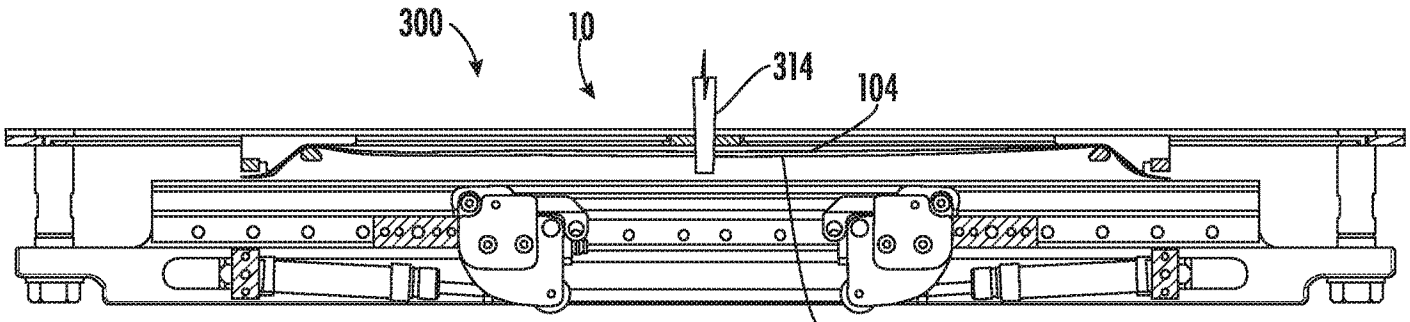
Figure 51:
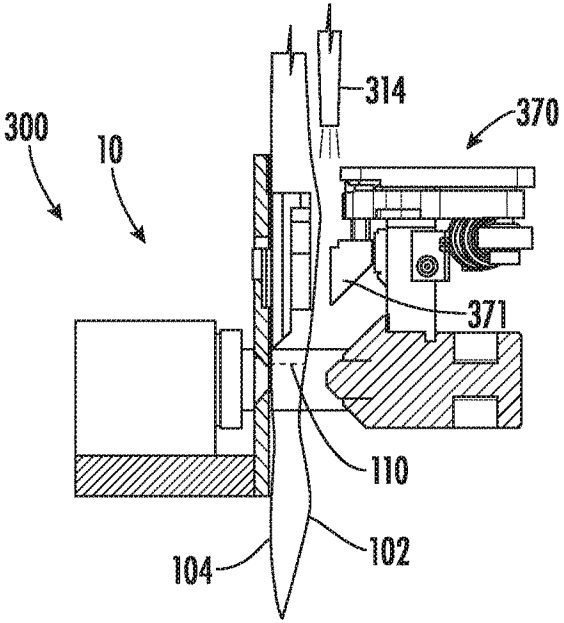
Figure 52:
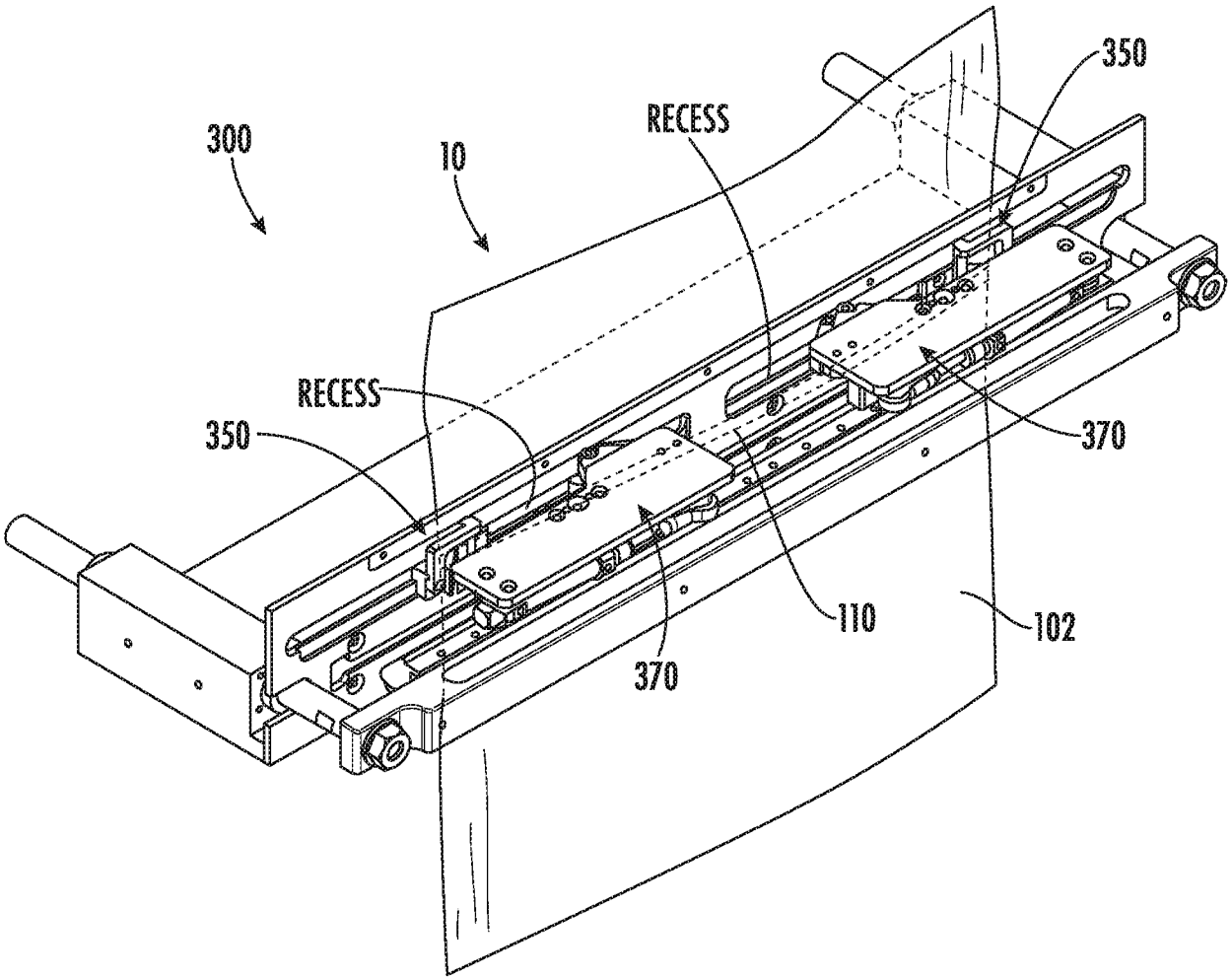
FIGS. 52-56 depict various views of an embodiment of the gripping arrangements being opened so that the grippers move into the engagement recess of the base, in accordance with the embodiments described herein.
Figure 53:
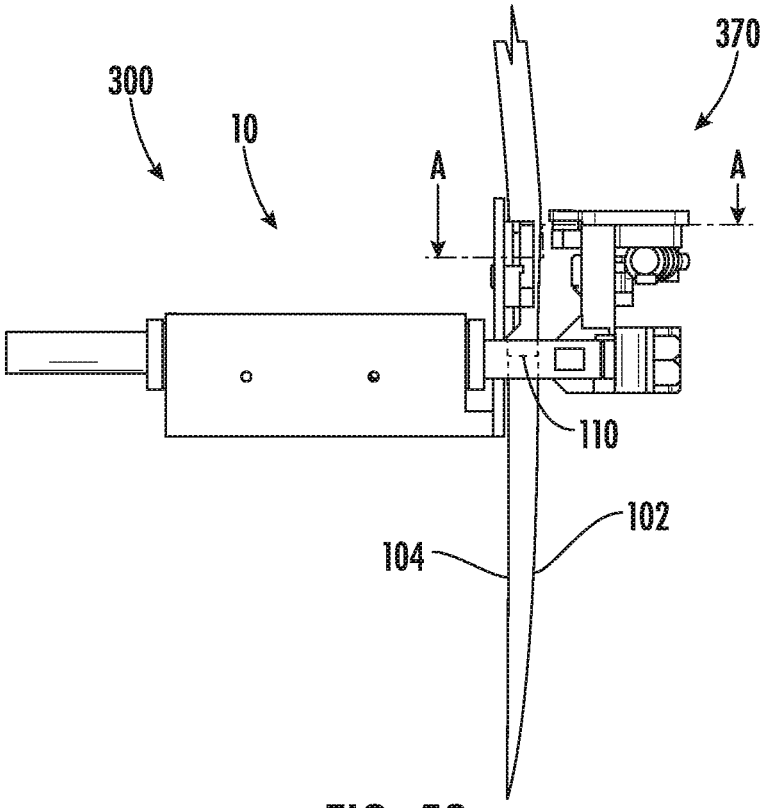
Figure 54:
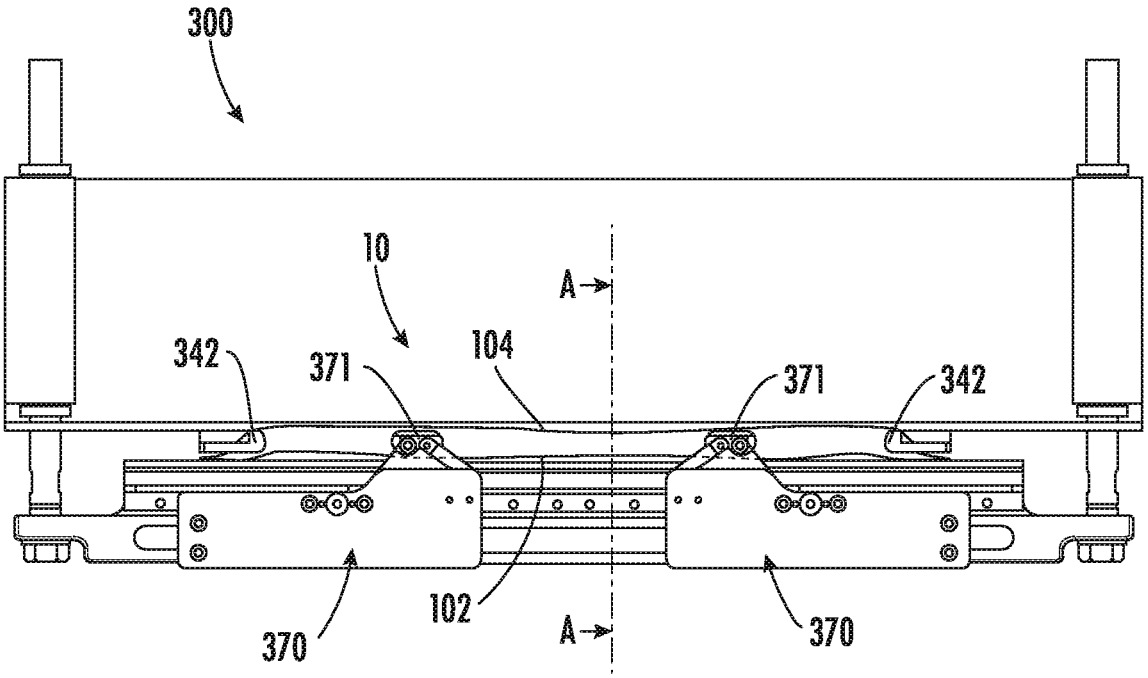
Figure 55:
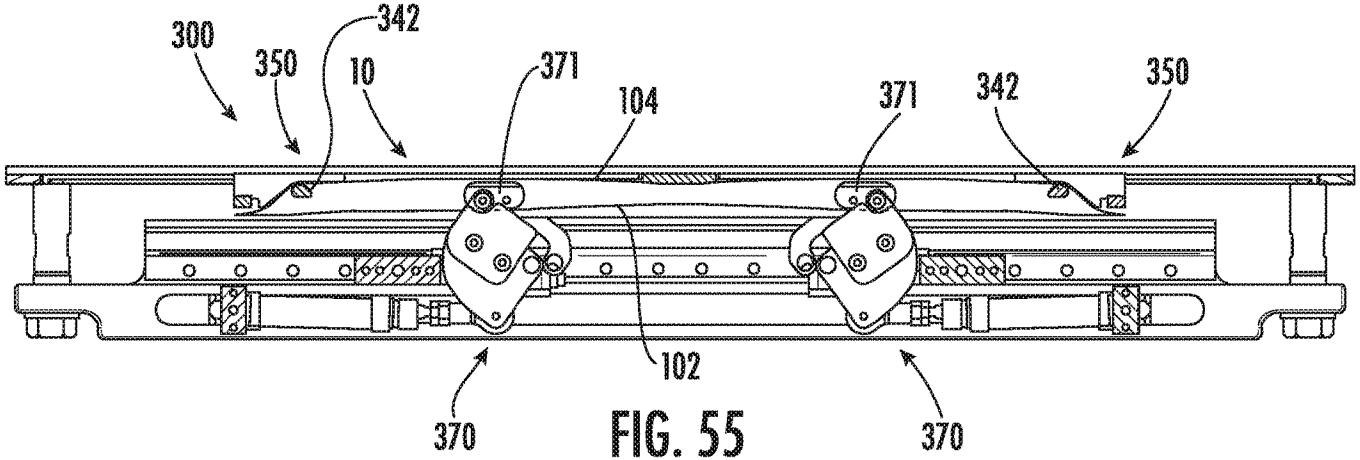
Figure 96:
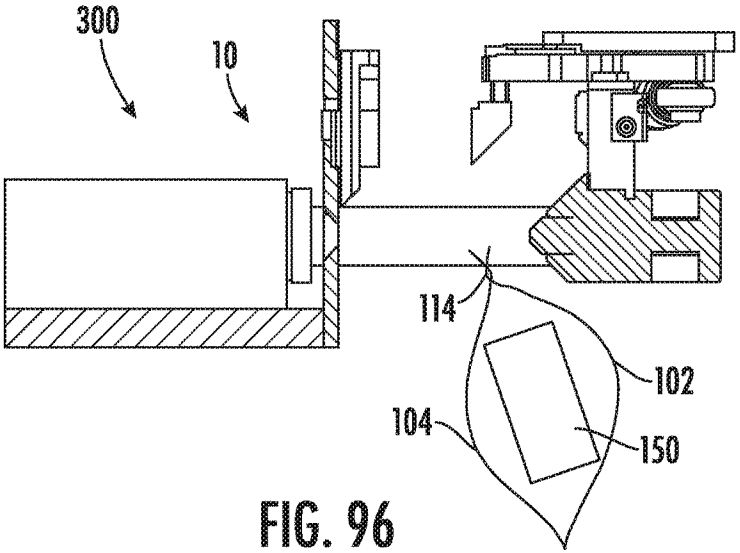

Referring now to FIGS. 37-96, the embodiment of a packaging machine 300 is shown being operated to make packages 14 from an elongated web 10 of preformed interconnected bags 100. Though not illustrated, the packaging machine 200 can be operated in a similar fashion to the packaging machine 300 shown in FIGS. 37-96. The concepts of the packaging machine 300 can be implemented in any of a wide variety of packaging machines, such as, for example, the packaging machine 200 illustrated in FIGS. 5-10. Additionally, U.S. Pat. No. 3,254,468 to H. Lerner, U.S. Pat. No. 4,928,455 to Gereby et al., U.S. Pat. No. 5,341,625 to Kramer, U.S. Pat. No. 5,394,676 to B. Lerner et al., U.S. Pat. No. 6,543,201 to Cronauer et al., U.S. Pat. Nos. 6,742,317, 5,394,676, 5,371,521, and 4,899,520 disclose packaging machines that can be modified in accordance with the present invention to make packages from an elongated web of preformed interconnected bags and are all incorporated herein by reference in their entirety.

Referring now to FIGS. 37-41, the packaging machine 300 is shown with the clamping arrangement 350 partially open so that the web 10 can be indexed along the path of travel 301 until the line of separation 110 is arranged below the engagement members 340 and the gripping arrangements 370. In some embodiments, the clamping arrangement 350 can be closed such that, when the gripping arrangements 370 are also closed, the grippers 371 help to keep the web 10 flat during indexing.

Referring now to FIGS. 42-46, after the line of separation 110 is arranged below the engagement members 340 and the gripping arrangements 370, the engagement members 340 are moved inward to engage the sides 106, 108 of the web 10. The inward movement of the engagement members 340 causes the sides 106, 108 to slide along the flat portions 348 and ramps 346 of the engagement members 340 until the sides 106, 108 of the web 10 are pushed away from the base 320 and beyond the fingers 342 of the engagement members 340. In this step, the separating lines of weakness 110 may partially open or break to begin to form the opening 103 in the web 10.

Referring now to FIGS. 47-51, the clamping arrangement 350 is opened in a direction 4700 to a distance from the base 320. In the depicted embodiment, the clamping arrangement 350 is opened to a distance such that the grippers 371 would be disposed within the engagement recess 322 if the gripping arrangements 370 were open. However, at the instance depicted in FIGS. 47-51, the gripping arrangements 370 remain closed to provide space between the web 10 and the clamping arrangement 350. A puff an air can now be optionally provided from the blower nozzle 314 (FIGS. 50 and 51) to cause the lines of weakness 100 to break further, thereby pre-opening the web 10.

Referring now to FIGS. 52-56, the gripping arrangements 370 are opened so that the grippers 371 move into the engagement recess 322 of the base 320. After the grippers 371 are in position shown in FIGS. 52-56, the web 10 is reversed indexed so that the fingers 342 and grippers 371 are inserted between the first and second plies 102, 104 to form an opening 103 of the bag 100, as can be seen in FIGS. 57-61. In some embodiments, the web 10 is reversed indexed until the top edge of the web 10 is at the top of the fingers 342 and grippers 371.

Referring now to FIGS. 62-66, the engagement members 340 are moved in an outward direction 6200 until the top portion of the bag 100 is taught. In some embodiments, failure of the engagement members 340, such as due to failure of the fingers 342 to enter the bag 100, is sensed by sensing the positions of the engagement members 340 when they are moved in the outward direction 6200 to cause the bag 100 to become taught. If one or both of the engagement members 340 fail to properly engage the bag 100 (e.g., by failing to enter the bag), the engagement member(s) will move further in the direction 6200 than expected. This excessive movement in the outward direction can be used to sense failure of one or both of the engagement members 340 to properly engage the bag 100. In some embodiments, the position sensors 336 can be used to detect the lateral position of the actuators 332, coupling members 334, and/or the engagement members 340. For example, the position sensors 336 can be configured to send a signal to the controller when the position sensors 336 detect that the engagement members 340 are in an initial or home position that is the outward most position of the engagement members 340. Detection of this home or initial position of the engagement members 340, when the engagement members are supposed to be engaging a bag 100 (which has a width that is less than the home position), indicates that the bag 100 has not been properly engaged by one or both of the engagement members.

Referring to FIGS. 67-71, the gripping arrangements 370 and clamping arrangement 350 are then closed so that the grippers 371 remain within the opening 103 of the bag 100 during closing of the gripping arrangements 370. In some embodiments, the gripping arrangements 370 and clamping arrangement 350 are closed substantially simultaneously. In some embodiments, this movement of the closing of the gripping arrangements 370 and clamping arrangement 350 is accomplished by de-energizing the gripper actuation mechanisms 360 so that the gripping arrangements 370 are closed by the grippers 371 engaging the base as the clamping mechanism 350 is closed. For example, the clamping mechanism 350 pushes the grippers 371 into the recess 322 and against the base, which pushes the gripping arrangement 370 closed. In this example, the gripping pads 376 are brought to the grippers 371 by the seal backer bar rather than the grippers 371 being brought to the gripping pads 376. Such a movement leaves the top portion of the first ply 102 undisturbed and results in a more secure grip of the first ply 102 when the gripping arrangements 370 are actuated to fully close the grippers 371, as depicted in FIGS. 67-71.

Referring now to FIGS. 72-76, the clamping arrangement 350 is opened while the engagement members 340 are moved inward to form an opening 103 for loading the product 150 into the bag 100. In the depicted embodiment, the opening 103 is a rectangular opening; the opening 103 can have other shapes in other embodiments. In some embodiments, the engagement members 340 are moved inward substantially simultaneously. The line of perforations 110 in the back ply 104 rips as the bag 100 is opened, except for the central area that defines one side of the rectangular opening. The back ply 104 also slides through the engagement members 340 as the opening 103 is formed. Proper engagement of the ply 102 by the gripping members 371 and pads 376 can be confirmed by sensing the presence of the ply at the gripping arrangement 370 when the clamping arrangement 350 is in the open, loading position. For example, the presence of the ply 102 (and thus, proper gripping of the bag 100 by the gripping arrangement 370) can be sensed by the gripping sensors 378. In the illustrated embodiment, the gripping sensor 378 is positioned such that the first ply 102, when successfully gripped by the gripper 371, will be directly in front of the sensor 378. In this embodiment, the sensor is a short-range optical sensor 378 calibrated to detect the material of the web 10. The gripping sensor 378 can be any suitable sensor, such as, for example, a proximity sensor, an optical sensor, an infrared sensor, a contact sensor, or the like. In some embodiments, the gripping sensor 378 is integrated in the gripper 371 and/or the gripping pad 376 and is configured to detect the presence of the material of the web 10.

Referring to FIGS. 77-81, after the product 150 is loaded into the bag 100, the clamping arrangement 350 is closed in a direction 7700. In some embodiments, the engagement members 340 are simultaneously moved outward 7710 to flatten the top portion of the bag 100 for sealing, as shown in FIGS. 77-81.

Referring to FIGS. 82-86, the clamping arrangement 350 is fully closed so that the heating element 326 can engage the web 10 to form the closing seal 114 between the first and second plies 102, 104. In some embodiments, the remainder of the perforation 110 in the ply 104 can be torn to separate the sealed package 14 from the supply of bags 12 by reverse indexing the web 12 by the indexing mechanism 310 while the clamping mechanism 350 holds the sealed package 14.

Referring now to FIGS. 87-91, the sealed package 14 can optionally held by the first ply 102 with the gripping arrangements 370 as the clamping arrangement 350 is opened. In some embodiments, the gripping arrangements 370 can continue holding the first ply 102 until the clamping arrangement 350 is opened to a desired release position, at which point the gripping arrangements 370 can be opened so that the package 14 can be removed from the machine 300. In some embodiments, the package 14 can be removed from the machine 300 by gravity as the weight of the package 14 causes the package 14 to drop from the machine 300 when the gripping arrangements 370 are opened.

Referring now to FIGS. 92-96, the package 14 is shown after having been removed from the machine 300. In the depicted embodiment, the package 14 is falling from the machine 300 after the gripping arrangements 370 have released the first ply 102 and the weight of the package 14 has caused the package 14 to begin falling from the machine 300.

While various inventive aspects, concepts and features of the disclosures may be described and illustrated herein as embodied in combination in the exemplary embodiments, these various aspects, concepts, and features may be used in many alternative embodiments, either individually or in various combinations and sub-combinations thereof. Unless expressly excluded herein all such combinations and sub-combinations are intended to be within the scope of the present application. Still further, while various alternative embodiments as to the various aspects, concepts, and features of the disclosures—such as alternative materials, structures, configurations, methods, devices, and components, alternatives as to form, fit, and function, and so on—may be described herein, such descriptions are not intended to be a complete or exhaustive list of available alternative embodiments, whether presently known or later developed. Those skilled in the art may readily adopt one or more of the inventive aspects, concepts, or features into additional embodiments and uses within the scope of the present application even if such embodiments are not expressly disclosed herein.

Additionally, even though some features, concepts, or aspects of the disclosures may be described herein as being a preferred arrangement or method, such description is not intended to suggest that such feature is required or necessary unless expressly so stated. Still further, exemplary or representative values and ranges may be included to assist in understanding the present application, however, such values and ranges are not to be construed in a limiting sense and are intended to be critical values or ranges only if so expressly stated.

As described herein, when one or more components are described as being connected, joined, affixed, coupled, attached, or otherwise interconnected, such interconnection may be direct as between the components or may be indirect such as through the use of one or more intermediary components. Also as described herein, reference to a "member," "component," or "portion" shall not be limited to a single structural member, component, or element but can include an assembly of components, members, or elements. Also as described herein, the terms "substantially" and "about" are defined as at least close to (and includes) a given value or state (preferably within 10% of, more preferably within 1% of, and most preferably within 0.1% of). Also as described herein, the phrase "line or area of weakness" may be a line or lines of perforations through a portion of a piece of material, a score line or lines that weaken a portion of a piece of material along a line or area, or other processing known in the art that weakens a portion of a piece of material to allow the piece of material to be separated or broken.

Moreover, while various aspects, features and concepts may be expressly identified herein as being inventive or forming part of a disclosure, such identification is not intended to be exclusive, but rather there may be inventive aspects, concepts, and features that are fully described herein without being expressly identified as such or as part of a specific disclosure, the disclosures instead being set forth in the appended claims. Descriptions of exemplary methods or processes are not limited to inclusion of all steps as being required in all cases, nor is the order that the steps are presented to be construed as required or necessary unless expressly so stated. The words used in the claims have their full ordinary meanings and are not limited in any way by the description of the embodiments in the specification.

What is claimed is:

1. A packaging machine, comprising:

an indexing mechanism configured to move a web of preformed bags along a path of travel, wherein the web includes first and second plies that extend between two sides of the web, seals that extends across the web between the two sides of the web to form bottoms of the bags, and lines of weakness in at least the second ply at tops of the bags, wherein each of the bags includes a compartment located between the first and second plies, between the two sides, and between one of the seals at the bottom of the bag and one of the lines of weakness at the top of the bag;

a base downstream of the indexing mechanism along the path of travel and configured to support a first engagement member, wherein the first engagement member includes a first finger having a beveled end; and a clamping arrangement configured to support a first gripper, wherein the first gripper includes a beveled surface and a gripping surface;

wherein the base further comprises a first engagement recess, wherein the first engagement member is positioned within the first engagement recess, and wherein the beveled end of the first finger is capable of being disposed within the first engagement recess; and wherein the indexing mechanism is configured to reverse index the web when the beveled end of the first finger is disposed within the first engagement recess so that the first finger and the first gripper are inserted into the top of one of the bags with the second ply sliding between the first finger and the base and the first ply being engaged by the beveled surface of the first gripper.

2. The packaging machine of claim 1, wherein the indexing mechanism is configured to reverse index the web until the first ply is engaged by the gripping surface of the first gripper.

3. The packaging machine of claim 2, wherein the clamping arrangement further comprises:

a first gripping pad;

a first gripper actuator configured to move the first gripper with respect to the first gripping pad; and a controller configured to cause the first ply to be gripped between the first gripping surface and the first gripping pad by causing the first gripper actuator to move the first gripper toward the first gripping pad after the first ply is engaged by the gripping surface of the first gripper.

4. The packaging machine of claim 3, further comprising:

a sensor configured to detect whether the first ply is gripped by the gripper and to send a signal to the controller in response to detecting that the first ply being gripped by the gripper.

5. The packaging machine of claim 1, wherein:

the base is further configured to support a second engagement member, wherein the second engagement member includes a second finger having a beveled end;

the clamping arrangement is further configured to support a second gripper, wherein the second gripper includes a beveled surface and a gripping surface;

the base further comprises a second engagement recess, wherein the second engagement member is positioned within the second engagement recess, and wherein the beveled end of the second finger is capable of being disposed within the second engagement recess; and the indexing mechanism is further configured to reverse index the web when the beveled end of the second finger is disposed within the second engagement recess so that the second finger and the second gripper are inserted into the top of the one of the bags with the second ply sliding between the second finger and the base and the first ply being engaged by the beveled surface of the second gripper.

6. The packaging machine of claim 5, wherein the indexing mechanism is configured to reverse index the web until the first ply is engaged by the gripping surface of the first gripper.

7. The packaging machine of claim 5, wherein:

the first engagement member is configured to move laterally within the first engagement recess; and the second engagement member is configured to move laterally within the second engagement recess.

8. The packaging machine of claim 7, wherein, after the first and second fingers are inserted between the first and second plies, the first and second engagement members are configured to move laterally outward away from each other to pull an opening of the bag taught between the first and second engagement members.

9. The packaging machine of claim 5, wherein the clamping arrangement is movable with respect to the base between open and closed positions, and wherein the clamping arrangement is in the closed position when the first gripper is disposed within the first engagement recess and the second gripper is disposed within the second engagement recess.

10. The packaging machine of claim 9, wherein the clamping arrangement is configured to move away from the base after the first and second fingers and the first and second grippers have been inserted into the top of the one of the bags to form an opening at the top of the one of the bags.

11. The packaging machine of claim 10, wherein:

the first engagement member is configured to move laterally within the first engagement recess based on a predetermined size or shape of the opening at the top of the bag; and the second engagement member is configured to move laterally within the second engagement recess based on the predetermined size or shape of the opening at the top of the bag.

12. The packaging machine of claim 10, wherein the first and second fingers and the first and second grippers are configured to hold the opening of the one of the bags as a product is loaded into the one of the bags.

13. The packaging machine of claim 12, wherein, after the product is loaded into the one of the bags, the clamping arrangement is configured to move to the closed position to close the opening of the one of the bags, and wherein the packaging machine comprises a sealing mechanism configured to form a closing seal in the one of the bags.

14. The packaging machine of claim 13, wherein the first and second engagement members are configured to move away from each other laterally with the first and second recesses, respectively, to flatten the opening of the bag before the closing seal is formed in the one of the bags.

15. The packaging machine of claim 13, wherein, while the clamping arrangement is in the closed position, the indexing mechanism is configured to reverse index the web to cause a line of weakness in the second ply at the top of the one of the bags to break.

16. The packaging machine of claim 15, wherein, after the closing seal is formed in the one of the bags and the line of weakness in the second ply at the top of the one of the bags is broken, the first and second grippers are configured to continue gripping the second ply as the clamping arrangement is moved away from the base.

17. The packaging machine of claim 16, wherein, after the clamping arrangement is moved away from the base, the first and second grippers are configured to open to allow the one of the bags to be removed from the packaging machine.

18. The packaging machine of claim 1, wherein the base further comprises a first horizontal ramp that protrudes outward from a flat portion that fits within the first engagement recess, and wherein indexing of the web by the indexing mechanism causes one of the two sides of the web to slide over the flat portion and along the ramp toward the first finger, which a line of weakness in the first ply to partially break near the first finger.

19. The packaging machine of claim 1, further comprising:

a blower nozzle configured to supply a puff of air to help separate the first and second plies by the first finger.

20. The packaging machine of claim 1, further comprising:

a position sensor configured to detect a lateral position of the first engagement member.

21. The packaging machine of claim 20, further comprising:

a controller configured to determine whether the first finger has engaged the first ply based on an indication of the lateral position of the first engagement member from the position sensor.

22. A method of opening a bag using the packaging machine of claim 1, the method comprising:

moving, by the indexing mechanism of the packaging machine, the web of preformed bags along a path of travel until one of the lines of weakness is downstream of the first finger and the first gripper;

moving the clamping arrangement of the packaging machine so that the beveled end of the first finger is disposed within the first engagement recess;

reverse indexing the web, by the indexing mechanism, so that the first finger and the first gripper are inserted into the top of one of the bags with the second ply sliding between the first finger and the base and the first ply being engaged by the beveled surface of the first gripper.

* * * * *